US010661114B2

(12) United States Patent
Watterson et al.

(10) Patent No.: US 10,661,114 B2
(45) Date of Patent: May 26, 2020

(54) BODY WEIGHT LIFT MECHANISM ON TREADMILL

(71) Applicant: ICON Health & Fitness, Inc., Logan, UT (US)

(72) Inventors: Scott R. Watterson, Logan, UT (US); William T. Dalebout, North Logan, UT (US); Kent M. Smith, Nibley, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 114 days.

(21) Appl. No.: 15/787,411

(22) Filed: Oct. 18, 2017

(65) Prior Publication Data

US 2018/0117385 A1 May 3, 2018

Related U.S. Application Data

(60) Provisional application No. 62/415,933, filed on Nov. 1, 2016.

(51) Int. Cl.

| | |
|---|---|
| ***A63B 21/068*** | (2006.01) |
| ***A63B 23/04*** | (2006.01) |
| ***A63B 23/035*** | (2006.01) |
| ***A63B 21/00*** | (2006.01) |
| ***A63B 22/00*** | (2006.01) |
| ***A63B 22/02*** | (2006.01) |

(Continued)

(52) U.S. Cl.

CPC ..... *A63B 21/068* (2013.01); *A63B 21/159* (2013.01); *A63B 21/4035* (2015.10); *A63B 21/4047* (2015.10); *A63B 22/0012* (2013.01); *A63B 22/025* (2015.10); *A63B 23/0355* (2013.01); *A63B 23/0405* (2013.01); *A63B 22/0023* (2013.01); *A63B 24/0075* (2013.01); *A63B 71/0622* (2013.01); *A63B 2023/0411* (2013.01); *A63B 2071/0625* (2013.01); *A63B 2220/20* (2013.01); *A63B 2220/62* (2013.01); *A63B 2230/06* (2013.01); *A63B 2230/75* (2013.01)

(58) Field of Classification Search

CPC . A63B 21/068; A63B 21/159; A63B 21/4047; A63B 21/4035; A63B 21/0615; A63B 21/1127; A63B 21/0204; A63B 22/0012; A63B 22/0015–0017; A63B 22/0023; A63B 22/0046; A63B 22/0048; A63B 23/0405; A63B 23/0355; A63B 2220/62; A63B 2220/20; A63B 2230/75; A63B 2230/06; A63B 2071/0625; A63B 71/0622; A63B 2023/0411; A63B 24/0075; A63B 2210/50; A63B 2022/0051; A63B 2022/0053; A63B 22/02–0292

USPC ..... 482/96, 51, 137

See application file for complete search history.

(56) References Cited

U.S. PATENT DOCUMENTS

| | | | |
|---|---|---|---|
| 9,595 | A | 2/1853 | Moreland |
| 9,695 | A | 5/1853 | Hinsdale |
| 34,577 | A | 3/1862 | Jabden |

(Continued)

*Primary Examiner* — Nyca T Nguyen
*Assistant Examiner* — Kathleen Vermillera
(74) *Attorney, Agent, or Firm* — Ray Quinney & Nebeker

(57) ABSTRACT

An exercise machine may include a frame, a base portion of the frame, a deck pivotally connected at a rear end, an upright structure of the frame, a handle movably attached to the frame, and a linkage connecting the handle to the first end of the deck. An elevation of the first end of the deck changes when the handle is moved.

19 Claims, 12 Drawing Sheets

(51) Int. Cl.
*A63B 24/00* (2006.01)
*A63B 71/06* (2006.01)

(56) References Cited

U.S. PATENT DOCUMENTS

| | | | |
|---|---|---|---|
| 104,973 | A | 7/1870 | Man |
| 115,826 | A | 6/1871 | Creed |
| 192,338 | A | 6/1877 | Marshall |
| 232,022 | A | 9/1880 | Gifford |
| 232,579 | A | 9/1880 | Weeks |
| 248,121 | A | 10/1881 | Tuttle |
| 284,294 | A | 9/1883 | Graves |
| 321,388 | A | 6/1885 | Ruebsam |
| 325,435 | A | 9/1885 | North |
| 337,942 | A | 3/1886 | Parley |
| 339,638 | A | 4/1886 | Goldie |
| 353,089 | A | 11/1886 | Smith |
| 356,219 | A | 1/1887 | Yeoman |
| 359,778 | A | 3/1887 | Pauber |
| 372,272 | A | 10/1887 | Murphy |
| 374,496 | A | 12/1887 | Reach |
| 421,779 | A | 2/1890 | Steven |
| 428,912 | A | 5/1890 | Holmes |
| 447,780 | A | 3/1891 | Luge |
| 450,792 | A | 4/1891 | Dodd |
| 457,400 | A | 8/1891 | Dowd |
| 480,271 | A | 8/1892 | Newton |
| 484,352 | A | 10/1892 | Ayton |
| 588,350 | A | 8/1897 | Perkins |
| 603,350 | A | 5/1898 | Towers |
| 610,716 | A | 9/1898 | Marshal |
| 624,995 | A | 5/1899 | Tellefsen |
| 659,216 | A | 10/1900 | Dowling |
| 663,486 | A | 12/1900 | Boren |
| 674,391 | A | 5/1901 | Baker |
| 679,784 | A | 8/1901 | Ryan |
| 680,556 | A | 8/1901 | Wray |
| 682,988 | A | 9/1901 | Carroll |
| 683,284 | A | 9/1901 | Honey |
| 685,788 | A | 11/1901 | Mcfadden |
| 689,418 | A | 12/1901 | Ryan |
| 722,462 | A | 3/1903 | Smith |
| 723,625 | A | 3/1903 | Thornley |
| 754,992 | A | 3/1904 | Grabner |
| 760,374 | A | 5/1904 | Belvoir |
| 761,504 | A | 5/1904 | Kleinbach |
| 766,930 | A | 8/1904 | Clemons |
| 772,906 | A | 10/1904 | Reach |
| 776,824 | A | 12/1904 | Bryon, Jr. |
| 807,670 | A | 12/1905 | Grabner |
| 846,389 | A | 3/1907 | Blackburn |
| 852,193 | A | 4/1907 | Mcmillan |
| 881,521 | A | 3/1908 | Wilson |
| 897,722 | A | 9/1908 | Day |
| 931,394 | A | 8/1909 | Day |
| 937,795 | A | 10/1909 | Hackney |
| 943,127 | A | 12/1909 | Van Boven |
| 964,745 | A | 7/1910 | Blakoe |
| 979,609 | A | 12/1910 | Vaughn |
| 1,016,729 | A | 2/1912 | Barrett |
| 1,019,861 | A | 3/1912 | Titus |
| 1,020,777 | A | 3/1912 | Peterson |
| 1,064,968 | A | 6/1913 | Hagen |
| 1,082,940 | A | 12/1913 | Flora |
| 1,115,826 | A | 11/1914 | Johnson |
| 1,123,272 | A | 1/1915 | Goodman |
| 1,144,085 | A | 6/1915 | Abplanalp |
| 1,211,765 | A | 1/1917 | Schmidt |
| 1,316,683 | A | 9/1919 | Calvert |
| 1,422,888 | A | 7/1922 | Reeves |
| 1,495,278 | A | 5/1924 | Titus |
| 1,539,214 | A | 5/1925 | Shockey |
| 1,570,482 | A | 1/1926 | Hale |
| 1,576,474 | A | 3/1926 | Walker |
| 1,580,530 | A | 4/1926 | Rambo |
| 1,585,748 | A | 5/1926 | Wendelken |
| 1,672,944 | A | 6/1928 | Jowett |
| 1,698,831 | A | 1/1929 | Titus |
| 1,715,870 | A | 6/1929 | Spain |
| 1,766,089 | A | 6/1930 | Wood |
| 1,778,635 | A | 10/1930 | Heisler |
| 1,824,406 | A | 9/1931 | Petersime |
| 1,850,530 | A | 3/1932 | Brown |
| 1,851,843 | A | 3/1932 | Inman |
| 1,893,728 | A | 1/1933 | Bullis |
| 1,902,694 | A | 3/1933 | Edwards |
| 1,917,566 | A | 7/1933 | Wood |
| 1,919,627 | A | 7/1933 | Fitz Gerald |
| 1,928,089 | A | 9/1933 | Blickman |
| 1,973,945 | A | 9/1934 | Chavin |
| 1,978,579 | A | 10/1934 | Hooks |
| 1,982,843 | A | 12/1934 | Traver |
| 1,982,872 | A | 12/1934 | Newton |
| 1,991,520 | A | 2/1935 | Postl |
| 2,067,136 | A | 1/1937 | Bridenbaugh |
| 2,117,957 | A | 5/1938 | Ritter |
| 2,129,262 | A | 9/1938 | Cole |
| 2,145,940 | A | 2/1939 | Marlowe |
| 2,153,077 | A | 4/1939 | Clarke |
| 2,165,700 | A | 7/1939 | Glynn |
| 2,177,957 | A | 10/1939 | Stewart |
| 2,183,345 | A | 12/1939 | Brandon |
| 2,209,034 | A | 7/1940 | Rene |
| 2,219,219 | A | 10/1940 | Boger |
| 2,247,946 | A | 7/1941 | Hein et al. |
| 2,255,864 | A | 9/1941 | Stephens |
| 2,274,574 | A | 2/1942 | Zerne |
| 2,315,485 | A | 4/1943 | Le Roy |
| 2,346,105 | A | 4/1944 | Haehnel |
| 2,379,984 | A | 7/1945 | Nereaux |
| 2,399,915 | A | 5/1946 | Drake |
| 2,436,987 | A | 3/1948 | Bailleaux |
| 2,438,548 | A | 3/1948 | Ehmann |
| 2,440,644 | A | 4/1948 | Powell |
| 2,456,017 | A | 12/1948 | Park |
| 2,470,544 | A | 5/1949 | Bell |
| 2,472,391 | A | 6/1949 | Albizu |
| 2,500,299 | A | 3/1950 | Spitzkeit |
| 2,512,417 | A | 6/1950 | Polite |
| 2,569,007 | A | 9/1951 | Klyce |
| 2,573,351 | A | 10/1951 | Motis |
| 2,607,816 | A | 8/1952 | Ryder |
| 2,632,645 | A | 3/1953 | Barkschat |
| 2,637,319 | A | 5/1953 | Bruene |
| 2,640,696 | A | 6/1953 | Lemieux |
| 2,641,250 | A | 6/1953 | Brockman |
| 2,642,288 | A | 6/1953 | Bell |
| 2,645,539 | A | 7/1953 | Thompson |
| 2,646,282 | A | 7/1953 | Ringman |
| 2,648,540 | A | 8/1953 | Hunter |
| 2,654,135 | A | 10/1953 | Grizzard et al. |
| 2,674,453 | A | 4/1954 | Hummert |
| 2,695,797 | A | 11/1954 | Mccarthy et al. |
| 2,714,507 | A | 8/1955 | Goodrich |
| 2,740,178 | A | 4/1956 | Kellems |
| 2,743,623 | A | 5/1956 | Wells |
| 2,746,822 | A | 5/1956 | Copenhaver |
| 2,763,156 | A | 9/1956 | Garigal |
| 2,842,365 | A | 7/1958 | Kelley |
| 2,843,858 | A | 7/1958 | Bjorklund |
| 2,855,200 | A | 10/1958 | Blickman |
| 2,874,971 | A | 2/1959 | Devery |
| 2,924,456 | A | 2/1960 | Miller |
| 2,927,006 | A | 3/1960 | Brooks |
| 2,938,695 | A | 5/1960 | Ciampa |
| 2,968,337 | A | 1/1961 | Bartlett |
| 2,969,060 | A | 1/1961 | Swanda |
| 2,977,120 | A | 3/1961 | Morris |
| 2,978,830 | A | 4/1961 | Killian |
| 2,984,594 | A | 5/1961 | Runton |
| 2,985,933 | A | 5/1961 | Peterson et al. |
| 3,000,628 | A | 9/1961 | Kellogg |
| 3,035,671 | A | 5/1962 | Sicherman |
| 3,057,201 | A | 10/1962 | Jaeger |

(56) References Cited

U.S. PATENT DOCUMENTS

| | | | |
|---|---|---|---|
| 3,059,312 | A | 10/1962 | Jamieson |
| 3,068,002 | A | 12/1962 | Balne |
| 3,068,950 | A | 12/1962 | Davidson |
| 3,072,426 | A | 1/1963 | Gilbert |
| 3,090,092 | A | 5/1963 | Szemplak |
| 3,099,509 | A | 7/1963 | Duenke |
| 3,112,108 | A | 11/1963 | Hanke |
| 3,115,332 | A | 12/1963 | Singleton |
| 3,118,441 | A | 1/1964 | Prosser |
| 3,127,171 | A | 3/1964 | Noland et al. |
| 3,161,395 | A | 12/1964 | Carter |
| 3,179,071 | A | 4/1965 | Johnston |
| 3,193,287 | A | 7/1965 | Robinson |
| 3,194,598 | A | 7/1965 | Goldfuss |
| 3,205,888 | A | 9/1965 | Stroop |
| 3,246,894 | A | 4/1966 | Salisbury |
| 3,256,630 | A | 6/1966 | Spector |
| 3,270,494 | A | 9/1966 | Holmes |
| 3,312,466 | A | 4/1967 | Melchiona |
| 3,316,898 | A | 5/1967 | Brown |
| 3,319,273 | A | 5/1967 | Lawrence |
| 3,323,367 | A | 6/1967 | Searle |
| 3,342,485 | A | 9/1967 | Martin |
| 3,345,067 | A | 10/1967 | Smith |
| 3,349,621 | A | 10/1967 | Mullen |
| 3,358,813 | A | 12/1967 | Kohlhagen |
| 3,370,584 | A | 2/1968 | William |
| 3,373,993 | A | 3/1968 | Oja et al. |
| 3,378,259 | A | 4/1968 | Kupchinski |
| 3,380,737 | A | 4/1968 | Petros |
| 3,381,958 | A | 5/1968 | Gulland |
| 3,384,370 | A | 5/1968 | Eugene et al. |
| 3,390,460 | A | 7/1968 | Brown |
| 3,408,067 | A | 10/1968 | Armstrong |
| 3,408,069 | A | 10/1968 | Lewis |
| 3,411,497 | A | 11/1968 | Rickey et al. |
| 3,411,776 | A | 11/1968 | Holkesvick et al. |
| 3,416,174 | A | 12/1968 | Novitske |
| 3,428,311 | A | 2/1969 | Mitchell |
| 3,428,312 | A | 2/1969 | Machen |
| 3,430,084 | A | 2/1969 | Hall |
| 3,430,507 | A | 3/1969 | Hurst et al. |
| 3,432,164 | A | 3/1969 | Deeks |
| 3,438,627 | A | 4/1969 | La Lanne |
| 3,444,830 | A | 5/1969 | Doetsch |
| 3,446,503 | A | 5/1969 | Lawton |
| 3,456,592 | A | 7/1969 | Nelsen |
| 3,465,592 | A | 9/1969 | Perrine |
| 3,482,835 | A | 12/1969 | Dean |
| 3,488,051 | A | 1/1970 | Papistas Scherer |
| 3,495,824 | A | 2/1970 | Cuinier |
| 3,501,140 | A | 3/1970 | Eichorn |
| 3,511,500 | A | 5/1970 | Dunn |
| 3,514,110 | A | 5/1970 | Thomander |
| 3,518,985 | A | 7/1970 | Quinton |
| 3,522,947 | A | 8/1970 | Anderson |
| 3,540,724 | A | 11/1970 | Hunter |
| 3,547,435 | A | 12/1970 | Scott |
| 3,554,541 | A | 1/1971 | Spoth |
| 3,563,541 | A | 2/1971 | Sanquist |
| 3,566,861 | A | 3/1971 | Weiss |
| 3,567,219 | A | 3/1971 | Foster |
| 3,568,669 | A | 3/1971 | Stites |
| 3,572,700 | A | 3/1971 | Mastropaolo |
| 3,583,465 | A | 6/1971 | Youngs et al. |
| 3,586,322 | A | 6/1971 | Kverneland |
| 3,588,101 | A | 6/1971 | Jungreis |
| 3,589,193 | A | 6/1971 | Thornton |
| 3,589,715 | A | 6/1971 | Mark |
| 3,589,720 | A | 6/1971 | Agamian |
| 3,592,466 | A | 7/1971 | Parsons |
| 3,598,404 | A | 8/1971 | Bowman |
| 3,601,398 | A | 8/1971 | Brochman |
| 3,602,502 | A | 8/1971 | Jaegar |
| 3,606,320 | A | 9/1971 | Erwin, Jr. |
| 3,606,406 | A | 9/1971 | Walters |
| 3,608,898 | A | 9/1971 | Berlin |
| 3,614,097 | A | 10/1971 | Blickman |
| 3,614,108 | A | 10/1971 | Garten |
| 3,617,056 | A | 11/1971 | Herbold |
| 3,628,654 | A | 12/1971 | Haracz |
| 3,628,791 | A | 12/1971 | Garcia |
| 3,634,895 | A | 1/1972 | Childers |
| 3,636,577 | A | 1/1972 | Nissen |
| 3,638,941 | A | 2/1972 | Kulkens |
| 3,640,528 | A | 2/1972 | Proctor |
| 3,640,530 | A | 2/1972 | Henson et al. |
| 3,641,601 | A | 2/1972 | Sieg |
| 3,642,279 | A | 2/1972 | Cutter |
| 3,643,943 | A | 2/1972 | Erwin, Jr. et al. |
| 3,647,209 | A | 3/1972 | La Lanne |
| 3,650,529 | A | 3/1972 | Salm |
| 3,652,085 | A | 3/1972 | Civalier |
| 3,658,327 | A | 4/1972 | Thiede |
| 3,659,845 | A | 5/1972 | Quinton |
| 3,664,666 | A | 5/1972 | Lloyd |
| 3,664,910 | A | 5/1972 | Hollie |
| 3,664,916 | A | 5/1972 | Grellier et al. |
| 3,672,124 | A | 6/1972 | Pirotta |
| 3,679,244 | A | 7/1972 | Reddy |
| 3,686,776 | A | 8/1972 | Dahl |
| 3,689,066 | A | 9/1972 | Hagen |
| 3,690,655 | A | 9/1972 | Chapman |
| 3,703,284 | A | 11/1972 | Hesen |
| 3,708,166 | A | 1/1973 | Annas |
| 3,708,167 | A | 1/1973 | Potgieter |
| 3,709,197 | A | 1/1973 | Moseley |
| 3,731,917 | A | 5/1973 | Townsend |
| 3,738,649 | A | 6/1973 | Miller |
| 3,741,538 | A | 6/1973 | Useldinger |
| 3,751,033 | A | 8/1973 | Rosenthal |
| 3,756,595 | A | 9/1973 | Hague |
| 3,758,109 | A | 9/1973 | Bender |
| 3,759,511 | A | 9/1973 | Zinkin |
| 3,761,083 | A | 9/1973 | Buchner |
| 3,767,195 | A | 10/1973 | Dimick |
| 3,771,785 | A | 11/1973 | Speyer |
| 3,784,193 | A | 1/1974 | Simjian |
| 3,788,412 | A | 1/1974 | Vincent |
| 3,789,467 | A | 2/1974 | Aratani et al. |
| 3,792,860 | A | 2/1974 | Selnes |
| 3,797,624 | A | 3/1974 | Powell et al. |
| 3,802,701 | A | 4/1974 | Good |
| 3,807,728 | A | 4/1974 | Chillier |
| 3,809,393 | A | 5/1974 | Jones |
| 3,814,420 | A | 6/1974 | Encke |
| 3,815,903 | A | 6/1974 | Blomqvist |
| 3,822,488 | A | 7/1974 | Johnson |
| 3,822,599 | A | 7/1974 | Brentham |
| 3,825,253 | A | 7/1974 | Speyer |
| 3,826,491 | A | 7/1974 | Elder |
| 3,831,942 | A | 8/1974 | Del Mar |
| 3,833,216 | A | 9/1974 | Philbin |
| 3,834,696 | A | 9/1974 | Spector |
| 3,840,227 | A | 10/1974 | Chesemore |
| 3,848,467 | A | 11/1974 | Flavell |
| 3,851,874 | A | 12/1974 | Wilkin |
| 3,858,873 | A | 1/1975 | Jones |
| 3,858,874 | A | 1/1975 | Weider |
| 3,858,938 | A | 1/1975 | Kristensson et al. |
| 3,861,215 | A | 1/1975 | Bradley |
| 3,869,121 | A | 3/1975 | Flavell |
| 3,870,297 | A | 3/1975 | Elder |
| 3,874,375 | A | 4/1975 | Penner |
| 3,874,657 | A | 4/1975 | Niebojewski |
| 3,880,274 | A | 4/1975 | Bechtloff |
| 3,883,922 | A | 5/1975 | Fleischhauer |
| 3,884,464 | A | 5/1975 | Evangelos |
| 3,891,207 | A | 6/1975 | Helliwell |
| 3,892,404 | A | 7/1975 | Martucci |
| 3,901,379 | A | 8/1975 | Bruhm |
| 3,902,480 | A | 9/1975 | Wilson |
| 3,902,717 | A | 9/1975 | Kulkens |
| 3,903,613 | A | 9/1975 | Bisberg |

(56) References Cited

U.S. PATENT DOCUMENTS

| | | | |
|---|---|---|---|
| 3,904,196 | A | 9/1975 | Berlin |
| 3,909,857 | A | 10/1975 | Herrera |
| 3,912,263 | A | 10/1975 | Yatso |
| 3,913,908 | A | 10/1975 | Speyer |
| 3,918,710 | A | 11/1975 | Niebojewski |
| 3,920,240 | A | 11/1975 | Ross |
| 3,926,430 | A | 12/1975 | Good, Jr. |
| 3,929,026 | A | 12/1975 | Hofmann |
| 3,938,400 | A | 2/1976 | Konyha |
| 3,938,803 | A | 2/1976 | Wilmoth |
| 3,941,377 | A | 3/1976 | Lie |
| 3,948,513 | A | 4/1976 | Pfotenhauer |
| 3,953,025 | A | 4/1976 | Mazman |
| 3,957,266 | A | 5/1976 | Rice |
| 3,958,803 | A | 5/1976 | Geisselbrecht |
| 3,963,101 | A | 6/1976 | Stadelmann et al. |
| 3,971,555 | A | 7/1976 | Mahnke |
| 3,976,058 | A | 8/1976 | Tidwell |
| 3,977,451 | A | 8/1976 | Duba |
| 3,979,931 | A | 9/1976 | Man |
| 3,981,500 | A | 9/1976 | Ryan |
| 3,984,666 | A | 10/1976 | Barron |
| 3,998,454 | A | 12/1976 | Jones |
| 4,004,801 | A | 1/1977 | Campanaro |
| 4,012,015 | A | 3/1977 | Nelson et al. |
| 4,024,949 | A | 5/1977 | Kleysteuber et al. |
| 4,026,545 | A | 5/1977 | Schonenberger |
| 4,026,548 | A | 5/1977 | Birdwell |
| 4,029,312 | A | 6/1977 | Wright |
| 4,033,567 | A | 7/1977 | Lipfert |
| 4,042,305 | A | 8/1977 | Vincent |
| 4,043,552 | A | 8/1977 | Kerkonian |
| 4,056,265 | A | 11/1977 | Ide |
| 4,059,265 | A | 11/1977 | Wieder et al. |
| 4,060,240 | A | 11/1977 | Dunston |
| 4,061,257 | A | 12/1977 | St. Clair |
| 4,063,726 | A | 12/1977 | Wilson |
| 4,063,727 | A | 12/1977 | Hall |
| 4,066,257 | A | 1/1978 | Moller |
| 4,066,259 | A | 1/1978 | Brentham |
| 4,066,868 | A | 1/1978 | Witkin et al. |
| 4,067,372 | A | 1/1978 | Masson |
| 4,071,235 | A | 1/1978 | Zent |
| 4,072,309 | A | 2/1978 | Wilson |
| 4,073,490 | A | 2/1978 | Feather |
| 4,074,409 | A | 2/1978 | Smith |
| 4,074,519 | A | 2/1978 | Garrett |
| 4,074,903 | A | 2/1978 | Diez de Aux |
| 4,076,236 | A | 2/1978 | Ionel |
| 4,076,237 | A | 2/1978 | Dussia |
| 4,077,626 | A | 3/1978 | Newman |
| 4,082,267 | A | 4/1978 | Flavell |
| 4,093,196 | A | 6/1978 | Bauer |
| 4,093,211 | A | 6/1978 | Hughes et al. |
| 4,094,330 | A | 6/1978 | Jong |
| 4,098,100 | A | 7/1978 | Wah |
| 4,101,124 | A | 7/1978 | Mahnke |
| 4,111,417 | A | 9/1978 | Gardner |
| 4,113,071 | A | 9/1978 | Muller et al. |
| 4,120,294 | A | 10/1978 | Wolfe |
| 4,122,585 | A | 10/1978 | Sharp et al. |
| 4,131,701 | A | 12/1978 | VanAuken |
| 4,140,312 | A | 2/1979 | Buchmann |
| 4,141,158 | A | 2/1979 | Benseler et al. |
| 4,146,222 | A | 3/1979 | Hribar |
| 4,149,714 | A | 4/1979 | Lambert, Jr. |
| 4,151,988 | A | 5/1979 | Nabinger |
| 4,151,994 | A | 5/1979 | Stalberger, Jr. |
| 4,154,441 | A | 5/1979 | Gajda |
| 4,157,181 | A | 6/1979 | Cecka |
| 4,157,594 | A | 6/1979 | Raabe |
| 4,161,998 | A | 7/1979 | Trimble |
| 4,167,938 | A | 9/1979 | Remih |
| 4,168,061 | A | 9/1979 | Gordon |
| 4,170,351 | A | 10/1979 | Ozbey |
| 4,171,805 | A | 10/1979 | Abbott |
| 4,176,836 | A | 12/1979 | Coyle |
| 4,179,134 | A | 12/1979 | Atkinson |
| 4,183,156 | A | 1/1980 | Rudy |
| 4,183,494 | A | 1/1980 | Cleveland |
| 4,188,030 | A | 2/1980 | Hooper |
| 4,193,630 | A | 3/1980 | Steele |
| 4,198,044 | A | 4/1980 | Holappa |
| 4,199,139 | A | 4/1980 | Mahnke |
| 4,200,279 | A | 4/1980 | Lambert, Jr. |
| 4,200,280 | A | 4/1980 | Goodwin |
| 4,204,673 | A | 5/1980 | Speer, Sr. |
| 4,207,879 | A | 6/1980 | Safadago |
| 4,208,049 | A | 6/1980 | Wilson |
| 4,215,516 | A | 8/1980 | Huschle et al. |
| 4,216,856 | A | 8/1980 | Moring et al. |
| 4,227,689 | A | 10/1980 | Keiser |
| 4,231,568 | A | 11/1980 | Riley |
| 4,231,569 | A | 11/1980 | Rae |
| 4,235,437 | A | 11/1980 | Ruis et al. |
| 4,239,092 | A | 12/1980 | Janson |
| 4,240,627 | A | 12/1980 | Brentham |
| 4,241,915 | A | 12/1980 | Noble |
| 4,248,476 | A | 2/1981 | Phelps |
| 4,249,725 | A | 2/1981 | Mattox |
| 4,249,773 | A | 2/1981 | Giambalvo |
| 4,251,932 | A | 2/1981 | Love |
| 4,252,314 | A | 2/1981 | Ceppo |
| 4,253,661 | A | 3/1981 | Russell |
| 4,253,662 | A | 3/1981 | Podolak |
| 4,256,302 | A | 3/1981 | Keiser et al. |
| 4,257,590 | A | 3/1981 | Sullivan et al. |
| 4,258,821 | A | 3/1981 | Wendt |
| 4,258,913 | A | 3/1981 | Brentham |
| 4,263,897 | A | 4/1981 | Terayama |
| 4,274,625 | A | 6/1981 | Gaetano |
| 4,275,882 | A | 6/1981 | Grosser et al. |
| 4,278,095 | A | 7/1981 | Lapeyre |
| 4,278,249 | A | 7/1981 | Forrest |
| 4,286,782 | A | 9/1981 | Fuhrhop |
| 4,290,601 | A | 9/1981 | Mittelstadt |
| 4,296,924 | A | 10/1981 | Anzaldua et al. |
| 4,300,760 | A | 11/1981 | Bobroff |
| 4,300,761 | A | 11/1981 | Howard |
| 4,307,880 | A | 12/1981 | Abram |
| 4,313,602 | A | 2/1982 | Sullivan |
| 4,313,603 | A | 2/1982 | Simjian |
| 4,316,609 | A | 2/1982 | Silberman |
| 4,316,610 | A | 2/1982 | Hinds |
| 4,324,501 | A | 4/1982 | Herbenar |
| 4,325,548 | A | 4/1982 | Piccini |
| 4,327,713 | A | 5/1982 | Okazaki et al. |
| 4,328,964 | A | 5/1982 | Walls |
| 4,328,965 | A | 5/1982 | Hatfield |
| 4,328,968 | A | 5/1982 | Hacker |
| 4,333,978 | A | 6/1982 | Kocher |
| 4,334,676 | A | 6/1982 | Schonenberger |
| 4,334,678 | A | 6/1982 | Doyel |
| 4,334,695 | A | 6/1982 | Ashby |
| 4,337,283 | A | 6/1982 | Haas, Jr. |
| 4,342,452 | A | 8/1982 | Summa |
| 4,344,616 | A | 8/1982 | Ogden |
| 4,345,756 | A | 8/1982 | Hoagland |
| 4,346,888 | A | 8/1982 | Szabo |
| 4,349,192 | A | 9/1982 | Lambert, Jr. et al. |
| 4,349,597 | A | 9/1982 | Fine et al. |
| 4,350,336 | A | 9/1982 | Hanford |
| 4,354,675 | A | 10/1982 | Barclay et al. |
| 4,355,061 | A | 10/1982 | Zeigler |
| 4,357,010 | A | 11/1982 | Telle |
| 4,357,011 | A | 11/1982 | Voris |
| 4,358,105 | A | 11/1982 | Sweeney, Jr. |
| 4,363,480 | A | 12/1982 | Fisher et al. |
| 4,363,486 | A | 12/1982 | Chaudhry |
| 4,367,895 | A | 1/1983 | Pacitti et al. |
| 4,368,735 | A | 1/1983 | Filmer |
| 4,369,081 | A | 1/1983 | Curry et al. |
| 4,369,966 | A | 1/1983 | Silberman et al. |
| 4,370,766 | A | 2/1983 | Teague, Jr. |

(56) References Cited

U.S. PATENT DOCUMENTS

| | | | |
|---|---|---|---|
| 4,371,162 | A | 2/1983 | Hartzell |
| 4,372,553 | A | 2/1983 | Hatfield |
| 4,373,716 | A | 2/1983 | Pagani |
| 4,374,587 | A | 2/1983 | Ogden |
| 4,374,588 | A | 2/1983 | Ruggles |
| 4,376,533 | A | 3/1983 | Kolbel |
| 4,377,045 | A | 3/1983 | Aurensan |
| 4,382,596 | A | 5/1983 | Silberman |
| 4,383,684 | A | 5/1983 | Schliep |
| 4,383,714 | A | 5/1983 | Ishida |
| 4,384,715 | A | 5/1983 | Barrett, Jr. |
| 4,387,893 | A | 6/1983 | Baldwin |
| 4,389,047 | A | 6/1983 | Hall |
| 4,390,179 | A | 6/1983 | Szkalak |
| 4,391,440 | A | 7/1983 | Berger |
| 4,397,462 | A | 8/1983 | Wilmarth |
| 4,398,713 | A | 8/1983 | Ellis |
| 4,402,504 | A | 9/1983 | Christian |
| 4,406,451 | A | 9/1983 | Gaetano |
| 4,408,613 | A | 10/1983 | Relyea |
| 4,422,635 | A | 12/1983 | Herod |
| 4,422,636 | A | 12/1983 | de Angeli |
| 4,423,864 | A | 1/1984 | Wiik |
| 4,424,693 | A | 1/1984 | Best et al. |
| 4,426,077 | A | 1/1984 | Becker |
| 4,428,577 | A | 1/1984 | Croom |
| 4,428,578 | A | 1/1984 | Kirkpatrick |
| 4,431,181 | A | 2/1984 | Baswell |
| 4,431,184 | A | 2/1984 | Lew et al. |
| 4,434,981 | A | 3/1984 | Norton |
| 4,441,708 | A | 4/1984 | Brentham |
| 4,445,684 | A | 5/1984 | Ruff |
| 4,448,434 | A | 5/1984 | Anderson |
| 4,452,448 | A | 6/1984 | Ausherman |
| 4,453,766 | A | 6/1984 | DiVito |
| 4,456,245 | A | 6/1984 | Baldwin |
| 4,456,246 | A | 6/1984 | Szabo |
| 4,461,472 | A | 7/1984 | Martinez |
| 4,461,473 | A | 7/1984 | Cole |
| 4,463,948 | A | 8/1984 | Mohr |
| 4,465,274 | A | 8/1984 | Davenport |
| 4,465,276 | A | 8/1984 | Cox |
| 4,465,277 | A | 8/1984 | Dittrich |
| 4,474,370 | A | 10/1984 | Oman |
| 4,476,582 | A | 10/1984 | Strauss et al. |
| 4,477,071 | A | 10/1984 | Brown et al. |
| 4,478,413 | A | 10/1984 | Siwula |
| 4,482,152 | A | 11/1984 | Wolff |
| 4,489,933 | A | 12/1984 | Fisher |
| 4,489,936 | A | 12/1984 | Dal Monte |
| 4,491,318 | A | 1/1985 | Francke |
| 4,492,375 | A | 1/1985 | Connelly |
| 4,494,662 | A | 1/1985 | Clymer |
| 4,496,147 | A | 1/1985 | DeCloux et al. |
| 4,499,784 | A | 2/1985 | Shum |
| 4,502,679 | A | 3/1985 | De Lorenzo |
| 4,502,682 | A | 3/1985 | Miller |
| 4,505,474 | A | 3/1985 | Mattox |
| 4,505,475 | A | 3/1985 | Olschansky et al. |
| 4,505,495 | A | 3/1985 | Foss et al. |
| 4,509,510 | A | 4/1985 | Hook |
| 4,511,137 | A | 4/1985 | Jones |
| 4,512,567 | A | 4/1985 | Phillips |
| 4,512,571 | A | 4/1985 | Hermelin |
| 4,515,363 | A | 5/1985 | Schleffendorf |
| 4,521,013 | A | 6/1985 | Dofel |
| 4,522,394 | A | 6/1985 | Broussard |
| 4,529,194 | A | 7/1985 | Haaheim |
| 4,529,196 | A | 7/1985 | Logan |
| 4,529,197 | A | 7/1985 | Gogarty |
| 4,529,198 | A | 7/1985 | Hettick, Jr. |
| 4,531,727 | A | 7/1985 | Pitre |
| 4,531,731 | A | 7/1985 | Law |
| 4,533,136 | A | 8/1985 | Smith et al. |
| 4,536,244 | A | 8/1985 | Greci et al. |
| 4,537,396 | A | 8/1985 | Hooper |
| 4,538,805 | A | 9/1985 | Parviainen |
| 4,540,171 | A | 9/1985 | Clark |
| 4,540,173 | A | 9/1985 | Hopkins, Jr. |
| 4,542,899 | A | 9/1985 | Hendricks |
| 4,544,152 | A | 10/1985 | Taitel |
| 4,544,153 | A | 10/1985 | Babcock |
| 4,546,967 | A | 10/1985 | Kecala |
| 4,546,970 | A | 10/1985 | Mahnke |
| 4,546,971 | A | 10/1985 | Raasoch |
| 4,548,405 | A | 10/1985 | Lee |
| 4,549,433 | A | 10/1985 | Gneiss et al. |
| 4,549,733 | A | 10/1985 | Salyer |
| 4,549,734 | A | 10/1985 | Hibler, Jr. |
| 4,555,109 | A | 11/1985 | Hartmann |
| 4,556,216 | A | 12/1985 | Pitkanen |
| 4,563,001 | A | 1/1986 | Terauds |
| 4,565,369 | A | 1/1986 | Bedgood |
| 4,566,689 | A | 1/1986 | Ogden |
| 4,566,690 | A | 1/1986 | Schook |
| 4,566,732 | A | 1/1986 | Ostergaard, Sr. |
| 4,569,518 | A | 2/1986 | Fulks |
| 4,569,519 | A | 2/1986 | Mattox et al. |
| 4,571,682 | A | 2/1986 | Silverman et al. |
| 4,572,500 | A | 2/1986 | Weiss |
| 4,572,504 | A | 2/1986 | DiBartolo |
| 4,575,074 | A | 3/1986 | Damratoski |
| 4,576,352 | A | 3/1986 | Ogden |
| 4,576,376 | A | 3/1986 | Miller |
| 4,576,377 | A | 3/1986 | Wolff |
| 4,577,860 | A | 3/1986 | Matias et al. |
| 4,577,861 | A | 3/1986 | Bangerter et al. |
| 4,579,360 | A | 4/1986 | Nishimura et al. |
| 4,580,983 | A | 4/1986 | Cassini et al. |
| 4,581,269 | A | 4/1986 | Tilman |
| 4,582,320 | A | 4/1986 | Shaw |
| 4,587,695 | A | 5/1986 | Jensen |
| 4,589,656 | A | 5/1986 | Baldwin |
| 4,591,147 | A | 5/1986 | Smith et al. |
| 4,591,150 | A | 5/1986 | Mosher |
| 4,591,151 | A | 5/1986 | Hensley |
| 4,592,544 | A | 6/1986 | Smith et al. |
| 4,598,908 | A | 7/1986 | Morgan |
| 4,600,188 | A | 7/1986 | Bangerter et al. |
| 4,600,189 | A | 7/1986 | Olschansky et al. |
| 4,600,196 | A | 7/1986 | Jones |
| 4,601,142 | A | 7/1986 | Frommelt |
| 4,602,779 | A | 7/1986 | Ogden |
| 4,603,855 | A | 8/1986 | Sebelle |
| 4,603,856 | A | 8/1986 | Fiore |
| 4,606,540 | A | 8/1986 | Chin Sen |
| 4,606,541 | A | 8/1986 | Kirkpatrick |
| 4,607,840 | A | 8/1986 | Harper |
| 4,607,841 | A | 8/1986 | Gala |
| 4,608,969 | A | 9/1986 | Hamlin |
| 4,609,174 | A | 9/1986 | Nakatani |
| 4,610,448 | A | 9/1986 | Hill |
| 4,610,449 | A | 9/1986 | Diercks, Jr. |
| 4,611,805 | A | 9/1986 | Franklin et al. |
| 4,614,337 | A | 9/1986 | Schonenberger |
| 4,616,822 | A | 10/1986 | Trulaske |
| 4,618,139 | A | 10/1986 | Haaheim |
| 4,618,140 | A | 10/1986 | Brown |
| 4,618,144 | A | 10/1986 | Gibson |
| 4,619,454 | A | 10/1986 | Walton |
| 4,620,701 | A | 11/1986 | Mojden |
| 4,620,704 | A | 11/1986 | Shifferaw |
| 4,621,623 | A | 11/1986 | Wang |
| 4,621,807 | A | 11/1986 | Stramer |
| 4,621,810 | A | 11/1986 | Cummins |
| 4,624,457 | A | 11/1986 | Silberman et al. |
| 4,625,962 | A | 12/1986 | Street |
| 4,627,614 | A | 12/1986 | De Angeli |
| 4,627,615 | A | 12/1986 | Nurkowski |
| 4,627,616 | A | 12/1986 | Kauffman |
| 4,627,618 | A | 12/1986 | Schwartz |
| 4,630,817 | A | 12/1986 | Buckley |
| 4,632,385 | A | 12/1986 | Geraci |
| 4,632,386 | A | 12/1986 | Beech |

(56) References Cited

U.S. PATENT DOCUMENTS

| | | | |
|---|---|---|---|
| 4,632,388 | A | 12/1986 | Schleffendorf |
| 4,632,390 | A | 12/1986 | Richey |
| 4,632,393 | A | 12/1986 | Van Noord |
| 4,632,414 | A | 12/1986 | Ellefson |
| 4,632,421 | A | 12/1986 | Shamie |
| 4,634,118 | A | 1/1987 | Jensen |
| 4,634,127 | A | 1/1987 | Rockwell |
| 4,635,926 | A | 1/1987 | Minkow |
| 4,635,927 | A | 1/1987 | Shu |
| 4,635,928 | A | 1/1987 | Ogden et al. |
| 4,637,605 | A | 1/1987 | Ritchie |
| 4,638,523 | A | 1/1987 | Todd |
| 4,638,969 | A | 1/1987 | Brown |
| 4,638,994 | A | 1/1987 | Gogarty |
| 4,641,833 | A | 2/1987 | Trethewey |
| 4,642,080 | A | 2/1987 | Takano et al. |
| 4,643,418 | A | 2/1987 | Bart |
| 4,643,420 | A | 2/1987 | Riley |
| 4,645,197 | A | 2/1987 | Mcfee |
| 4,645,198 | A | 2/1987 | Levenston |
| 4,645,200 | A | 2/1987 | Hix |
| 4,645,201 | A | 2/1987 | Evans |
| 4,645,917 | A | 2/1987 | Penney et al. |
| 4,647,037 | A | 3/1987 | Donohue |
| 4,647,040 | A | 3/1987 | Ehrenfried |
| 4,647,041 | A | 3/1987 | Whiteley |
| 4,648,481 | A | 3/1987 | Lee |
| 4,648,594 | A | 3/1987 | Schleffendorf |
| 4,650,067 | A | 3/1987 | Brule |
| 4,650,183 | A | 3/1987 | McIntyre |
| 4,650,184 | A | 3/1987 | Brebner |
| 4,650,185 | A | 3/1987 | Cartwright |
| 4,651,581 | A | 3/1987 | Svensson |
| 4,651,988 | A | 3/1987 | Sobel |
| 4,655,448 | A | 4/1987 | Harder |
| 4,657,246 | A | 4/1987 | Salyer |
| 4,659,074 | A | 4/1987 | Taitel et al. |
| 4,659,077 | A | 4/1987 | Stropkay |
| 4,659,078 | A | 4/1987 | Blome |
| 4,660,550 | A | 4/1987 | Bodine |
| 4,662,629 | A | 5/1987 | Plovie |
| 4,662,630 | A | 5/1987 | Dignard et al. |
| 4,664,371 | A | 5/1987 | Viander |
| 4,664,373 | A | 5/1987 | Hait |
| 4,664,646 | A | 5/1987 | Rorabaugh |
| 4,666,149 | A | 5/1987 | Olschansky et al. |
| 4,666,151 | A | 5/1987 | Chillier |
| 4,673,177 | A | 6/1987 | Szymski |
| 4,673,180 | A | 6/1987 | Rice |
| 4,674,740 | A | 6/1987 | Iams et al. |
| 4,674,743 | A | 6/1987 | Hirano |
| 4,678,185 | A | 7/1987 | Mahnke |
| 4,679,786 | A | 7/1987 | Rodgers |
| 4,679,787 | A | 7/1987 | Guilbault |
| 4,684,121 | A | 8/1987 | Nestegard |
| 4,684,126 | A | 8/1987 | Dalebout et al. |
| 4,685,670 | A | 8/1987 | Zinkin |
| 4,685,671 | A | 8/1987 | Hagerman et al. |
| 4,687,195 | A | 8/1987 | Potts |
| 4,697,809 | A | 10/1987 | Rockwell |
| 4,700,946 | A | 10/1987 | Breunig |
| 4,702,475 | A | 10/1987 | Elstein et al. |
| 4,705,267 | A | 11/1987 | Jackson |
| 4,706,953 | A | 11/1987 | Graham |
| 4,708,337 | A | 11/1987 | Shyu |
| 4,709,917 | A | 12/1987 | Yang |
| 4,709,918 | A | 12/1987 | Grinblat |
| 4,709,920 | A | 12/1987 | Schnell |
| 4,711,447 | A | 12/1987 | Mansfield |
| 4,714,248 | A | 12/1987 | Koss |
| 4,717,146 | A | 1/1988 | Nohara |
| 4,718,207 | A | 1/1988 | Frommelt |
| 4,720,093 | A | 1/1988 | Del Mar |
| 4,720,099 | A | 1/1988 | Carlson |
| 4,720,789 | A | 1/1988 | Hector et al. |
| 4,721,301 | A | 1/1988 | Drake |
| 4,721,303 | A | 1/1988 | Fitzpatrick |
| 4,722,522 | A | 2/1988 | Lundgren |
| 4,725,057 | A | 2/1988 | Shifferaw |
| 4,726,581 | A | 2/1988 | Chang |
| 4,726,582 | A | 2/1988 | Fulks |
| 4,728,099 | A | 3/1988 | Pitre |
| 4,729,558 | A | 3/1988 | Kuo |
| 4,729,562 | A | 3/1988 | Pipasik |
| 4,730,828 | A | 3/1988 | Lane |
| 4,730,829 | A | 3/1988 | Carlson |
| 4,733,858 | A | 3/1988 | Lan |
| 4,733,860 | A | 3/1988 | Steffee |
| 4,733,905 | A | 3/1988 | Buickerood |
| 4,741,530 | A | 5/1988 | Wolf |
| 4,743,009 | A | 5/1988 | Beale |
| 4,743,010 | A | 5/1988 | Geraci |
| 4,743,015 | A | 5/1988 | Marshall |
| 4,743,017 | A | 5/1988 | Jaeger |
| 4,744,559 | A | 5/1988 | Mahnke et al. |
| 4,746,115 | A | 5/1988 | Lahman |
| 4,749,184 | A | 6/1988 | Tobin |
| 4,750,736 | A | 6/1988 | Watterson |
| 4,750,738 | A | 6/1988 | Dang |
| 4,751,755 | A | 6/1988 | Carey, Jr. et al. |
| 4,753,437 | A | 6/1988 | Lapcevic |
| 4,756,098 | A | 7/1988 | Boggia |
| 4,756,527 | A | 7/1988 | Ledbetter |
| 4,757,987 | A | 7/1988 | Allemand |
| 4,759,540 | A | 7/1988 | Yu et al. |
| 4,763,897 | A | 8/1988 | Yakata |
| 4,765,610 | A | 8/1988 | Sidwell |
| 4,765,613 | A | 8/1988 | Voris |
| 4,765,616 | A | 8/1988 | Wolff |
| 4,768,780 | A | 9/1988 | Hayes |
| 4,771,148 | A | 9/1988 | Bersonnet |
| 4,772,015 | A | 9/1988 | Carlson et al. |
| 4,773,170 | A | 9/1988 | Moore et al. |
| 4,773,640 | A | 9/1988 | Kolbel et al. |
| 4,775,149 | A | 10/1988 | Wilson |
| 4,776,581 | A | 10/1988 | Shepherdson |
| 4,776,582 | A | 10/1988 | Ramhorst |
| 4,776,587 | A | 10/1988 | Carlson et al. |
| 4,778,173 | A | 10/1988 | Joutras |
| 4,779,867 | A | 10/1988 | Hinds |
| 4,779,884 | A | 10/1988 | Minati |
| 4,784,384 | A | 11/1988 | Deola |
| 4,786,049 | A | 11/1988 | Lautenschlager |
| 4,786,050 | A | 11/1988 | Geschwender |
| 4,789,153 | A | 12/1988 | Brown |
| 4,790,522 | A | 12/1988 | Drutchas |
| 4,790,528 | A | 12/1988 | Nakao et al. |
| 4,790,596 | A | 12/1988 | Shifferaw |
| 4,792,134 | A | 12/1988 | Chen |
| 4,793,608 | A | 12/1988 | Mahnke et al. |
| 4,797,968 | A | 1/1989 | Wenzlick |
| 4,798,377 | A | 1/1989 | White |
| 4,798,760 | A | 1/1989 | Diaz-Kotti |
| 4,799,475 | A | 1/1989 | Iams et al. |
| 4,799,671 | A | 1/1989 | Hoggan et al. |
| 4,801,079 | A | 1/1989 | Gonella |
| 4,801,139 | A | 1/1989 | Vanhoutte |
| 4,801,140 | A | 1/1989 | Bergeron |
| 4,804,178 | A | 2/1989 | Friedebach |
| 4,805,901 | A | 2/1989 | Kulick |
| 4,807,874 | A | 2/1989 | Little |
| 4,807,893 | A | 2/1989 | Huang |
| 4,809,804 | A | 3/1989 | Houston et al. |
| 4,809,972 | A | 3/1989 | Rasmussen et al. |
| 4,809,973 | A | 3/1989 | Johns |
| 4,809,976 | A | 3/1989 | Berger |
| 4,813,667 | A | 3/1989 | Watterson |
| 4,813,668 | A | 3/1989 | Solloway |
| 4,813,743 | A | 3/1989 | Mizelle |
| 4,817,939 | A | 4/1989 | Augspurger et al. |
| 4,818,175 | A | 4/1989 | Kimura |
| 4,819,583 | A | 4/1989 | Guerra |
| 4,822,029 | A | 4/1989 | Sarno |
| 4,822,034 | A | 4/1989 | Shields |

(56) References Cited

U.S. PATENT DOCUMENTS

| | | | |
|---|---|---|---|
| 4,822,035 | A | 4/1989 | Jennings et al. |
| 4,822,038 | A | 4/1989 | Maag |
| 4,824,104 | A | 4/1989 | Bloch |
| 4,826,153 | A | 5/1989 | Schalip |
| 4,826,157 | A | 5/1989 | Fitzpatrick |
| 4,826,158 | A | 5/1989 | Fields, Jr. |
| 4,826,159 | A | 5/1989 | Hersey |
| 4,828,255 | A | 5/1989 | Lahman |
| 4,828,257 | A | 5/1989 | Dyer et al. |
| 4,830,362 | A | 5/1989 | Bull |
| 4,830,363 | A | 5/1989 | Kennedy |
| 4,830,365 | A | 5/1989 | March |
| 4,832,332 | A | 5/1989 | Dumbser |
| 4,834,365 | A | 5/1989 | Jones |
| 4,834,396 | A | 5/1989 | Schnell |
| 4,836,530 | A | 6/1989 | Stanley, Jr. |
| 4,836,535 | A | 6/1989 | Pearson |
| 4,838,180 | A | 6/1989 | Gutgsell |
| 4,838,543 | A | 6/1989 | Armstrong et al. |
| 4,838,544 | A | 6/1989 | Sasakawa et al. |
| 4,840,373 | A | 6/1989 | Maag |
| 4,842,266 | A | 6/1989 | Sweeney, Sr. |
| 4,842,268 | A | 6/1989 | Jenkins |
| 4,842,274 | A | 6/1989 | Oosthuizen |
| 4,844,448 | A | 7/1989 | Niznik |
| 4,844,449 | A | 7/1989 | Truslaske |
| 4,844,450 | A | 7/1989 | Rodgers, Jr. |
| 4,844,453 | A | 7/1989 | Hestilow |
| 4,844,456 | A | 7/1989 | Habing et al. |
| 4,846,458 | A | 7/1989 | Potts |
| 4,848,737 | A | 7/1989 | Ehrenfield |
| 4,850,585 | A | 7/1989 | Dalebout |
| 4,852,874 | A | 8/1989 | Sleichter, III et al. |
| 4,854,578 | A | 8/1989 | Fulks |
| 4,856,773 | A | 8/1989 | Deola |
| 4,856,775 | A | 8/1989 | Colledge |
| 4,858,912 | A | 8/1989 | Boyd |
| 4,858,915 | A | 8/1989 | Szabo |
| 4,858,918 | A | 8/1989 | Iams et al. |
| 4,861,020 | A | 8/1989 | Soligny, Sr. |
| 4,861,023 | A | 8/1989 | Wedman |
| 4,861,025 | A | 8/1989 | Rockwell |
| 4,863,163 | A | 9/1989 | Wehrell |
| 4,865,344 | A | 9/1989 | Romero, Sr. et al. |
| 4,867,443 | A | 9/1989 | Jensen |
| 4,869,493 | A | 9/1989 | Johnston |
| 4,869,494 | A | 9/1989 | Lambert, Sr. |
| 4,869,497 | A | 9/1989 | Stewart et al. |
| 4,872,670 | A | 10/1989 | Nichols |
| 4,875,676 | A | 10/1989 | Zimmer |
| 4,877,239 | A | 10/1989 | Dela Rosa |
| 4,878,662 | A | 11/1989 | Chern |
| 4,878,663 | A | 11/1989 | Luquette |
| 4,880,227 | A | 11/1989 | Sowell |
| 4,880,229 | A | 11/1989 | Broussard |
| 4,880,230 | A | 11/1989 | Cook |
| 4,883,272 | A | 11/1989 | Lay |
| 4,886,266 | A | 12/1989 | Trulaske |
| 4,887,929 | A | 12/1989 | Hale |
| 4,889,458 | A | 12/1989 | Taylor |
| 4,891,764 | A | 1/1990 | McIntosh |
| 4,893,409 | A | 1/1990 | Poehlmann |
| 4,893,810 | A | 1/1990 | Lee |
| 4,894,933 | A | 1/1990 | Tonkel et al. |
| 4,898,379 | A | 2/1990 | Shiba |
| 4,898,381 | A | 2/1990 | Gordon |
| 4,900,012 | A | 2/1990 | Fu |
| 4,900,013 | A | 2/1990 | Rodgers, Jr. |
| 4,900,016 | A | 2/1990 | Caruthers |
| 4,900,017 | A | 2/1990 | Bold, Jr. |
| 4,900,018 | A | 2/1990 | Ish, III |
| 4,902,006 | A | 2/1990 | Stallings, Jr. |
| 4,902,007 | A | 2/1990 | Ferrari |
| 4,904,829 | A | 2/1990 | Berthaud et al. |
| 4,905,330 | A | 3/1990 | Jacobs |
| 4,907,795 | A | 3/1990 | Shaw et al. |
| 4,907,797 | A | 3/1990 | Gezari et al. |
| 4,907,798 | A | 3/1990 | Burchatz |
| 4,909,504 | A | 3/1990 | Yang |
| 4,909,505 | A | 3/1990 | Tee |
| 4,911,436 | A | 3/1990 | Lighter |
| 4,911,438 | A | 3/1990 | Van Straaten |
| 4,913,396 | A | 4/1990 | Dalebout et al. |
| 4,913,419 | A | 4/1990 | McAuliffe |
| 4,913,422 | A | 4/1990 | Elmore |
| 4,913,423 | A | 4/1990 | Farran |
| 4,915,377 | A | 4/1990 | Malnke et al. |
| 4,915,379 | A | 4/1990 | Sapp |
| 4,917,376 | A | 4/1990 | Lo |
| 4,919,418 | A | 4/1990 | Miller |
| 4,919,419 | A | 4/1990 | Houston |
| 4,921,242 | A | 5/1990 | Watterson |
| 4,921,245 | A | 5/1990 | Roberts |
| 4,921,247 | A | 5/1990 | Sterling |
| 4,923,193 | A | 5/1990 | Pitzen et al. |
| 4,925,183 | A | 5/1990 | Kim |
| 4,925,200 | A | 5/1990 | Jones |
| 4,925,724 | A | 5/1990 | Ogden |
| 4,927,136 | A | 5/1990 | Leask |
| 4,927,138 | A | 5/1990 | Ferrari |
| 4,928,546 | A | 5/1990 | Walters |
| 4,928,957 | A | 5/1990 | Lanier et al. |
| 4,928,961 | A | 5/1990 | Madden |
| 4,930,768 | A | 6/1990 | Lapcevic |
| 4,930,769 | A | 6/1990 | Nenoff |
| 4,930,770 | A | 6/1990 | Baker |
| 4,934,690 | A | 6/1990 | Bull |
| 4,934,692 | A | 6/1990 | Owens |
| 4,938,473 | A | 7/1990 | Lee |
| 4,941,652 | A | 7/1990 | Nagano et al. |
| 4,941,673 | A | 7/1990 | Bennett |
| 4,944,511 | A | 7/1990 | Francis |
| 4,944,518 | A | 7/1990 | Flynn |
| 4,948,121 | A | 8/1990 | Haaheim et al. |
| 4,948,123 | A | 8/1990 | Schook |
| 4,949,951 | A | 8/1990 | Deola |
| 4,949,954 | A | 8/1990 | Hix |
| 4,949,958 | A | 8/1990 | Richey |
| 4,952,265 | A | 8/1990 | Yamanaka et al. |
| 4,953,415 | A | 9/1990 | Lehtonen |
| 4,953,858 | A | 9/1990 | Zelli |
| 4,955,466 | A | 9/1990 | Trulaske, Sr. |
| 4,958,832 | A | 9/1990 | Kim |
| 4,960,276 | A | 10/1990 | Feuer et al. |
| 4,964,632 | A | 10/1990 | Rockwell |
| 4,968,028 | A | 11/1990 | Wehrell |
| 4,971,305 | A | 11/1990 | Rennex |
| 4,971,316 | A | 11/1990 | Dalebout et al. |
| 4,973,050 | A | 11/1990 | Santoro |
| 4,974,831 | A | 12/1990 | Dunham |
| 4,974,832 | A | 12/1990 | Dalebout |
| 4,974,836 | A | 12/1990 | Hirsch |
| 4,974,838 | A | 12/1990 | Sollenberger |
| 4,976,424 | A | 12/1990 | Sargeant et al. |
| 4,976,428 | A | 12/1990 | Ghazi |
| 4,976,435 | A | 12/1990 | Shatford |
| 4,978,122 | A | 12/1990 | Dibowski |
| 4,982,955 | A | 1/1991 | Heasley |
| 4,984,810 | A | 1/1991 | Stearns et al. |
| 4,986,261 | A | 1/1991 | Iams et al. |
| 4,986,689 | A | 1/1991 | Drutchas |
| 4,989,860 | A | 2/1991 | Iams et al. |
| 4,990,838 | A | 2/1991 | Kawato et al. |
| 4,992,190 | A | 2/1991 | Shtarkman |
| 4,995,777 | A | 2/1991 | Warmington |
| 4,998,723 | A | 3/1991 | Santoro |
| 4,998,725 | A | 3/1991 | Watterson et al. |
| 5,000,440 | A | 3/1991 | Lynch |
| 5,000,442 | A | 3/1991 | Dalebout et al. |
| 5,000,446 | A | 3/1991 | Sarno |
| 5,001,632 | A | 3/1991 | Hall Tipping |
| 5,002,271 | A | 3/1991 | Gonzales |
| 5,004,224 | A | 4/1991 | Wang |
| 5,005,832 | A | 4/1991 | Van Der Hoeven |

(56) References Cited

U.S. PATENT DOCUMENTS

| | | | |
|---|---|---|---|
| 5,007,630 | A | 4/1991 | Real et al. |
| 5,007,631 | A | 4/1991 | Wang |
| 5,011,139 | A | 4/1991 | Towley, III |
| 5,011,142 | A | 4/1991 | Eckler |
| 5,013,031 | A | 5/1991 | Bull |
| 5,015,926 | A | 5/1991 | Casler |
| 5,016,870 | A | 5/1991 | Bulloch et al. |
| 5,018,725 | A | 5/1991 | Cook |
| 5,020,793 | A | 6/1991 | Loane |
| 5,022,377 | A | 6/1991 | Stevens |
| 5,024,441 | A | 6/1991 | Rousseau |
| 5,026,049 | A | 6/1991 | Goodman |
| 5,027,303 | A | 6/1991 | Witte |
| 5,029,801 | A | 7/1991 | Dalebout et al. |
| 5,029,848 | A | 7/1991 | Sleamaker |
| 5,029,849 | A | 7/1991 | Nurkowski |
| 5,029,850 | A | 7/1991 | Van Straaten |
| 5,031,455 | A | 7/1991 | Cline |
| 5,031,901 | A | 7/1991 | Saarinen |
| 5,031,905 | A | 7/1991 | Walsh |
| 5,032,048 | A | 7/1991 | Walton et al. |
| 5,033,740 | A | 7/1991 | Schwartz |
| 5,034,576 | A | 7/1991 | Dalebout et al. |
| RE33,662 | E | 8/1991 | Blair et al. |
| 5,037,084 | A | 8/1991 | Flor |
| 5,037,089 | A | 8/1991 | Spagnuolo |
| 5,037,090 | A | 8/1991 | Fitzpatrick |
| 5,039,088 | A | 8/1991 | Shifferaw |
| 5,039,089 | A | 8/1991 | Lapcevic |
| 5,039,091 | A | 8/1991 | Johnson |
| 5,040,785 | A | 8/1991 | Charnitski |
| 5,040,787 | A | 8/1991 | Brotman |
| 5,040,788 | A | 8/1991 | Randall |
| 5,042,704 | A | 8/1991 | Izzo |
| 5,042,799 | A | 8/1991 | Stanley |
| 5,044,629 | A | 9/1991 | Ryan |
| 5,044,631 | A | 9/1991 | Jones |
| 5,044,632 | A | 9/1991 | Jones |
| 5,046,382 | A | 9/1991 | Steinberg |
| 5,046,722 | A | 9/1991 | Antoon |
| 5,048,823 | A | 9/1991 | Bean |
| 5,048,825 | A | 9/1991 | Kelly |
| 5,048,826 | A | 9/1991 | Ryan |
| 5,050,872 | A | 9/1991 | Farenholtz |
| 5,050,873 | A | 9/1991 | Jones |
| 5,051,638 | A | 9/1991 | Pyles |
| 5,052,684 | A | 10/1991 | Kosuge et al. |
| 5,054,770 | A | 10/1991 | Bull |
| 5,056,777 | A | 10/1991 | Capjon et al. |
| 5,058,881 | A | 10/1991 | Measom |
| 5,058,882 | A | 10/1991 | Dalebout et al. |
| 5,058,884 | A | 10/1991 | Fuller, Sr. |
| 5,058,888 | A | 10/1991 | Walker et al. |
| 5,062,626 | A | 11/1991 | Dalebout et al. |
| 5,062,627 | A | 11/1991 | Bingham |
| 5,062,629 | A | 11/1991 | Vaughan |
| 5,062,630 | A | 11/1991 | Nelson |
| 5,062,631 | A | 11/1991 | Dau et al. |
| 5,062,632 | A | 11/1991 | Dalebout et al. |
| 5,062,633 | A | 11/1991 | Engel et al. |
| 5,064,191 | A | 11/1991 | Johnson |
| 5,066,000 | A | 11/1991 | Dolan |
| 5,067,710 | A | 11/1991 | Watterson et al. |
| 5,071,115 | A | 12/1991 | Welch |
| 5,071,119 | A | 12/1991 | Johnson |
| 5,072,928 | A | 12/1991 | Stearns et al. |
| 5,072,929 | A | 12/1991 | Peterson et al. |
| 5,074,550 | A | 12/1991 | Sloan |
| 5,077,916 | A | 1/1992 | Beneteau |
| 5,080,353 | A | 1/1992 | Tench |
| 5,081,991 | A | 1/1992 | Chance |
| 5,085,426 | A | 2/1992 | Wanzer et al. |
| 5,085,427 | A | 2/1992 | Finn |
| 5,085,430 | A | 2/1992 | Habing |
| 5,087,047 | A | 2/1992 | McConnell |
| 5,088,729 | A | 2/1992 | Dalebout |
| 5,090,694 | A | 2/1992 | Pauls et al. |
| 5,094,249 | A | 3/1992 | Marras et al. |
| 5,094,447 | A | 3/1992 | Wang |
| 5,094,449 | A | 3/1992 | Stearns |
| 5,096,225 | A | 3/1992 | Osawa |
| 5,100,129 | A | 3/1992 | Porter |
| 5,102,121 | A | 4/1992 | Solow et al. |
| 5,102,122 | A | 4/1992 | Piane, Jr. |
| 5,102,124 | A | 4/1992 | Diodati |
| 5,102,380 | A | 4/1992 | Jacobson et al. |
| 5,104,119 | A | 4/1992 | Lynch |
| 5,104,120 | A | 4/1992 | Watterson et al. |
| 5,106,079 | A | 4/1992 | Escobedo |
| 5,108,090 | A | 4/1992 | Reed |
| 5,108,093 | A | 4/1992 | Watterson |
| 5,109,778 | A | 5/1992 | Berkowitz et al. |
| 5,110,117 | A | 5/1992 | Fisher et al. |
| 5,110,118 | A | 5/1992 | Winey |
| 5,110,121 | A | 5/1992 | Foster |
| 5,112,045 | A | 5/1992 | Mason et al. |
| 5,112,287 | A | 5/1992 | Brewer |
| 5,114,388 | A | 5/1992 | Trulaske |
| 5,114,391 | A | 5/1992 | Pitzen et al. |
| 5,116,297 | A | 5/1992 | Stonecipher |
| 5,120,289 | A | 6/1992 | Yu |
| 5,123,629 | A | 6/1992 | Takeuchi |
| 5,123,885 | A | 6/1992 | Shields |
| 5,123,886 | A | 6/1992 | Cook |
| 5,125,647 | A | 6/1992 | Smith |
| 5,125,884 | A | 6/1992 | Weber et al. |
| 5,129,872 | A | 7/1992 | Dalton et al. |
| 5,131,895 | A | 7/1992 | Rogers, Jr. |
| 5,131,898 | A | 7/1992 | Panagos |
| 5,135,216 | A | 8/1992 | Bingham et al. |
| 5,135,445 | A | 8/1992 | Christensen |
| 5,135,449 | A | 8/1992 | Jones |
| 5,135,453 | A | 8/1992 | Sollenberger |
| 5,135,458 | A | 8/1992 | Huang |
| 5,135,459 | A | 8/1992 | Perry, Jr. |
| 5,137,272 | A | 8/1992 | Wilkinson |
| 5,137,501 | A | 8/1992 | Mertesdorf |
| 5,138,730 | A | 8/1992 | Masuda |
| 5,141,478 | A | 8/1992 | Upper |
| 5,141,480 | A | 8/1992 | Lennox et al. |
| 5,141,483 | A | 8/1992 | Smith |
| 5,142,358 | A | 8/1992 | Jason |
| 5,145,475 | A | 9/1992 | Cares |
| 5,145,481 | A | 9/1992 | Friedebach |
| 5,147,266 | A | 9/1992 | Ricard |
| 5,149,084 | A | 9/1992 | Dalebout et al. |
| 5,149,312 | A | 9/1992 | Croft et al. |
| 5,151,071 | A | 9/1992 | Jain et al. |
| 5,154,684 | A | 10/1992 | Delf |
| 5,156,650 | A | 10/1992 | Bals |
| 5,158,518 | A | 10/1992 | Pizzuto |
| 5,158,520 | A | 10/1992 | Lemke et al. |
| 5,160,305 | A | 11/1992 | Lin |
| 5,162,029 | A | 11/1992 | Schine |
| 5,163,885 | A | 11/1992 | Wanzer et al. |
| 5,167,159 | A | 12/1992 | Lucking |
| 5,167,597 | A | 12/1992 | David |
| 5,167,850 | A | 12/1992 | Shtarkman |
| 5,169,362 | A | 12/1992 | Schwartz |
| 5,169,363 | A | 12/1992 | Campanaro |
| 5,171,196 | A | 12/1992 | Lynch |
| 5,176,601 | A | 1/1993 | Reynolds |
| 5,176,602 | A | 1/1993 | Roberts |
| 5,178,590 | A | 1/1993 | Stephens |
| 5,178,593 | A | 1/1993 | Roberts |
| 5,178,599 | A | 1/1993 | Scott |
| 5,180,352 | A | 1/1993 | Sreter |
| 5,181,894 | A | 1/1993 | Shieng |
| 5,184,295 | A | 2/1993 | Mann |
| 5,184,988 | A | 2/1993 | Dunham |
| 5,184,991 | A | 2/1993 | Brangi |
| 5,184,994 | A | 2/1993 | Morris |
| 5,186,697 | A | 2/1993 | Rennex |
| 5,190,509 | A | 3/1993 | Davison, Jr. |

(56) References Cited

U.S. PATENT DOCUMENTS 5,190,513 A 3/1993 Habing et al.
5,192,255 A 3/1993 Dalebout et al.
5,192,257 A 3/1993 Panasewicz
5,192,258 A 3/1993 Keller
5,194,059 A 3/1993 Wu
5,195,781 A 3/1993 Osawa
5,195,935 A 3/1993 Fencel
5,195,937 A 3/1993 Engel et al.
5,199,931 A 4/1993 Easley et al.
5,199,934 A 4/1993 Lin
5,199,935 A 4/1993 Gibson et al.
5,201,694 A 4/1993 Zappel
5,201,772 A 4/1993 Maxwell
5,203,126 A 4/1993 Sorenson et al.
5,203,229 A 4/1993 Chen
5,203,800 A 4/1993 Meredith
5,203,826 A 4/1993 Dalebout
5,205,798 A 4/1993 Lekhtman
5,205,800 A 4/1993 Grant
5,205,802 A 4/1993 Swisher
5,207,489 A 5/1993 Miller
5,207,621 A 5/1993 Koch et al.
5,207,622 A 5/1993 Wilkinson et al.
5,207,625 A 5/1993 White
5,207,628 A 5/1993 Graham
5,209,223 A 5/1993 McGorry et al.
5,209,482 A 5/1993 Hopfer
5,209,715 A 5/1993 Walker et al.
5,211,614 A 5/1993 Henes
5,211,617 A 5/1993 Millen
5,215,510 A 6/1993 Baran
5,217,422 A 6/1993 Domzalski
5,221,240 A 6/1993 Mann
5,221,245 A 6/1993 Yeh
5,222,928 A 6/1993 Yacullo
5,224,909 A 7/1993 Hamilton
5,226,866 A 7/1993 Engel et al.
5,226,868 A 7/1993 Montgomery
5,230,680 A 7/1993 Wu
5,231,752 A 8/1993 Hereford
5,232,422 A 8/1993 Bishop, Jr.
5,234,392 A 8/1993 Clark
5,234,395 A 8/1993 Miller et al.
5,236,406 A 8/1993 Webber
5,240,417 A 8/1993 Smithson et al.
5,242,339 A 9/1993 Thornton
5,242,340 A 9/1993 Jerome
5,242,342 A 9/1993 Silverman
5,242,343 A 9/1993 Miller
5,242,344 A 9/1993 Hundley
5,242,345 A 9/1993 Mitchell
5,242,347 A 9/1993 Keeton
5,242,348 A 9/1993 Bates
5,242,353 A 9/1993 Cole et al.
5,244,444 A 9/1993 Wostry
5,247,853 A 9/1993 Dalebout
5,250,012 A 10/1993 Whitcomb, Jr.
5,250,013 A 10/1993 Brangi
5,254,065 A 10/1993 Pollock
5,254,066 A 10/1993 Brown et al.
5,254,067 A 10/1993 Habing et al.
5,256,117 A 10/1993 Potts et al.
5,256,118 A 10/1993 Chen
5,256,121 A 10/1993 Brotman
5,256,126 A 10/1993 Grotstein
5,257,701 A 11/1993 Edelson
5,257,964 A 11/1993 Petters
5,261,864 A 11/1993 Fitzpatrick
5,261,865 A 11/1993 Trainor
5,263,913 A 11/1993 Boren
5,263,915 A 11/1993 Habing
5,263,916 A 11/1993 Bobich
5,267,929 A 12/1993 Chen
5,267,930 A 12/1993 Henes
5,269,737 A 12/1993 Sobotka
5,269,738 A 12/1993 Boren
5,271,416 A 12/1993 Lepley
5,273,285 A 12/1993 Long
5,273,505 A 12/1993 Jones
5,277,678 A 1/1994 Friedebach et al.
5,277,683 A 1/1994 Wilkins
5,277,684 A 1/1994 Harris
5,279,528 A 1/1994 Dalebout et al.
5,279,529 A 1/1994 Eschenbach
5,279,531 A 1/1994 Jen Huey
5,280,936 A 1/1994 Schmidlin
5,281,193 A 1/1994 Colbo, Jr.
5,282,776 A 2/1994 Dalebout
5,284,461 A 2/1994 Wilkinson et al.
5,284,463 A 2/1994 Shields
5,284,464 A 2/1994 Lee, III et al.
5,286,243 A 2/1994 Lapcevic
5,290,205 A 3/1994 Densmore et al.
5,290,211 A 3/1994 Stearns
5,290,214 A 3/1994 Chen
5,292,293 A 3/1994 Schumacher
5,292,297 A 3/1994 Hsu
5,295,927 A 3/1994 Easley
5,295,928 A 3/1994 Rennex
5,295,935 A 3/1994 Wang
5,298,002 A 3/1994 Lin
5,299,992 A 4/1994 Wilkinson
5,299,993 A 4/1994 Habing
5,299,997 A 4/1994 Chen
5,302,161 A 4/1994 Loubert et al.
5,302,162 A 4/1994 Pasero
5,303,885 A 4/1994 Wade
5,306,218 A 4/1994 Huang Chen
5,306,221 A 4/1994 Itaru
5,308,075 A 5/1994 Theriault
5,308,234 A 5/1994 Nicke et al.
5,308,304 A 5/1994 Habing
5,310,392 A 5/1994 Lo
5,310,394 A 5/1994 Kallios
5,313,852 A 5/1994 Arena
5,314,390 A 5/1994 Westing et al.
5,314,391 A 5/1994 Potash et al.
5,314,392 A 5/1994 Hawkins et al.
5,314,394 A 5/1994 Ronan
5,316,534 A 5/1994 Dalebout et al.
5,318,487 A 6/1994 Golen et al.
5,318,490 A 6/1994 Henderson et al.
5,318,495 A 6/1994 Malynowsky
5,320,343 A 6/1994 McKinney
5,320,588 A 6/1994 Wanzer et al.
5,320,591 A 6/1994 Harmon et al.
5,320,641 A 6/1994 Riddle
5,322,489 A 6/1994 Webb et al.
5,324,242 A 6/1994 Lo
5,328,410 A 7/1994 Amburgey et al.
5,328,420 A 7/1994 Allen
5,328,422 A 7/1994 Nichols
5,328,428 A 7/1994 Huang
5,328,429 A 7/1994 Potash et al.
5,328,430 A 7/1994 Vittone
5,330,401 A 7/1994 Walstead
5,330,402 A 7/1994 Johnson
5,330,404 A 7/1994 Lopeteguy et al.
5,330,405 A 7/1994 Habing et al.
5,330,408 A 7/1994 Westmoreland, Jr.
5,334,120 A 8/1994 Rasmussen
5,336,142 A 8/1994 Dalebout et al.
5,336,143 A 8/1994 Wu
5,336,144 A 8/1994 Rodden
5,336,145 A 8/1994 Keiser
5,336,146 A 8/1994 Piaget et al.
5,336,148 A 8/1994 Ish, III
5,336,151 A 8/1994 Van Ballegooie
5,338,274 A 8/1994 Jones
5,338,277 A 8/1994 Yang
5,342,261 A 8/1994 Johnston
5,342,264 A 8/1994 Gordon
5,342,269 A 8/1994 Huang
5,342,271 A 8/1994 Long

(56) References Cited

U.S. PATENT DOCUMENTS

| | | | |
|---|---|---|---|
| RE34,728 | E | 9/1994 | Hall-Tipping |
| 5,344,372 | A | 9/1994 | Hung |
| 5,344,374 | A | 9/1994 | Telle |
| 5,346,447 | A | 9/1994 | Stearns |
| 5,348,524 | A | 9/1994 | Grant |
| 5,350,344 | A | 9/1994 | Kissel |
| 5,350,345 | A | 9/1994 | Frey |
| 5,352,166 | A | 10/1994 | Chang |
| 5,352,167 | A | 10/1994 | Ulicny |
| 5,352,169 | A | 10/1994 | Eschenbach |
| 5,352,171 | A | 10/1994 | Lin |
| 5,352,174 | A | 10/1994 | Mason et al. |
| 5,353,452 | A | 10/1994 | Rulis |
| 5,354,248 | A | 10/1994 | Rawls et al. |
| 5,354,251 | A | 10/1994 | Sleamaker |
| 5,354,252 | A | 10/1994 | Habing |
| 5,354,253 | A | 10/1994 | Awbrey et al. |
| 5,356,003 | A | 10/1994 | Gretz et al. |
| 5,356,356 | A | 10/1994 | Hildebrandt et al. |
| 5,356,357 | A | 10/1994 | Wang et al. |
| 5,356,358 | A | 10/1994 | Chen |
| 5,356,360 | A | 10/1994 | Johns |
| 5,358,461 | A | 10/1994 | Bailey, Jr. |
| 5,358,462 | A | 10/1994 | Calderone |
| 5,359,986 | A | 11/1994 | Magrath, III et al. |
| 5,362,069 | A | 11/1994 | Hall-Tipping |
| 5,362,290 | A | 11/1994 | Huang |
| 5,362,295 | A | 11/1994 | Nurge |
| 5,362,296 | A | 11/1994 | Wang et al. |
| 5,364,060 | A | 11/1994 | Donovan et al. |
| 5,364,327 | A | 11/1994 | Graham |
| 5,366,428 | A | 11/1994 | Liao |
| 5,366,432 | A | 11/1994 | Habing et al. |
| 5,368,042 | A | 11/1994 | O'Neal et al. |
| 5,368,532 | A | 11/1994 | Farnet |
| 5,368,536 | A | 11/1994 | Stodgell |
| 5,370,594 | A | 12/1994 | Grinblat |
| 5,372,556 | A | 12/1994 | Ropp |
| 5,372,559 | A | 12/1994 | Dalebout et al. |
| 5,372,560 | A | 12/1994 | Chang |
| 5,372,564 | A | 12/1994 | Spirito |
| 5,374,230 | A | 12/1994 | Bonnaime |
| 5,376,053 | A | 12/1994 | Ponder |
| 5,378,212 | A | 1/1995 | Pin-Kuo |
| 5,378,216 | A | 1/1995 | Ish, III et al. |
| 5,380,258 | A | 1/1995 | Hawley, Jr. |
| 5,382,207 | A | 1/1995 | Skowronski et al. |
| 5,382,208 | A | 1/1995 | Hu |
| 5,382,209 | A | 1/1995 | Pasier |
| 5,383,827 | A | 1/1995 | Stern |
| 5,383,828 | A | 1/1995 | Sands et al. |
| 5,385,346 | A | 1/1995 | Carroll et al. |
| 5,385,519 | A | 1/1995 | Hsu |
| 5,387,169 | A | 2/1995 | Wang |
| 5,387,171 | A | 2/1995 | Casey et al. |
| 5,391,132 | A | 2/1995 | Greenwald |
| 5,392,476 | A | 2/1995 | Williams |
| 5,394,922 | A | 3/1995 | Colson et al. |
| 5,396,876 | A | 3/1995 | Liscio et al. |
| 5,397,287 | A | 3/1995 | Lindfors |
| 5,398,948 | A | 3/1995 | Mathis |
| 5,401,226 | A | 3/1995 | Stearns |
| 5,403,251 | A | 4/1995 | Belsito et al. |
| 5,403,252 | A | 4/1995 | Leon et al. |
| 5,403,253 | A | 4/1995 | Gaylord |
| 5,403,254 | A | 4/1995 | Lundin et al. |
| 5,403,255 | A | 4/1995 | Johnston |
| 5,403,256 | A | 4/1995 | Squires |
| 5,406,661 | A | 4/1995 | Pekar |
| 5,407,402 | A | 4/1995 | Brown et al. |
| 5,407,404 | A | 4/1995 | Killian et al. |
| 5,407,405 | A | 4/1995 | Oren |
| 5,407,408 | A | 4/1995 | Wilkinson |
| 5,407,411 | A | 4/1995 | Trainor |
| 5,407,414 | A | 4/1995 | Bass |
| 5,409,330 | A | 4/1995 | Naines et al. |
| 5,409,435 | A | 4/1995 | Daniels |
| RE34,959 | E | 5/1995 | Potts |
| 5,410,971 | A | 5/1995 | Golden et al. |
| 5,413,546 | A | 5/1995 | Basile |
| 5,413,551 | A | 5/1995 | Wu |
| 5,415,608 | A | 5/1995 | Bode |
| 5,417,634 | A | 5/1995 | Habing |
| 5,417,643 | A | 5/1995 | Taylor |
| 5,419,570 | A | 5/1995 | Bollotte |
| 5,419,571 | A | 5/1995 | Vaughan |
| 5,419,747 | A | 5/1995 | Piaget |
| 5,419,749 | A | 5/1995 | Morgenstein |
| 5,419,751 | A | 5/1995 | Byrd et al. |
| 5,421,795 | A | 6/1995 | Chen |
| 5,421,796 | A | 6/1995 | Jones et al. |
| 5,421,798 | A | 6/1995 | Bond et al. |
| 5,421,800 | A | 6/1995 | Mullen |
| 5,421,801 | A | 6/1995 | Davies, III et al. |
| 5,423,729 | A | 6/1995 | Eschenbach |
| 5,423,730 | A | 6/1995 | Hirsch |
| 5,423,731 | A | 6/1995 | Chen |
| 5,429,563 | A | 7/1995 | Engel et al. |
| 5,429,567 | A | 7/1995 | Gerschefske et al. |
| 5,429,568 | A | 7/1995 | Chen |
| 5,429,569 | A | 7/1995 | Gunnari |
| 5,431,612 | A | 7/1995 | Holden |
| 5,433,679 | A | 7/1995 | Szymczak et al. |
| 5,433,685 | A | 7/1995 | Winslow |
| 5,435,315 | A | 7/1995 | McPhee et al. |
| 5,435,798 | A | 7/1995 | Habing et al. |
| 5,435,799 | A | 7/1995 | Lundin |
| 5,435,801 | A | 7/1995 | Hung |
| 5,437,589 | A | 8/1995 | Habing |
| 5,439,225 | A | 8/1995 | Gvoich et al. |
| 5,441,467 | A | 8/1995 | Stevens |
| 5,441,468 | A | 8/1995 | Deckers et al. |
| 5,443,435 | A | 8/1995 | Wilkinson |
| 5,447,480 | A | 9/1995 | Fulks |
| 5,449,332 | A | 9/1995 | Hervig |
| 5,449,334 | A | 9/1995 | Kingsbury |
| 5,451,191 | A | 9/1995 | Beenken |
| 5,453,066 | A | 9/1995 | Richter, Jr. |
| 5,454,772 | A | 10/1995 | Rodden |
| 5,454,773 | A | 10/1995 | Blanchard et al. |
| 5,456,644 | A | 10/1995 | Hecox et al. |
| 5,456,648 | A | 10/1995 | Edinburg |
| 5,458,553 | A | 10/1995 | Wu |
| 5,460,379 | A | 10/1995 | Cleland |
| 5,460,586 | A | 10/1995 | Wilkinson |
| 5,462,503 | A | 10/1995 | Benjamin et al. |
| 5,462,504 | A | 10/1995 | Trulaske et al. |
| 5,464,378 | A | 11/1995 | Yu |
| 5,466,200 | A | 11/1995 | Ulrich et al. |
| 5,466,203 | A | 11/1995 | Chen |
| 5,467,874 | A | 11/1995 | Whitaker |
| 5,468,205 | A | 11/1995 | McFall et al. |
| 5,470,298 | A | 11/1995 | Curtis |
| 5,471,405 | A | 11/1995 | Marsh |
| 5,472,397 | A | 12/1995 | Ammoscato et al. |
| 5,472,399 | A | 12/1995 | Szekely |
| 5,474,087 | A | 12/1995 | Nashner |
| 5,474,510 | A | 12/1995 | Chen |
| 5,476,428 | A | 12/1995 | Potash et al. |
| 5,476,430 | A | 12/1995 | Lee et al. |
| 5,478,298 | A | 12/1995 | Chen |
| 5,480,212 | A | 1/1996 | Marconet |
| 5,484,358 | A | 1/1996 | Wang et al. |
| 5,484,362 | A | 1/1996 | Skowronski et al. |
| 5,484,365 | A | 1/1996 | Jones et al. |
| 5,487,707 | A | 1/1996 | Sharf et al. |
| 5,489,249 | A | 2/1996 | Brewer et al. |
| 5,489,250 | A | 2/1996 | Densmore et al. |
| 5,490,818 | A | 2/1996 | Haber et al. |
| 5,492,514 | A | 2/1996 | Daum |
| 5,492,518 | A | 2/1996 | Measom |
| 5,492,520 | A | 2/1996 | Brown |
| 5,493,127 | A | 2/1996 | Lloyd et al. |
| 5,496,235 | A | 3/1996 | Stevens |

(56) References Cited

U.S. PATENT DOCUMENTS

| | | | |
|---|---|---|---|
| 5,496,236 | A | 3/1996 | Buonauito |
| 5,496,238 | A | 3/1996 | Taylor |
| 5,496,239 | A | 3/1996 | Kallman |
| 5,496,244 | A | 3/1996 | Caruthers |
| 5,498,222 | A | 3/1996 | Hur |
| 5,498,223 | A | 3/1996 | Iams et al. |
| 5,499,956 | A | 3/1996 | Habing et al. |
| 5,499,959 | A | 3/1996 | Holmes et al. |
| 5,499,961 | A | 3/1996 | Mattox |
| 5,501,647 | A | 3/1996 | Snyder |
| 5,501,656 | A | 3/1996 | Homma et al. |
| 5,503,608 | A | 4/1996 | Chang |
| 5,505,011 | A | 4/1996 | Bleimhofer |
| 5,505,677 | A | 4/1996 | Hinds |
| 5,507,271 | A | 4/1996 | Actor |
| 5,507,710 | A | 4/1996 | Chen |
| 5,509,870 | A | 4/1996 | Lloyd |
| 5,512,025 | A | 4/1996 | Dalebout et al. |
| 5,512,029 | A | 4/1996 | Barnard |
| 5,514,053 | A | 5/1996 | Hawkins et al. |
| 5,514,059 | A | 5/1996 | Romney |
| 5,518,471 | A | 5/1996 | Hettinger et al. |
| 5,518,473 | A | 5/1996 | Miller |
| 5,518,476 | A | 5/1996 | Mcleon |
| 5,518,477 | A | 5/1996 | Simonson |
| 5,518,483 | A | 5/1996 | Oswald |
| 5,518,486 | A | 5/1996 | Sheeler |
| 5,520,599 | A | 5/1996 | Chen |
| 5,522,783 | A | 6/1996 | Gordon |
| 5,527,245 | A | 6/1996 | Dalebout et al. |
| 5,527,249 | A | 6/1996 | Harris |
| 5,527,250 | A | 6/1996 | Chen |
| 5,527,253 | A | 6/1996 | Wilkinson |
| 5,529,554 | A | 6/1996 | Eschenbach |
| 5,529,560 | A | 6/1996 | Dise |
| 5,531,658 | A | 7/1996 | L. S. C. |
| 5,533,899 | A | 7/1996 | Young |
| 5,533,948 | A | 7/1996 | Wilkinson |
| 5,533,951 | A | 7/1996 | Chang |
| 5,533,952 | A | 7/1996 | Schaber |
| 5,538,489 | A | 7/1996 | Magid |
| 5,540,642 | A | 7/1996 | Sprague |
| 5,542,892 | A | 8/1996 | Buhler |
| 5,545,112 | A | 8/1996 | Densmore et al. |
| 5,545,114 | A | 8/1996 | Gvoich |
| 5,549,052 | A | 8/1996 | Hoffman |
| 5,549,530 | A | 8/1996 | Fulks |
| 5,549,532 | A | 8/1996 | Kropp |
| 5,549,533 | A | 8/1996 | Olson et al. |
| 5,549,536 | A | 8/1996 | Clark |
| 5,551,934 | A | 9/1996 | Binette |
| 5,551,937 | A | 9/1996 | Kwo |
| 5,554,033 | A | 9/1996 | Bizzi et al. |
| 5,554,083 | A | 9/1996 | Chen |
| 5,554,085 | A | 9/1996 | Dalebout |
| 5,554,086 | A | 9/1996 | Habing et al. |
| 5,556,362 | A | 9/1996 | Whipps |
| 5,556,369 | A | 9/1996 | Roberts |
| 5,558,608 | A | 9/1996 | Hall |
| 5,562,572 | A | 10/1996 | Carmein |
| 5,562,574 | A | 10/1996 | Miller |
| 5,562,577 | A | 10/1996 | Nichols, Sr. et al. |
| 5,563,487 | A | 10/1996 | Davis |
| 5,568,993 | A | 10/1996 | Potzick |
| 5,569,128 | A | 10/1996 | Dalebout |
| 5,569,133 | A | 10/1996 | Vittone |
| 5,569,138 | A | 10/1996 | Wang et al. |
| 5,571,064 | A | 11/1996 | Holm |
| 5,573,485 | A | 11/1996 | Geschwender |
| 5,575,740 | A | 11/1996 | Piaget |
| 5,577,985 | A | 11/1996 | Miller |
| 5,577,987 | A | 11/1996 | Brown |
| 5,580,249 | A | 12/1996 | Jacobsen et al. |
| 5,580,340 | A | 12/1996 | Yu |
| 5,580,341 | A | 12/1996 | Simonson |
| 5,582,563 | A | 12/1996 | Fan |
| 5,582,565 | A | 12/1996 | Soria |
| 5,584,700 | A | 12/1996 | Feldman et al. |
| 5,584,779 | A | 12/1996 | Knecht |
| 5,586,736 | A | 12/1996 | Mollet |
| 5,586,811 | A | 12/1996 | Tornero |
| 5,586,962 | A | 12/1996 | Hallmark |
| 5,588,938 | A | 12/1996 | Schneider et al. |
| 5,588,942 | A | 12/1996 | Dillard |
| 5,590,893 | A | 1/1997 | Robinson et al. |
| 5,591,104 | A | 1/1997 | Andrus et al. |
| 5,591,106 | A | 1/1997 | Dalebout et al. |
| 5,591,107 | A | 1/1997 | Rodgers, Jr. |
| 5,591,908 | A | 1/1997 | Reid |
| 5,593,372 | A | 1/1997 | Rodgers, Jr. |
| 5,593,380 | A | 1/1997 | Bittikofer |
| 5,595,545 | A | 1/1997 | O'Brien |
| 5,595,556 | A | 1/1997 | Dalebout et al. |
| 5,595,559 | A | 1/1997 | Viel |
| 5,597,362 | A | 1/1997 | Lee |
| 5,597,375 | A | 1/1997 | Simonson |
| 5,599,261 | A | 2/1997 | Easley et al. |
| 5,600,310 | A | 2/1997 | Whipple, III et al. |
| 5,601,518 | A | 2/1997 | Weintraub |
| 5,603,675 | A | 2/1997 | Wu |
| 5,603,678 | A | 2/1997 | Wilson |
| 5,605,524 | A | 2/1997 | Husted |
| 5,607,250 | A | 3/1997 | Tatterson et al. |
| 5,607,375 | A | 3/1997 | Dalebout |
| 5,609,278 | A | 3/1997 | Fresco |
| 5,613,216 | A | 3/1997 | Galler |
| 5,613,856 | A | 3/1997 | Hoover |
| 5,613,924 | A | 3/1997 | Lee |
| 5,613,928 | A | 3/1997 | Laudone |
| 5,616,103 | A | 4/1997 | Lee |
| 5,616,106 | A | 4/1997 | Abelbeck |
| 5,616,107 | A | 4/1997 | Simonson |
| 5,616,111 | A | 4/1997 | Randolph |
| 5,618,250 | A | 4/1997 | Butz |
| 5,620,402 | A | 4/1997 | Simonson |
| 5,620,403 | A | 4/1997 | Lundin |
| 5,622,527 | A | 4/1997 | Watterson et al. |
| 5,624,353 | A | 4/1997 | Naidus |
| 5,624,360 | A | 4/1997 | Wilkins |
| 5,624,361 | A | 4/1997 | Lai |
| 5,625,577 | A | 4/1997 | Kunii et al. |
| 5,626,539 | A | 5/1997 | Piaget |
| 5,626,546 | A | 5/1997 | Little |
| 5,626,548 | A | 5/1997 | Coyle |
| 5,628,715 | A | 5/1997 | Simonson |
| 5,628,716 | A | 5/1997 | Brice |
| 5,630,566 | A | 5/1997 | Case |
| 5,632,209 | A | 5/1997 | Sakakibara |
| 5,632,711 | A | 5/1997 | Hwang |
| 5,634,870 | A | 6/1997 | Wilkinson |
| 5,637,064 | A | 6/1997 | Olson et al. |
| 5,643,142 | A | 7/1997 | Salerno et al. |
| 5,643,144 | A | 7/1997 | Trulaske |
| 5,643,147 | A | 7/1997 | Huang |
| 5,643,152 | A | 7/1997 | Simonson |
| 5,643,153 | A | 7/1997 | Nylen et al. |
| 5,643,157 | A | 7/1997 | Seliber |
| 5,643,162 | A | 7/1997 | Landers et al. |
| 5,645,509 | A | 7/1997 | Brewer et al. |
| 5,645,510 | A | 7/1997 | Wilkinson |
| 5,645,914 | A | 7/1997 | Horowitz |
| 5,649,882 | A | 7/1997 | Parikh et al. |
| 5,650,709 | A | 7/1997 | Rotunda et al. |
| 5,653,662 | A | 8/1997 | Rodgers, Jr. |
| 5,653,669 | A | 8/1997 | Cheng |
| 5,655,997 | A | 8/1997 | Greenberg et al. |
| 5,656,001 | A | 8/1997 | Baatz |
| 5,656,003 | A | 8/1997 | Robinson et al. |
| 5,658,227 | A | 8/1997 | Stearns |
| 5,662,557 | A | 9/1997 | Watterson et al. |
| 5,665,031 | A | 9/1997 | Hsieh |
| 5,665,033 | A | 9/1997 | Palmer |
| 5,665,041 | A | 9/1997 | Hsieh |
| 5,667,459 | A | 9/1997 | Su |

(56) References Cited

U.S. PATENT DOCUMENTS 5,667,465 A 9/1997 McCollum et al.
5,669,455 A 9/1997 Dietrich
5,669,833 A 9/1997 Stone
5,669,857 A 9/1997 Watterson et al.
5,669,862 A 9/1997 Sayman
5,669,865 A 9/1997 Gordon
5,672,140 A 9/1997 Watterson et al.
5,674,156 A 10/1997 Watterson et al.
5,674,167 A 10/1997 Piaget et al.
5,679,047 A 10/1997 Engel
5,679,100 A 10/1997 Charnitski
5,679,101 A 10/1997 Magid
5,681,247 A 10/1997 Webber
5,681,249 A 10/1997 Endelman
5,683,332 A 11/1997 Watterson et al.
5,683,334 A 11/1997 Webber
5,685,810 A 11/1997 Chung
5,688,196 A 11/1997 O'neil
5,688,209 A 11/1997 Trulaske et al.
5,688,210 A 11/1997 Chou
5,688,212 A 11/1997 Walker
5,688,216 A 11/1997 Mauriello
5,690,582 A 11/1997 Ulrich et al.
5,690,587 A 11/1997 Gruenangerl
5,690,589 A 11/1997 Rodgers, Jr.
5,692,994 A 12/1997 Eschenbach
5,692,996 A 12/1997 Widerman
5,692,997 A 12/1997 Stearns
5,693,004 A 12/1997 Carlson et al.
5,695,434 A 12/1997 Dalebout et al.
5,695,436 A 12/1997 Huang
5,702,325 A 12/1997 Watterson et al.
5,704,879 A 1/1998 Watterson et al.
5,707,168 A 1/1998 Sharon
5,707,319 A 1/1998 Riley
5,708,355 A 1/1998 Schrey
5,709,428 A 1/1998 Hugghins
5,709,632 A 1/1998 Socwell
5,709,633 A 1/1998 Sokol
5,709,634 A 1/1998 Pointer
5,709,636 A 1/1998 Vallone
5,709,638 A 1/1998 Mackert et al.
5,711,745 A 1/1998 Yang
5,711,746 A 1/1998 Carlson
5,711,749 A 1/1998 Miller
5,713,549 A 2/1998 Shieh
5,713,821 A 2/1998 Nissen
5,716,308 A 2/1998 Lee
5,718,657 A 2/1998 Dalebout et al.
5,718,660 A 2/1998 Chen
5,720,200 A 2/1998 Anderson et al.
5,720,474 A 2/1998 Sugiyama
5,720,702 A 2/1998 Lee
5,722,917 A 3/1998 Olschansky et al.
5,722,920 A 3/1998 Bauer
5,722,921 A 3/1998 Simonson
5,722,922 A 3/1998 Watterson et al.
5,725,459 A 3/1998 Rexach
5,725,463 A 3/1998 Colonello et al.
5,730,236 A 3/1998 Miller et al.
5,733,227 A 3/1998 Lee
5,733,228 A 3/1998 Stevens
5,733,229 A 3/1998 Dalebout et al.
5,733,232 A 3/1998 Hsu
5,735,586 A 4/1998 Cheng
5,735,773 A 4/1998 Vittone
5,735,776 A 4/1998 Swezey
5,738,612 A 4/1998 Tsuda
5,738,616 A 4/1998 Robertson
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,746,687 A 5/1998 Vial et al.
5,746,688 A 5/1998 Prager
5,749,372 A 5/1998 Allen
5,749,668 A 5/1998 Mcilvain
5,749,787 A 5/1998 Jank
5,749,807 A 5/1998 Webb
5,749,809 A 5/1998 Lin
5,749,813 A 5/1998 Domzalski
5,752,879 A 5/1998 Berdut
5,752,897 A 5/1998 Skowronski et al.
5,752,901 A 5/1998 Lee
5,755,642 A 5/1998 Miller
5,755,645 A 5/1998 Miller et al.
5,755,646 A 5/1998 Chu
5,755,651 A 5/1998 Homyonfer
5,755,823 A 5/1998 Cleary
5,759,136 A 6/1998 Chen
5,759,139 A 6/1998 Wright
5,760,353 A 6/1998 Rapp
5,761,831 A 6/1998 Cho
5,762,584 A 6/1998 Daniels
5,762,587 A 6/1998 Dalebout et al.
5,762,588 A 6/1998 Chen
5,766,118 A 6/1998 Conner
5,769,759 A 6/1998 Alter
5,769,762 A 6/1998 Towley, III et al.
5,771,152 A 6/1998 Crompton et al.
5,772,522 A 6/1998 Nesbit
5,772,558 A 6/1998 Rodgers, Jr.
5,772,560 A 6/1998 Watterson et al.
5,772,563 A 6/1998 Lin
5,776,040 A 7/1998 Webb et al.
5,776,582 A 7/1998 Needham
5,779,599 A 7/1998 Chen
5,779,604 A 7/1998 Towley, III et al.
5,779,607 A 7/1998 Harris
5,782,639 A 7/1998 Beal
5,782,723 A 7/1998 Kuo
5,785,630 A 7/1998 Bobick et al.
5,785,632 A 7/1998 Greenberg et al.
5,788,609 A 8/1998 Miller
5,788,610 A 8/1998 Eschenbach
5,788,611 A 8/1998 Kuo
5,788,616 A 8/1998 Polidi
5,788,618 A 8/1998 Joutras
5,792,027 A 8/1998 Gvoich
5,792,028 A 8/1998 Jarvie
5,792,029 A 8/1998 Gordon
5,792,031 A 8/1998 Alton
5,792,034 A 8/1998 Kozlovsky
5,795,270 A 8/1998 Woods et al.
5,795,274 A 8/1998 Kasbohm
5,797,578 A 8/1998 Graffeo
5,797,639 A 8/1998 Zorzenon
5,800,310 A 9/1998 Jones
5,800,321 A 9/1998 Webber
5,800,323 A 9/1998 Ansel
5,803,874 A 9/1998 Wilkinson
5,803,877 A 9/1998 Franey
5,803,882 A 9/1998 Habing et al.
5,807,210 A 9/1998 Devlin
5,807,214 A 9/1998 Riazi
5,810,697 A 9/1998 Joiner
5,810,698 A 9/1998 Hullett et al.
5,810,702 A 9/1998 Wilkinson
5,813,142 A 9/1998 Demon
5,813,947 A 9/1998 Densmore
5,813,953 A 9/1998 Whipple
5,816,372 A 10/1998 Carlson et al.
5,816,981 A 10/1998 Hung
5,816,983 A 10/1998 Dawes et al.
5,820,529 A 10/1998 Weintraub
5,820,532 A 10/1998 Oliver
5,823,618 A 10/1998 Fox et al.
5,825,983 A 10/1998 Park et al.
5,827,155 A 10/1998 Jensen et al.
5,827,158 A 10/1998 Drecksel
5,829,771 A 11/1998 Hsu
5,830,107 A 11/1998 Brigliadoro

(56) References Cited

U.S. PATENT DOCUMENTS 5,830,113 A 11/1998 Coody et al.
5,830,114 A 11/1998 Halfen et al.
5,833,577 A 11/1998 Hurt
5,833,582 A 11/1998 Chen
5,833,583 A 11/1998 Chuang
5,833,584 A 11/1998 Piaget et al.
5,833,587 A 11/1998 Strong et al.
5,836,770 A 11/1998 Powers
5,836,854 A 11/1998 Kuo
5,836,858 A 11/1998 Sharff
5,839,990 A 11/1998 Virkkala
5,839,993 A 11/1998 Fox
5,839,997 A 11/1998 Roth et al.
5,842,956 A 12/1998 Strachan
5,842,961 A 12/1998 Davis
5,846,166 A 12/1998 Kuo
5,848,954 A 12/1998 Stearns et al.
5,852,264 A 12/1998 Muller
5,855,537 A 1/1999 Coody et al.
5,855,538 A 1/1999 Argabright
5,857,939 A 1/1999 Kaufman
5,857,940 A 1/1999 Husted
5,857,941 A 1/1999 Maresh
5,857,942 A 1/1999 Moon et al.
5,857,943 A 1/1999 Murray
5,860,190 A 1/1999 Cano
5,860,893 A 1/1999 Watterson et al.
5,860,894 A 1/1999 Dalebout et al.
5,860,899 A 1/1999 Rassman
5,865,710 A 2/1999 Wilson-Hyde
5,865,714 A 2/1999 Marlowe
5,868,108 A 2/1999 Schmitz et al.
5,868,648 A 2/1999 Coody et al.
5,868,653 A 2/1999 Klasen
5,871,421 A 2/1999 Trulaske et al.
5,871,424 A 2/1999 Conner
5,876,095 A 3/1999 Johnston
5,876,310 A 3/1999 Mackey et al.
5,876,313 A 3/1999 Krull
5,879,247 A 3/1999 Winter et al.
5,879,273 A 3/1999 Wei
5,879,276 A 3/1999 Miller
5,882,281 A 3/1999 Stearns et al.
5,885,196 A 3/1999 Gvoich
5,888,172 A 3/1999 Andrus et al.
5,890,562 A 4/1999 Bartels et al.
5,890,995 A 4/1999 Bobick et al.
5,891,001 A 4/1999 Carnes et al.
5,891,003 A 4/1999 Deac et al.
5,891,004 A 4/1999 Berry
5,891,042 A 4/1999 Sham et al.
5,895,339 A 4/1999 Maresh
5,895,340 A 4/1999 Keller
5,895,342 A 4/1999 Solland
5,897,457 A 4/1999 Mackovjak
5,897,459 A 4/1999 Habing et al.
5,897,460 A 4/1999 McBride et al.
5,897,461 A 4/1999 Socwell
5,897,463 A 4/1999 Maresh
5,897,467 A 4/1999 Habing et al.
5,897,469 A 4/1999 Yalch
5,897,472 A 4/1999 Thulasingam
5,897,474 A 4/1999 Romero
5,899,833 A 5/1999 Ryan et al.
5,902,214 A 5/1999 Makikawa et al.
5,904,398 A 5/1999 Farricielli
5,904,636 A 5/1999 Chen
5,904,638 A 5/1999 Habing et al.
5,906,269 A 5/1999 Zabron et al.
5,906,564 A 5/1999 Jacobsen
5,906,566 A 5/1999 Whitcomb
5,908,373 A 6/1999 Pitre
5,910,070 A 6/1999 Henry et al.
5,910,072 A 6/1999 Rawls et al.
5,910,073 A 6/1999 Conner
5,911,132 A 6/1999 Sloane
5,911,649 A 6/1999 Miller
5,913,751 A 6/1999 Eschenbach
5,916,064 A 6/1999 Eschenbach
5,916,069 A 6/1999 Wang
5,917,692 A 6/1999 Schmitz et al.
5,919,118 A 7/1999 Stearns
5,921,892 A 7/1999 Easton
5,921,896 A 7/1999 Boland
5,921,901 A 7/1999 Palacios
5,924,966 A 7/1999 Havlovic
5,925,001 A 7/1999 Hoyt et al.
5,927,780 A 7/1999 Chandler
5,928,116 A 7/1999 Chiang
5,931,767 A 8/1999 Morales
5,935,048 A 8/1999 Krull
5,938,551 A 8/1999 Warner
5,938,565 A 8/1999 Bernacki
5,938,570 A 8/1999 Maresh
5,938,571 A 8/1999 Stevens
5,938,574 A 8/1999 Webber
5,938,575 A 8/1999 Stearns
5,940,502 A 8/1999 Hirai et al.
5,940,911 A 8/1999 Wang
5,941,800 A 8/1999 Laconis
5,941,803 A 8/1999 Chamberlain
5,941,807 A 8/1999 Cassidy
5,943,794 A 8/1999 Gelsomini
5,944,641 A 8/1999 Habing
5,944,642 A 8/1999 Krull
5,947,869 A 9/1999 Shea
5,947,872 A 9/1999 Ryan et al.
5,951,444 A 9/1999 Webber
5,951,447 A 9/1999 Butler
5,951,449 A 9/1999 Oppriecht
5,954,106 A 9/1999 Huang
5,954,621 A 9/1999 Joutras et al.
5,957,814 A 9/1999 Eschenbach
5,957,819 A 9/1999 Cortesi
5,961,423 A 10/1999 Sellers
5,961,428 A 10/1999 Webber
5,961,430 A 10/1999 Zuckerman et al.
5,964,684 A 10/1999 Sokol
5,967,944 A 10/1999 Vittone et al.
5,967,948 A 10/1999 Carr
5,967,950 A 10/1999 Hsu
5,967,954 A 10/1999 Habing
5,967,955 A 10/1999 Westfall et al.
5,971,892 A 10/1999 Lee
5,971,895 A 10/1999 Habing
5,971,902 A 10/1999 Robertson et al.
5,976,039 A 11/1999 Epel et al.
5,976,061 A 11/1999 Moon et al.
5,980,430 A 11/1999 Wang
5,980,432 A 11/1999 Ahman
5,984,798 A 11/1999 Gilmour
5,984,836 A 11/1999 Casali
5,984,839 A 11/1999 Corkum
5,989,161 A 11/1999 Wang et al.
5,989,163 A 11/1999 Rodgers, Jr.
5,989,164 A 11/1999 Kullman et al.
5,989,165 A 11/1999 Giannelli et al.
5,989,166 A 11/1999 Capizzo et al.
5,989,168 A 11/1999 See
5,991,143 A 11/1999 Wright et al.
5,993,358 A 11/1999 Gureghian et al.
5,993,359 A 11/1999 Eschenbach
5,993,362 A 11/1999 Ghobadi
5,997,447 A 12/1999 Giannelli et al.
5,997,450 A 12/1999 Wilkinson
5,998,897 A 12/1999 Bosten et al.
6,003,294 A 12/1999 Fitzgerald et al.
6,003,481 A 12/1999 Pischinger et al.
6,004,244 A 12/1999 Simonson
6,004,246 A 12/1999 Sencil
6,004,247 A 12/1999 Webber
6,006,379 A 12/1999 Hensley
6,007,268 A 12/1999 Whittington et al.
6,010,432 A 1/2000 Vawter

(56) References Cited

U.S. PATENT DOCUMENTS

| | | | |
|---|---|---|---|
| 6,011,134 | A | 1/2000 | Marks et al. |
| 6,012,591 | A | 1/2000 | Brandenberg |
| 6,012,772 | A | 1/2000 | Conde et al. |
| 6,013,011 | A | 1/2000 | Moore et al. |
| 6,015,367 | A | 1/2000 | Scaramucci |
| 6,015,368 | A | 1/2000 | Clem |
| 6,015,371 | A | 1/2000 | Davitt |
| 6,017,293 | A | 1/2000 | Pfefferle |
| 6,019,403 | A | 2/2000 | Corbett |
| 6,022,300 | A | 2/2000 | Hightower |
| 6,022,302 | A | 2/2000 | McBride |
| 6,024,677 | A | 2/2000 | Siwertz |
| 6,027,429 | A | 2/2000 | Daniels |
| 6,027,430 | A | 2/2000 | Stearns et al. |
| 6,027,432 | A | 2/2000 | Cheng |
| 6,027,433 | A | 2/2000 | Flynn |
| 6,029,858 | A | 2/2000 | Srokose |
| 6,030,320 | A | 2/2000 | Stearns |
| 6,030,321 | A | 2/2000 | Fuentes |
| 6,030,323 | A | 2/2000 | Fontenot |
| 6,033,344 | A | 3/2000 | Trulaske et al. |
| 6,033,347 | A | 3/2000 | Dalebout et al. |
| 6,033,350 | A | 3/2000 | Krull |
| 6,036,622 | A | 3/2000 | Gordon |
| 6,036,625 | A | 3/2000 | Woodruff |
| 6,039,677 | A | 3/2000 | Spletzer |
| 6,039,678 | A | 3/2000 | Dawson |
| 6,042,512 | A | 3/2000 | Eschenbach |
| 6,042,514 | A | 3/2000 | Abelbeck |
| 6,042,515 | A | 3/2000 | Wang |
| 6,042,516 | A | 3/2000 | Norton |
| 6,042,518 | A | 3/2000 | Hildebrandt et al. |
| 6,042,523 | A | 3/2000 | Graham |
| 6,045,487 | A | 4/2000 | Miller |
| 6,045,488 | A | 4/2000 | Eschenbach |
| 6,045,490 | A | 4/2000 | Shafer |
| 6,045,491 | A | 4/2000 | McNergney |
| 6,050,920 | A | 4/2000 | Ehrenfried |
| 6,050,921 | A | 4/2000 | Wang |
| 6,050,922 | A | 4/2000 | Wang |
| 6,050,923 | A | 4/2000 | Yu |
| 6,053,816 | A | 4/2000 | Immel |
| 6,053,844 | A | 4/2000 | Clem |
| 6,053,847 | A | 4/2000 | Stearns et al. |
| 6,053,848 | A | 4/2000 | Eschenbach |
| 6,053,853 | A | 4/2000 | Hinds |
| 6,055,747 | A | 5/2000 | Lombardino |
| 6,056,678 | A | 5/2000 | Giannelli et al. |
| 6,059,692 | A | 5/2000 | Hickman |
| 6,059,695 | A | 5/2000 | Hung |
| 6,059,698 | A | 5/2000 | Mazor |
| 6,059,701 | A | 5/2000 | George et al. |
| 6,063,009 | A | 5/2000 | Stearns |
| 6,065,572 | A | 5/2000 | Schober et al. |
| 6,066,075 | A | 5/2000 | Poulton |
| 6,066,077 | A | 5/2000 | Horst |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,071,217 | A | 6/2000 | Barnett |
| 6,074,328 | A | 6/2000 | Johnson |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,079,915 | A | 6/2000 | Bosten et al. |
| 6,080,091 | A | 6/2000 | Habing et al. |
| 6,082,346 | A | 7/2000 | Andrews et al. |
| 6,083,144 | A | 7/2000 | Towley, III et al. |
| 6,086,520 | A | 7/2000 | Rodriquez |
| 6,086,521 | A | 7/2000 | Solland |
| 6,090,014 | A | 7/2000 | Eschenbach |
| 6,090,016 | A | 7/2000 | Kuo |
| 6,090,020 | A | 7/2000 | Webber |
| 6,095,951 | A | 8/2000 | Skowronski et al. |
| 6,095,954 | A | 8/2000 | Svanberg |
| 6,099,439 | A | 8/2000 | Ryan et al. |
| 6,099,442 | A | 8/2000 | Krull |
| 6,099,444 | A | 8/2000 | Domenge |
| 6,101,684 | A | 8/2000 | Ginocchio |
| 6,102,412 | A | 8/2000 | Staffaroni |
| 6,102,832 | A | 8/2000 | Tani |
| 6,102,836 | A | 8/2000 | Person |
| 6,102,837 | A | 8/2000 | Hubbard |
| 6,106,437 | A | 8/2000 | Brooks |
| 6,106,439 | A | 8/2000 | Boland |
| 6,110,075 | A | 8/2000 | Woodruff |
| 6,110,076 | A | 8/2000 | Hurt |
| 6,110,077 | A | 8/2000 | Yu |
| 6,110,081 | A | 8/2000 | Barrett |
| 6,112,624 | A | 9/2000 | Chen |
| 6,113,188 | A | 9/2000 | Stewart et al. |
| 6,113,323 | A | 9/2000 | Bosten et al. |
| 6,113,518 | A | 9/2000 | Maresh |
| 6,113,522 | A | 9/2000 | Montgomery |
| 6,113,564 | A | 9/2000 | McGuire |
| 6,117,049 | A | 9/2000 | Lowe |
| 6,120,421 | A | 9/2000 | Kuo |
| 6,120,424 | A | 9/2000 | Arline |
| 6,123,646 | A | 9/2000 | Colassi |
| 6,123,647 | A | 9/2000 | Mitchell |
| 6,123,648 | A | 9/2000 | Stevens |
| 6,123,649 | A | 9/2000 | Lee |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,126,577 | A | 10/2000 | Chang |
| 6,128,981 | A | 10/2000 | Bondhus et al. |
| 6,129,651 | A | 10/2000 | Denaro |
| 6,129,962 | A | 10/2000 | Quigley et al. |
| 6,132,314 | A | 10/2000 | Aiki |
| 6,132,340 | A | 10/2000 | Wang |
| 6,132,347 | A | 10/2000 | Alessandri |
| 6,135,924 | A | 10/2000 | Gibbs et al. |
| 6,135,925 | A | 10/2000 | Liu |
| 6,135,926 | A | 10/2000 | Lee |
| 6,135,927 | A | 10/2000 | Lo |
| 6,142,870 | A | 11/2000 | Wada et al. |
| 6,142,913 | A | 11/2000 | Ewert |
| 6,142,914 | A | 11/2000 | Crawford et al. |
| 6,142,915 | A | 11/2000 | Eschenbach |
| 6,146,313 | A | 11/2000 | Whan-Tong et al. |
| 6,146,315 | A | 11/2000 | Schonenberger |
| 6,149,551 | A | 11/2000 | Pyles et al. |
| 6,149,552 | A | 11/2000 | Chen |
| 6,149,556 | A | 11/2000 | Jordan |
| 6,149,558 | A | 11/2000 | Chen |
| 6,149,559 | A | 11/2000 | Mackey |
| 6,152,856 | A | 11/2000 | Studor et al. |
| 6,152,859 | A | 11/2000 | Stearns |
| 6,152,864 | A | 11/2000 | Giannelli et al. |
| 6,162,153 | A | 12/2000 | Perez, Jr. |
| 6,162,183 | A | 12/2000 | Hoover |
| 6,163,451 | A | 12/2000 | Chiu |
| 6,165,107 | A | 12/2000 | Birrell |
| 6,165,110 | A | 12/2000 | Gajda |
| 6,168,551 | B1 | 1/2001 | Mcguinness |
| 6,168,557 | B1 | 1/2001 | Liao |
| 6,171,216 | B1 | 1/2001 | Wang |
| 6,172,178 | B1 | 1/2001 | Koning et al. |
| 6,174,265 | B1 | 1/2001 | Alessandri |
| 6,174,267 | B1 | 1/2001 | Dalebout |
| 6,174,268 | B1 | 1/2001 | Novak |
| 6,175,994 | B1 | 1/2001 | Nicoletti |
| 6,176,814 | B1 | 1/2001 | Ryan et al. |
| 6,179,748 | B1 | 1/2001 | Barr |
| 6,179,753 | B1 | 1/2001 | Barker et al. |
| 6,181,647 | B1 | 1/2001 | Tipton et al. |
| 6,183,397 | B1 | 2/2001 | Stearns et al. |
| 6,183,400 | B1 | 2/2001 | Pope |
| 6,183,401 | B1 | 2/2001 | Krull |

(56) References Cited

U.S. PATENT DOCUMENTS 6,183,403 B1 2/2001 Dunn
6,186,290 B1 2/2001 Carlson
6,186,460 B1 2/2001 Lin
6,186,926 B1 2/2001 Ellis
6,186,927 B1 2/2001 Krull
6,186,928 B1 2/2001 Chen
6,186,929 B1 2/2001 Endelman et al.
6,189,846 B1 2/2001 Wang
6,190,289 B1 2/2001 Pyles et al.
6,193,635 B1 2/2001 Webber et al.
6,196,952 B1 3/2001 Chen
6,196,954 B1 3/2001 Chen
6,199,732 B1 3/2001 Swetish
6,203,473 B1 3/2001 Atwood
6,203,474 B1 3/2001 Jones
6,206,795 B1 3/2001 Ou
6,206,804 B1 3/2001 Maresh
6,210,305 B1 4/2001 Eschenbach
6,213,919 B1 4/2001 Wang
6,213,923 B1 4/2001 Cameron et al.
6,215,870 B1 4/2001 Hirai et al.
6,217,483 B1 4/2001 Kallassy
6,217,487 B1 4/2001 Reinert
6,217,493 B1 4/2001 Spletzer
6,217,495 B1 4/2001 Yalch
6,220,990 B1 4/2001 Crivello
6,220,992 B1 4/2001 Shafik
6,220,995 B1 4/2001 Chen
6,224,516 B1 5/2001 Disch
6,224,519 B1 5/2001 Doolittle
6,228,003 B1 5/2001 Hald et al.
6,230,047 B1 5/2001 McHugh
6,230,460 B1 5/2001 Huyett
6,231,482 B1 5/2001 Thompson
6,231,489 B1 5/2001 McBride et al.
6,231,946 B1 5/2001 Brown, Jr. et al.
6,234,935 B1 5/2001 Chu
6,234,936 B1 5/2001 Wang
6,234,941 B1 5/2001 Chu
6,237,583 B1 5/2001 Ripley et al.
6,238,322 B1 5/2001 Hsu
6,238,323 B1 5/2001 Simonson
6,241,553 B1 6/2001 Hsia
6,241,638 B1 6/2001 Hurt
6,244,988 B1 6/2001 Delman
6,244,992 B1 6/2001 James
6,244,995 B1 6/2001 Prsala
6,245,001 B1 6/2001 Siaperas
6,251,047 B1 6/2001 Stearns et al.
6,251,048 B1 6/2001 Kaufman
6,251,052 B1 6/2001 Simonson
6,254,514 B1 7/2001 Maresh et al.
6,254,515 B1 7/2001 Carman et al.
6,254,516 B1 7/2001 Giannelli et al.
6,261,022 B1 7/2001 Dalebout et al.
6,261,209 B1 7/2001 Coody
6,264,272 B1 7/2001 Jones et al.
6,264,586 B1 7/2001 Webber
6,264,588 B1 7/2001 Ellis
6,267,710 B1 7/2001 Liu
6,267,711 B1 7/2001 Hinds
6,273,842 B1 8/2001 Wang
6,273,843 B1 8/2001 Lo
6,276,749 B1 8/2001 Okazawa et al.
6,277,054 B1 8/2001 Kuo
6,277,056 B1 8/2001 McBride et al.
6,280,361 B1 8/2001 Harvey et al.
6,280,367 B1 8/2001 Arsenault
6,282,816 B1 9/2001 Rosendahl
6,283,859 B1 9/2001 Carlson et al.
6,283,896 B1 9/2001 Grunfeld
6,287,240 B1 9/2001 Trabbic
6,287,241 B1 9/2001 Ellis
6,290,630 B1 9/2001 Boland
6,293,375 B1 9/2001 Chen
6,293,892 B1 9/2001 Slawinski et al.
6,299,959 B1 10/2001 Squires et al.
6,302,815 B1 10/2001 Shishido et al.
6,302,826 B1 10/2001 Lee
6,302,828 B1 10/2001 Martin et al.
6,302,829 B1 10/2001 Schmidt
6,302,833 B1 10/2001 Ellis et al.
6,306,108 B1 10/2001 Butler
6,307,167 B1 10/2001 Kajio et al.
6,309,331 B1 10/2001 Raymond
6,312,363 B1 11/2001 Watterson et al.
6,312,366 B1 11/2001 Prusick
6,314,667 B1 11/2001 Rife et al.
6,315,486 B1 11/2001 Lunz
6,315,702 B1 11/2001 Ikonomopoulos
6,319,176 B1 11/2001 Landfair
6,319,178 B1 11/2001 Webber
6,319,179 B1 11/2001 Hinds
6,322,059 B1 11/2001 Kelm et al.
6,322,481 B1 11/2001 Krull
6,322,483 B1 11/2001 Rotella
6,325,745 B1 12/2001 Yu
6,325,746 B1 12/2001 Wang
6,328,325 B1 12/2001 Greenwood
6,328,676 B1 12/2001 Alessandri
6,328,677 B1 12/2001 Drapeau
6,334,624 B1 1/2002 Giglio
6,335,100 B1 1/2002 Tominaga et al.
6,338,701 B1 1/2002 Webber
6,340,340 B1 1/2002 Stearns
6,342,028 B1 1/2002 De Sane
6,344,986 B1 2/2002 Jain et al.
6,347,603 B1 2/2002 Felger
6,347,731 B1 2/2002 Burger
6,348,028 B1 2/2002 Cragg
6,350,218 B1 2/2002 Dalebout et al.
6,350,219 B1 2/2002 Hobson
6,350,221 B1 2/2002 Krull
6,352,494 B2 3/2002 McAlonan
6,357,077 B1 3/2002 Jones, Jr. et al.
6,358,187 B1 3/2002 Smith
6,360,408 B1 3/2002 Dykstra et al.
6,361,476 B1 3/2002 Eschenbach
6,368,251 B1 4/2002 Casler
6,368,252 B1 4/2002 Stearns
6,368,254 B1 4/2002 Wall
6,371,738 B2 4/2002 Jones
6,371,895 B1 4/2002 Endelman et al.
6,375,580 B1 4/2002 Schmidt
6,379,287 B1 4/2002 Slawinski et al.
6,379,289 B1 4/2002 Gossie
6,382,627 B1 5/2002 Lundberg
6,383,120 B1 5/2002 Lo
6,387,015 B1 5/2002 Watson
6,387,016 B1 5/2002 Lo
6,387,018 B1 5/2002 Krull
6,387,019 B1 5/2002 Krull
6,387,022 B1 5/2002 Smith
6,387,024 B1 5/2002 Monti et al.
6,390,927 B1 5/2002 Cleveland, III
6,390,953 B1 5/2002 Maresh
6,390,955 B1 5/2002 Wang
6,394,239 B1 5/2002 Carlson
6,394,935 B1 5/2002 Lake
6,394,936 B1 5/2002 Voris
6,394,938 B1 5/2002 Tornabene
6,397,797 B1 6/2002 Kolmanovsky et al.
6,398,695 B2 6/2002 Miller
6,402,666 B2 6/2002 Krull
6,409,632 B1 6/2002 Eschenbach
6,409,633 B1 6/2002 Abelbeck
6,413,196 B1 7/2002 Crowson
6,413,197 B2 7/2002 McKechnie et al.
6,416,442 B1 7/2002 Stearns et al.
6,416,444 B1 7/2002 Lim
6,416,446 B1 7/2002 Krull
6,416,447 B1 7/2002 Harmon
6,419,611 B1 7/2002 Levine et al.
6,422,976 B1 7/2002 Eschenbach

(56) References Cited

U.S. PATENT DOCUMENTS 6,422,977 B1 7/2002 Eschenbach
6,422,979 B1 7/2002 Krull
6,422,980 B1 7/2002 Simonson
6,422,981 B1 7/2002 Riser
6,422,983 B1 7/2002 Weck
6,427,805 B1 8/2002 Gibson et al.
6,428,449 B1 8/2002 Apseloff
6,428,450 B1 8/2002 Ho
6,430,997 B1 8/2002 French et al.
6,432,026 B1 8/2002 Wang
6,435,466 B1 8/2002 Adams
6,436,007 B1 8/2002 Eschenbach
6,436,008 B1 8/2002 Skowronski et al.
6,436,013 B1 8/2002 Krull
6,440,013 B1 8/2002 Brown
6,440,042 B2 8/2002 Eschenbach
6,440,045 B1 8/2002 Gaston
6,443,521 B1 9/2002 Nye et al.
6,443,875 B1 9/2002 Golen, Jr. et al.
6,443,877 B1 9/2002 Hoecht
6,443,878 B1 9/2002 Webber
6,447,424 B1 9/2002 Ashby et al.
6,447,430 B1 9/2002 Webb et al.
6,447,432 B1 9/2002 Krull
6,450,284 B1 9/2002 Sakyo et al.
6,450,922 B1 9/2002 Henderson et al.
6,450,923 B1 9/2002 Vatti
6,450,925 B1 9/2002 Kuo
6,450,928 B1 9/2002 Larkins, Jr.
6,454,050 B2 9/2002 Gibson et al.
6,454,679 B1 9/2002 Radow
6,454,682 B1 9/2002 Kuo
6,455,960 B1 9/2002 Trago et al.
6,458,060 B1 10/2002 Watterson et al.
6,458,061 B2 10/2002 Simonson
6,461,275 B1 10/2002 Wang et al.
6,461,279 B1 10/2002 Kuo
6,461,284 B1 10/2002 Francavilla
6,466,460 B1 10/2002 Rein et al.
6,468,189 B2 10/2002 Alessandri
6,471,622 B1 10/2002 Hammer et al.
6,471,624 B1 10/2002 Voris
6,474,193 B1 11/2002 Farney
6,475,121 B2 11/2002 Wang
6,475,122 B2 11/2002 Wu
6,478,721 B1 11/2002 Hunter
6,482,128 B1 11/2002 Michalow
6,482,130 B1 11/2002 Pasero et al.
6,482,132 B2 11/2002 Eschenbach
6,482,134 B1 11/2002 Rasmussen
6,482,139 B1 11/2002 Haag
6,485,397 B1 11/2002 Manderbacka
6,488,020 B1 12/2002 Rosas-Magallan
6,488,599 B2 12/2002 Nye
6,488,612 B2 12/2002 Sechrest et al.
6,491,268 B1 12/2002 Channer et al.
6,491,609 B2 12/2002 Webber
6,491,610 B1 12/2002 Henn
6,494,814 B1 12/2002 Wang
6,494,817 B2 12/2002 Lake
6,500,097 B1 12/2002 Hall
6,500,101 B1 12/2002 Chen
6,500,102 B1 12/2002 Domenge
6,503,173 B2 1/2003 Clem
6,505,503 B1 1/2003 Teresi et al.
6,506,142 B2 1/2003 Itoh et al.
6,510,760 B2 1/2003 Matsuo
6,513,532 B2 2/2003 Mault et al.
6,513,669 B2 2/2003 Ozawa et al.
6,514,180 B1 2/2003 Rawls
6,515,182 B2 2/2003 Hosokawa et al.
6,520,531 B1 2/2003 Gien
6,520,891 B1 2/2003 Stephens, Jr.
6,524,226 B2 2/2003 Kushner
6,527,674 B1 3/2003 Clem
6,527,678 B1 3/2003 Wang
6,527,683 B2 3/2003 Tolles
6,527,685 B2 3/2003 Endelman et al.
6,527,796 B1 3/2003 Magovern
6,530,864 B1 3/2003 Parks
6,533,707 B2 * 3/2003 Wang ..... A63B 22/0235 482/54
6,537,184 B2 3/2003 Kim
6,537,185 B1 3/2003 Hur
6,539,931 B2 4/2003 Trajkovic et al.
6,540,650 B1 4/2003 Krull
6,540,651 B1 4/2003 Aberton et al.
6,543,247 B2 4/2003 Strauss
6,544,146 B1 4/2003 Stearns et al.
6,547,701 B1 4/2003 Eschenbach
6,547,702 B1 4/2003 Heidecke
6,551,217 B2 4/2003 Kaganovsky
6,551,218 B2 4/2003 Goh
6,551,220 B1 4/2003 Schroeder
6,551,223 B2 4/2003 Cheng
6,551,226 B1 4/2003 Webber et al.
6,554,749 B2 4/2003 Iund et al.
6,558,299 B1 5/2003 Slattery
6,558,300 B2 5/2003 Deola
6,558,301 B1 5/2003 Jackson
6,558,302 B2 5/2003 Cluff
6,561,955 B1 5/2003 Dreissigacker et al.
6,561,956 B1 5/2003 Allison
6,561,960 B2 5/2003 Webber
6,563,489 B1 5/2003 Latypov et al.
6,569,061 B2 5/2003 Stearns et al.
6,569,062 B2 5/2003 Wang
6,572,511 B1 6/2003 Volpe
6,572,512 B2 6/2003 Anderson et al.
6,572,513 B1 6/2003 Whan-Tong et al.
6,575,878 B1 6/2003 Choy
6,575,882 B2 6/2003 Chen
6,575,885 B1 6/2003 Weck et al.
6,579,210 B1 6/2003 Stearns et al.
6,579,211 B2 6/2003 Wu
6,579,213 B1 6/2003 Webber et al.
6,579,214 B2 6/2003 Crump
6,582,342 B2 6/2003 Kaufman
6,582,344 B2 6/2003 Tang
6,582,345 B2 6/2003 Roy
6,585,624 B1 7/2003 Chen
6,585,626 B2 7/2003 McBride
6,589,138 B2 7/2003 Dyer et al.
6,592,498 B1 7/2003 Trainor
6,592,499 B2 7/2003 Parker
6,592,502 B1 7/2003 Phillips
6,595,905 B2 7/2003 McBride
6,599,223 B2 7/2003 Wang
6,601,016 B1 7/2003 Brown et al.
6,601,358 B2 8/2003 Panatta
6,601,825 B2 8/2003 Bressner et al.
6,604,008 B2 8/2003 Chudley et al.
6,605,020 B1 8/2003 Huang
6,605,024 B2 8/2003 Stearns
6,607,472 B2 8/2003 Toole
6,609,478 B2 8/2003 Del Valle
6,610,063 B2 8/2003 Kumar et al.
6,612,170 B2 9/2003 Brown
6,612,969 B2 9/2003 Eschenbach
6,612,971 B1 9/2003 Morris
6,619,681 B2 9/2003 Gutierrez
6,620,079 B2 9/2003 Kuo
6,623,407 B2 9/2003 Novak
6,623,409 B1 9/2003 Abelbeck
6,626,799 B2 9/2003 Watterson et al.
6,626,802 B1 9/2003 Rodgers, Jr.
6,626,803 B1 9/2003 Oglesby et al.
6,629,902 B2 10/2003 Murphy et al.
6,629,908 B2 10/2003 Hamady
6,629,909 B1 10/2003 Stearns et al.
6,629,910 B1 10/2003 Krull
6,632,160 B2 10/2003 LaFond et al.
6,632,161 B1 10/2003 Nir
6,634,996 B2 10/2003 Jacobsen

(56) References Cited

U.S. PATENT DOCUMENTS

| | | | |
|---|---|---|---|
| 6,634,997 | B2 | 10/2003 | Breibart et al. |
| 6,634,998 | B2 | 10/2003 | Siaperas |
| 6,637,811 | B2 | 10/2003 | Zheng |
| 6,637,818 | B2 | 10/2003 | Williams |
| 6,645,125 | B1 | 11/2003 | Stearns et al. |
| 6,645,126 | B1 | 11/2003 | Martin et al. |
| 6,645,129 | B2 | 11/2003 | Eschenbach |
| 6,645,130 | B2 | 11/2003 | Webber |
| 6,648,800 | B2 | 11/2003 | Stearns et al. |
| 6,648,801 | B2 | 11/2003 | Stearns et al. |
| 6,648,802 | B2 | 11/2003 | Ware |
| 6,652,419 | B1 | 11/2003 | Rota |
| 6,652,424 | B2 | 11/2003 | Dalebout |
| 6,652,425 | B1 | 11/2003 | Martin et al. |
| 6,652,426 | B2 | 11/2003 | Carter |
| 6,652,429 | B2 | 11/2003 | Bushnell |
| 6,652,431 | B1 | 11/2003 | Mattox |
| 6,652,432 | B2 | 11/2003 | Smith |
| 6,656,093 | B2 | 12/2003 | Chen |
| 6,660,949 | B2 | 12/2003 | Kamino et al. |
| 6,661,136 | B1 | 12/2003 | Lee |
| 6,662,651 | B1 | 12/2003 | Roth |
| 6,663,127 | B2 | 12/2003 | Miller |
| 6,663,498 | B2 | 12/2003 | Stipan |
| 6,663,500 | B2 | 12/2003 | Huang |
| 6,666,796 | B1 | 12/2003 | MacCready, Jr. |
| 6,666,800 | B2 | 12/2003 | Krull |
| 6,666,801 | B1 | 12/2003 | Michalow |
| 6,668,678 | B1 | 12/2003 | Baba et al. |
| 6,669,600 | B2 | 12/2003 | Warner |
| 6,669,606 | B2 | 12/2003 | Krull |
| 6,669,607 | B2 | 12/2003 | Slawinski et al. |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,572 | B2 | 1/2004 | Wang |
| 6,676,573 | B2 | 1/2004 | Abelbeck et al. |
| 6,676,577 | B2 | 1/2004 | Stearns |
| 6,676,579 | B1 | 1/2004 | Lin |
| 6,679,816 | B1 | 1/2004 | Krull |
| 6,679,820 | B2 | 1/2004 | Barkus et al. |
| 6,681,704 | B1 | 1/2004 | Brookhiser |
| 6,681,728 | B2 | 1/2004 | Haghgooie |
| 6,682,460 | B2 | 1/2004 | Lo |
| 6,682,461 | B2 | 1/2004 | Wang |
| 6,685,169 | B2 | 2/2004 | Shim |
| 6,685,600 | B1 | 2/2004 | Ullman |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,689,019 | B2 | 2/2004 | Ohrt et al. |
| 6,689,020 | B2 | 2/2004 | Stearns |
| 6,689,023 | B2 | 2/2004 | Baumler |
| 6,689,025 | B2 | 2/2004 | Emick |
| 6,689,075 | B2 | 2/2004 | West |
| 6,691,839 | B1 | 2/2004 | El-Kassouf |
| 6,692,415 | B1 | 2/2004 | Winston |
| 6,692,417 | B2 | 2/2004 | Burrell |
| 6,695,620 | B1 | 2/2004 | Huang |
| 6,695,694 | B2 | 2/2004 | Ishikawa et al. |
| 6,698,110 | B1 | 3/2004 | Robbins |
| 6,699,146 | B1 | 3/2004 | Winter et al. |
| 6,699,159 | B2 | 3/2004 | Rouse |
| 6,699,161 | B1 | 3/2004 | Speas |
| 6,699,162 | B2 | 3/2004 | Chen |
| 6,702,719 | B1 | 3/2004 | Brown et al. |
| 6,702,723 | B2 | 3/2004 | Landfair |
| 6,702,726 | B2 | 3/2004 | Lin |
| 6,705,974 | B1 | 3/2004 | Tardif |
| 6,705,976 | B1 | 3/2004 | Piane, Jr. |
| 6,705,977 | B1 | 3/2004 | Ziak |
| 6,708,427 | B2 | 3/2004 | Sussmann et al. |
| 6,711,789 | B2 | 3/2004 | Ping |
| 6,712,737 | B1 | 3/2004 | Nusbaum |
| 6,712,740 | B2 | 3/2004 | Simonson |
| 6,716,142 | B2 | 4/2004 | Kuo |
| 6,716,144 | B1 | 4/2004 | Shifferaw |
| 6,719,667 | B2 | 4/2004 | Wong et al. |
| 6,719,669 | B1 | 4/2004 | Wang |
| 6,719,672 | B1 | 4/2004 | Ellis et al. |
| 6,719,674 | B2 | 4/2004 | Krull |
| 6,723,413 | B2 | 4/2004 | Walters |
| 6,726,600 | B2 | 4/2004 | Miller |
| 6,726,601 | B1 | 4/2004 | Beutel |
| 6,726,602 | B2 | 4/2004 | Chang |
| 6,730,002 | B2 | 5/2004 | Hald et al. |
| 6,733,423 | B1 | 5/2004 | Chang |
| 6,733,424 | B2 | 5/2004 | Krull |
| 6,736,360 | B1 | 5/2004 | Buczek |
| 6,736,759 | B1 | 5/2004 | Stubbs et al. |
| 6,736,765 | B2 | 5/2004 | Wallace et al. |
| 6,736,766 | B1 | 5/2004 | Gallant |
| 6,738,274 | B2 | 5/2004 | Prasad et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,746,370 | B1 | 6/2004 | Fleming et al. |
| 6,746,371 | B1 | 6/2004 | Brown et al. |
| 6,746,380 | B2 | 6/2004 | Lien et al. |
| 6,746,381 | B2 | 6/2004 | Krull |
| 6,747,427 | B1 | 6/2004 | Carson |
| 6,749,537 | B1 | 6/2004 | Hickman |
| 6,749,540 | B1 | 6/2004 | Pasero et al. |
| 6,749,542 | B2 | 6/2004 | Wu |
| 6,749,547 | B2 | 6/2004 | Krull |
| 6,752,745 | B1 | 6/2004 | Davis |
| 6,755,770 | B2 | 6/2004 | Martens |
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,667 | B1 | 7/2004 | Cutler et al. |
| 6,761,672 | B1 | 7/2004 | Williams |
| 6,764,429 | B1 | 7/2004 | Michalow |
| 6,764,430 | B1 | 7/2004 | Fencel |
| 6,764,431 | B2 | 7/2004 | Yoss |
| 6,764,432 | B2 | 7/2004 | Hippensteel |
| 6,765,726 | B2 | 7/2004 | French et al. |
| 6,767,314 | B2 | 7/2004 | Thompson |
| 6,770,014 | B2 | 8/2004 | Amore |
| 6,770,015 | B2 | 8/2004 | Simonson |
| 6,776,740 | B1 | 8/2004 | Anderson et al. |
| 6,778,938 | B1 | 8/2004 | Ng et al. |
| 6,783,134 | B2 | 8/2004 | Geary |
| 6,783,482 | B2 | 8/2004 | Oglesby et al. |
| 6,786,821 | B2 | 9/2004 | Nobe et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,790,163 | B1 | 9/2004 | Van De Laarschot |
| 6,793,607 | B2 | 9/2004 | Neil |
| 6,793,609 | B1 | 9/2004 | Fan |
| 6,796,159 | B2 | 9/2004 | Kelm et al. |
| 6,796,925 | B2 | 9/2004 | Martinez et al. |
| 6,796,927 | B2 | 9/2004 | Toyama |
| 6,800,050 | B2 | 10/2004 | Moavro |
| 6,802,800 | B1 | 10/2004 | Hobson |
| 6,807,869 | B2 | 10/2004 | Farringdon et al. |
| 6,808,458 | B1 | 10/2004 | Jung |
| 6,808,475 | B2 | 10/2004 | Kehrbaum |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,821,230 | B2 | 11/2004 | Dalebout et al. |
| 6,824,210 | B2 | 11/2004 | Zheng |
| 6,824,502 | B1 | 11/2004 | Huang |
| 6,827,822 | B2 | 12/2004 | Tao et al. |
| 6,830,540 | B2 | 12/2004 | Watterson et al. |
| 6,830,541 | B2 | 12/2004 | Wu |

(56) References Cited

U.S. PATENT DOCUMENTS 6,830,542 B2 12/2004 Ball
6,835,166 B1 12/2004 Stearns et al.
6,837,829 B2 1/2005 Eschenbach
6,837,830 B2 1/2005 Eldridge
6,837,838 B2 1/2005 List
6,840,892 B1 1/2005 Wu
6,842,928 B2 1/2005 Yang et al.
6,843,732 B1 1/2005 Huang
6,843,757 B2 1/2005 Pan et al.
6,846,270 B1 1/2005 Etnyre
6,846,272 B2 1/2005 Rosenow et al.
6,849,032 B2 2/2005 Chu
6,852,068 B2 2/2005 Ogawa
6,852,069 B2 2/2005 Park
6,855,093 B2 2/2005 Anderson et al.
6,855,097 B2 2/2005 Krull
6,857,993 B2 2/2005 Yeh
6,860,131 B2 3/2005 Armstrong et al.
6,860,836 B1 3/2005 Wu
6,860,839 B1 3/2005 Dice
6,860,841 B1 3/2005 Mortorano
6,866,141 B2 3/2005 Saeki
6,872,168 B2 3/2005 Wang et al.
6,872,173 B2 3/2005 Krull
6,872,175 B2 3/2005 Lin
6,875,157 B1 4/2005 Wang
6,875,160 B2 4/2005 Watterson et al.
6,878,099 B2 4/2005 Corbalis et al.
6,878,101 B2 4/2005 Colley
6,880,416 B2 4/2005 Koch
6,880,487 B2 4/2005 Reinkensmeyer et al.
6,881,176 B2 4/2005 Oishi et al.
6,886,645 B2 5/2005 Bise et al.
6,887,185 B1 5/2005 Kuo
6,887,190 B1 5/2005 Azari
6,893,381 B2 5/2005 Slawinski
6,893,383 B1 5/2005 Chang et al.
6,896,342 B1 5/2005 Cheng
6,896,645 B1 5/2005 Krull
6,899,657 B2 5/2005 Chuang
6,899,659 B2 5/2005 Anderson et al.
6,899,661 B1 5/2005 Krull
6,902,513 B1 6/2005 Mcclure
6,902,515 B2 6/2005 Howell et al.
6,902,516 B2 6/2005 Krull
6,905,446 B2 6/2005 Greenland
6,908,416 B2 6/2005 Mercado et al.
6,908,417 B2 6/2005 Jackson
6,908,418 B2 6/2005 Saure
6,910,991 B2 6/2005 Matsumoto
6,910,992 B2 6/2005 Arguilez
6,913,562 B2 7/2005 Chen
6,913,563 B2 7/2005 Chen
6,916,278 B2 7/2005 Webber
6,918,858 B2 7/2005 Watterson et al.
6,918,859 B1 7/2005 Yeh
6,918,860 B1 7/2005 Nusbaum
6,918,861 B2 7/2005 Liao et al.
6,920,947 B2 7/2005 Kamen et al.
6,921,354 B1 7/2005 Shifferaw
6,921,355 B2 7/2005 Campanaro et al.
6,923,746 B1 8/2005 Skowronski et al.
6,923,747 B1 8/2005 Chu
6,923,748 B1 8/2005 Mauz
6,923,749 B1 8/2005 Smith
6,926,644 B2 8/2005 Chen
6,926,646 B1 8/2005 Nguyen
6,926,649 B2 8/2005 Slawinski
6,929,589 B1 8/2005 Bruggemann et al.
6,932,745 B1 8/2005 Ellis
6,932,748 B2 8/2005 Huang
6,932,749 B2 * 8/2005 Barnes ..... A63B 21/00072 482/130
6,939,271 B1 9/2005 Whan-Tong et al.
6,941,620 B1 9/2005 Hinds
6,944,294 B2 9/2005 Tsay
6,945,912 B2 9/2005 Levi
6,945,916 B2 9/2005 Schroeder
6,945,917 B1 9/2005 Baatz
6,949,052 B2 9/2005 Millington
6,949,053 B1 9/2005 Stearns
6,949,054 B1 9/2005 Stearns
6,953,418 B1 10/2005 Chen
6,953,424 B2 10/2005 Kusumoto et al.
6,960,156 B2 11/2005 Smith
6,964,632 B1 11/2005 Ko
6,964,633 B2 11/2005 Kolda
6,966,872 B2 11/2005 Eschenbach
6,971,974 B2 12/2005 Bowman
6,971,975 B2 12/2005 Croft
6,971,978 B2 12/2005 Hyder
6,974,404 B1 12/2005 Watterson et al.
6,974,405 B2 12/2005 Krull
6,976,698 B2 12/2005 Kuiken
6,976,941 B2 12/2005 Britt
6,976,943 B1 12/2005 Hsiung
6,979,283 B2 12/2005 Pan
6,991,588 B1 1/2006 Adams
6,993,270 B2 1/2006 Yoshioka et al.
6,994,306 B1 2/2006 Sweere et al.
6,994,657 B1 2/2006 Eschenbach
6,994,683 B1 2/2006 Starr
6,997,852 B2 2/2006 Watterson et al.
6,997,856 B1 2/2006 Krull
7,001,288 B2 2/2006 Harrell
7,003,122 B2 2/2006 Chen
7,003,828 B2 2/2006 Roussy
7,004,271 B1 2/2006 Kamen et al.
7,004,887 B2 2/2006 Pan et al.
7,004,888 B1 2/2006 Weng
7,004,895 B2 2/2006 Perry
7,008,352 B2 3/2006 Grossi
7,008,356 B2 3/2006 Hung
7,008,359 B2 3/2006 Fan et al.
7,009,613 B2 3/2006 Goden
7,011,326 B1 3/2006 Schroeder et al.
7,011,607 B2 3/2006 Kolda et al.
7,011,609 B1 3/2006 Kuo
7,011,610 B2 3/2006 Wawrzyniak
7,011,611 B1 3/2006 Ripley
7,014,598 B2 3/2006 Fenelon et al.
7,014,599 B2 3/2006 Ashley
7,022,047 B2 4/2006 Cohen et al.
7,022,048 B1 4/2006 Fernandez
7,022,049 B2 4/2006 Ryan et al.
7,022,051 B2 4/2006 Ota
7,025,713 B2 4/2006 Dalebout
7,029,425 B2 4/2006 Krull
7,032,870 B2 4/2006 Sweere et al.
7,033,176 B2 4/2006 Feldman
7,033,269 B2 4/2006 Namba et al.
7,033,306 B2 4/2006 Graber
7,037,241 B2 5/2006 Kuo
7,037,246 B2 5/2006 Kim
7,039,263 B2 5/2006 Towle
7,041,034 B1 5/2006 Stearns et al.
7,041,038 B2 5/2006 Smith
7,041,041 B1 5/2006 Evans
7,044,066 B1 5/2006 Miller
7,044,891 B1 5/2006 Rivera
7,044,897 B2 5/2006 Myers et al.
7,047,817 B2 5/2006 Lanham
7,048,638 B2 5/2006 Novotny
7,048,677 B2 5/2006 Mackert
7,052,426 B2 5/2006 Battat et al.
7,052,440 B2 5/2006 Pyles et al.
7,052,442 B2 5/2006 Watterson
7,052,444 B2 5/2006 Webber
7,052,446 B2 5/2006 Morris et al.
7,055,899 B2 6/2006 Zhurong et al.
7,060,005 B2 6/2006 Carlsen et al.
7,060,006 B1 6/2006 Watterson et al.
7,060,007 B2 6/2006 Juva
7,060,008 B2 6/2006 Watterson et al.

(56) References Cited

U.S. PATENT DOCUMENTS

| | | | |
|---|---|---|---|
| 7,060,011 | B1 | 6/2006 | Krull |
| 7,060,012 | B2 | 6/2006 | Howell et al. |
| 7,066,867 | B2 | 6/2006 | Krull |
| 7,070,415 | B2 | 7/2006 | Hojo et al. |
| 7,070,542 | B2 | 7/2006 | Reyes et al. |
| 7,070,545 | B2 | 7/2006 | Lull et al. |
| 7,073,417 | B2 | 7/2006 | Beauchamp |
| 7,073,852 | B1 | 7/2006 | Zheng |
| 7,077,788 | B2 | 7/2006 | Chang |
| 7,077,791 | B2 | 7/2006 | Krull |
| 7,081,069 | B2 | 7/2006 | Hsu |
| 7,081,073 | B1 | 7/2006 | Smith |
| 7,082,703 | B2 | 8/2006 | Greene et al. |
| 7,083,536 | B2 | 8/2006 | Lu et al. |
| 7,083,546 | B2 | 8/2006 | Zillig |
| 7,083,549 | B1 | 8/2006 | Fan |
| 7,083,554 | B1 | 8/2006 | Lo Presti |
| 7,083,582 | B2 | 8/2006 | Chen |
| 7,086,994 | B2 | 8/2006 | Turak et al. |
| 7,086,995 | B2 | 8/2006 | Reyes |
| 7,086,999 | B2 | 8/2006 | Jeneve et al. |
| 7,087,000 | B1 | 8/2006 | Walker |
| 7,087,003 | B1 | 8/2006 | Katterjohn |
| 7,087,005 | B2 | 8/2006 | Rouillard |
| 7,090,621 | B2 | 8/2006 | Loane |
| 7,090,622 | B2 | 8/2006 | Hetrick |
| 7,090,625 | B2 | 8/2006 | Chermack |
| 7,094,183 | B2 | 8/2006 | Hsieh |
| 7,094,184 | B1 | 8/2006 | Chen et al. |
| 7,094,185 | B2 | 8/2006 | Greenland |
| 7,097,591 | B2 | 8/2006 | Moon |
| 7,097,593 | B2 | 8/2006 | Chang |
| 7,097,601 | B1 | 8/2006 | Ronnow |
| 7,100,517 | B1 | 9/2006 | Godwin |
| 7,101,124 | B2 | 9/2006 | Keightley |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,930 | B2 | 9/2006 | Lo et al. |
| 7,104,937 | B2 | 9/2006 | Arbuckle |
| 7,108,636 | B1 | 9/2006 | Garcia |
| 7,108,641 | B2 | 9/2006 | Pertegaz-Esteban |
| 7,108,659 | B2 | 9/2006 | Ross et al. |
| 7,111,526 | B1 | 9/2006 | Flojo |
| 7,112,163 | B2 | 9/2006 | Krull |
| 7,113,166 | B1 | 9/2006 | Rosenberg et al. |
| 10,949,271 | | 9/2006 | Maresh et al. |
| 7,115,073 | B2 | 10/2006 | Nizamuddin |
| 7,115,078 | B1 | 10/2006 | Kalember et al. |
| 7,115,080 | B2 | 10/2006 | Cockrill, Jr. et al. |
| 7,118,517 | B1 | 10/2006 | Hale |
| 7,121,980 | B2 | 10/2006 | Chen |
| 7,121,988 | B2 | 10/2006 | Walkerdine |
| 7,125,371 | B2 | 10/2006 | Henderson |
| 7,125,373 | B1 | 10/2006 | Garza |
| 7,128,696 | B1 | 10/2006 | Krull |
| 7,128,697 | B1 | 10/2006 | Krull |
| 7,128,701 | B1 | 10/2006 | Ketcham |
| 7,132,939 | B2 | 11/2006 | Tyndall et al. |
| 7,134,987 | B2 | 11/2006 | Goldstein |
| 7,137,644 | B2 | 11/2006 | Kimberley |
| 7,137,931 | B2 | 11/2006 | Liu |
| 7,137,932 | B2 | 11/2006 | Doudiet |
| 7,137,935 | B2 | 11/2006 | Clarke |
| 7,137,936 | B1 | 11/2006 | Shaw |
| 7,140,487 | B2 | 11/2006 | Motoda |
| 7,140,626 | B1 | 11/2006 | Keay |
| 7,141,003 | B2 | 11/2006 | Wu |
| 7,141,005 | B2 | 11/2006 | Wu |
| 7,141,008 | B2 | 11/2006 | Krull et al. |
| 7,147,591 | B2 | 12/2006 | McAvoy |
| 7,150,168 | B1 | 12/2006 | Kuo |
| 7,153,244 | B2 | 12/2006 | Towley |
| 7,153,248 | B2 | 12/2006 | Chen |
| 7,156,776 | B2 | 1/2007 | Maser |
| 7,156,782 | B1 | 1/2007 | Krull |
| 7,156,783 | B2 | 1/2007 | Chen |
| 7,163,488 | B2 | 1/2007 | Anders |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,066 | B2 | 1/2007 | Webber |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,169,093 | B2 | 1/2007 | Simonson et al. |
| 7,172,531 | B2 | 2/2007 | Rodgers, Jr. |
| 7,172,536 | B2 | 2/2007 | Liu |
| 7,172,538 | B2 | 2/2007 | Keiser |
| 7,175,193 | B2 | 2/2007 | Wu |
| 7,178,637 | B2 | 2/2007 | Asano et al. |
| 7,179,204 | B2 | 2/2007 | Anderson et al. |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,179,212 | B2 | 2/2007 | Hsiung et al. |
| 7,186,189 | B2 | 3/2007 | Huang |
| 7,188,439 | B2 | 3/2007 | DiBenedetto et al. |
| 7,189,190 | B2 | 3/2007 | Lamar et al. |
| 7,189,791 | B2 | 3/2007 | Solan |
| 7,192,387 | B2 | 3/2007 | Mendel |
| 7,192,388 | B2 | 3/2007 | Dalebout et al. |
| 7,192,389 | B2 | 3/2007 | Allison |
| 7,195,568 | B2 | 3/2007 | Huang |
| 7,196,491 | B2 | 3/2007 | Mayhew et al. |
| 7,197,029 | B1 | 3/2007 | Osterhout et al. |
| 7,201,705 | B2 | 4/2007 | Rodgers, Jr. |
| 7,201,707 | B1 | 4/2007 | Moon |
| 7,201,712 | B2 | 4/2007 | Tiahrt |
| 7,204,328 | B2 | 4/2007 | LoPresti |
| 7,204,790 | B2 | 4/2007 | Sleamaker |
| 7,207,929 | B2 | 4/2007 | Hamilton |
| 7,207,930 | B2 | 4/2007 | Bonutti |
| 7,211,029 | B2 | 5/2007 | Kau |
| 7,211,030 | B1 | 5/2007 | Cao |
| 7,214,167 | B2 | 5/2007 | Stearns |
| 7,214,170 | B2 | 5/2007 | Sumners |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,220 | B2 | 5/2007 | Stubbs |
| 7,220,221 | B2 | 5/2007 | Mosimann et al. |
| 7,223,209 | B2 | 5/2007 | Lee |
| 7,223,213 | B2 | 5/2007 | Golesh |
| 7,223,214 | B2 | 5/2007 | Chen |
| 7,223,215 | B2 | 5/2007 | Bastyr |
| 7,223,216 | B1 | 5/2007 | McBride |
| 7,225,694 | B2 | 6/2007 | Said |
| 7,226,402 | B1 | 6/2007 | Joya |
| 7,228,601 | B2 | 6/2007 | Thompson |
| 7,229,391 | B2 | 6/2007 | Francis |
| 7,232,404 | B2 | 6/2007 | Nelson |
| 7,234,200 | B2 | 6/2007 | Chase |
| 7,235,942 | B2 | 6/2007 | Nagaoka et al. |
| 7,238,143 | B1 | 7/2007 | Sokolovos |
| 7,238,147 | B2 | 7/2007 | Mills et al. |
| 7,244,217 | B2 | 7/2007 | Rodgers, Jr. |
| 7,247,128 | B2 | 7/2007 | Oga |
| 7,249,540 | B1 | 7/2007 | Hacker et al. |
| 7,250,021 | B2 | 7/2007 | Leight |
| 7,250,022 | B2 | 7/2007 | Dalebout |
| 7,255,665 | B2 | 8/2007 | Ish, III |
| 7,255,666 | B2 | 8/2007 | Cardenas |
| 7,257,468 | B1 | 8/2007 | Costa et al. |
| 7,258,039 | B2 | 8/2007 | Lin |
| 7,258,651 | B2 | 8/2007 | Clarke |
| 7,260,950 | B2 | 8/2007 | Choi et al. |
| 7,261,678 | B2 | 8/2007 | Crawford et al. |
| 7,264,554 | B2 | 9/2007 | Bentley |
| 7,264,578 | B1 | 9/2007 | Krull |

(56) References Cited

U.S. PATENT DOCUMENTS

| | | | |
|---|---|---|---|
| 7,269,038 | B2 | 9/2007 | Shekhawat |
| 7,270,628 | B2 | 9/2007 | Campanaro |
| 7,276,017 | B2 | 10/2007 | Lin |
| 7,276,018 | B2 | 10/2007 | Studdard |
| 7,278,934 | B2 | 10/2007 | McBride et al. |
| 7,278,955 | B2 | 10/2007 | Giannelli et al. |
| 7,278,958 | B2 | 10/2007 | Morgan |
| 7,278,966 | B2 | 10/2007 | Hjelt et al. |
| 7,279,868 | B2 | 10/2007 | Lanni |
| 7,282,016 | B2 | 10/2007 | Simonson |
| 7,284,466 | B1 | 10/2007 | Ho |
| 7,285,075 | B2 | 10/2007 | Cutler et al. |
| 7,287,770 | B2 | 10/2007 | Drabant et al. |
| 7,288,053 | B2 | 10/2007 | Endelman et al. |
| 7,290,760 | B1 | 11/2007 | Lindsay |
| 7,291,096 | B2 | 11/2007 | Ho |
| 7,291,098 | B1 | 11/2007 | Krull |
| 7,291,100 | B2 | 11/2007 | Dodge |
| 7,292,151 | B2 | 11/2007 | Ferguson |
| 7,293,510 | B1 | 11/2007 | Siao |
| 7,294,094 | B1 | 11/2007 | Howle |
| 7,294,095 | B2 | 11/2007 | Charnitski |
| 7,294,100 | B2 | 11/2007 | Bull |
| 7,299,720 | B1 | 11/2007 | Schultz et al. |
| 7,300,390 | B1 | 11/2007 | Krull |
| 7,300,392 | B1 | 11/2007 | Curran |
| 7,303,508 | B2 | 12/2007 | Toyama et al. |
| 7,303,510 | B2 | 12/2007 | Gebhardt |
| 7,309,303 | B1 | 12/2007 | Proctor |
| 7,311,640 | B2 | 12/2007 | Baatz |
| 7,311,644 | B2 | 12/2007 | Hale |
| 7,314,438 | B1 | 1/2008 | Clark et al. |
| 7,316,633 | B2 | 1/2008 | Liao et al. |
| 7,318,810 | B1 | 1/2008 | Benson |
| 7,319,457 | B2 | 1/2008 | Lin et al. |
| 7,322,219 | B2 | 1/2008 | Armstrong et al. |
| 7,322,653 | B2 | 1/2008 | Dragusin |
| 7,322,906 | B2 | 1/2008 | Webber |
| 7,322,907 | B2 | 1/2008 | Bowser |
| 7,322,909 | B1 | 1/2008 | Loccarini |
| 7,329,212 | B2 | 2/2008 | Roque |
| 7,331,227 | B2 | 2/2008 | Kang et al. |
| 7,331,908 | B2 | 2/2008 | Olsen |
| 7,331,911 | B2 | 2/2008 | Webber et al. |
| 7,334,350 | B2 | 2/2008 | Ellis, III |
| 7,335,135 | B2 | 2/2008 | Wang |
| 7,335,139 | B2 | 2/2008 | Bartholomew et al. |
| 7,335,140 | B2 | 2/2008 | Webber et al. |
| 7,335,141 | B2 | 2/2008 | Piane, Jr. |
| 7,335,142 | B2 | 2/2008 | Towley, III et al. |
| 7,335,147 | B2 | 2/2008 | Jones |
| 7,341,545 | B2 | 3/2008 | Cao |
| 7,344,481 | B2 | 3/2008 | Watterson et al. |
| 7,344,488 | B2 | 3/2008 | Weck et al. |
| 7,346,935 | B1 | 3/2008 | Patterson |
| 7,347,806 | B2 | 3/2008 | Nakano et al. |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,756 | B2 | 4/2008 | Demas |
| 7,357,758 | B2 | 4/2008 | Polk, III |
| 7,359,121 | B2 | 4/2008 | French et al. |
| 7,361,122 | B2 | 4/2008 | Porth |
| 7,361,123 | B1 | 4/2008 | Krull |
| 7,361,125 | B2 | 4/2008 | Webber et al. |
| 7,361,127 | B2 | 4/2008 | Tremayne |
| 7,362,016 | B2 | 4/2008 | Cheng |
| 7,364,538 | B2 | 4/2008 | Aucamp |
| 7,366,921 | B2 | 4/2008 | Ranganathan |
| 7,367,926 | B2 | 5/2008 | Clark |
| 7,367,927 | B2 | 5/2008 | Krull |
| 7,367,957 | B2 | 5/2008 | Huang et al. |
| 7,369,121 | B2 | 5/2008 | Lane |
| 7,370,498 | B1 | 5/2008 | Miao |
| 7,374,519 | B2 | 5/2008 | Naidus |
| 7,377,881 | B2 | 5/2008 | Moon |
| 7,377,882 | B2 | 5/2008 | Watterson |
| 7,377,886 | B2 | 5/2008 | Wu |
| 7,381,161 | B2 | 6/2008 | Ellis |
| 7,381,167 | B2 | 6/2008 | Duhamel |
| 7,384,013 | B2 | 6/2008 | Yen |
| 7,384,209 | B2 | 6/2008 | Muders et al. |
| 7,384,381 | B2 | 6/2008 | Webber et al. |
| 7,387,597 | B2 | 6/2008 | Krull |
| 7,387,867 | B2 | 6/2008 | Hasegawa et al. |
| 7,393,308 | B1 | 7/2008 | Huang |
| 7,396,319 | B1 | 7/2008 | Ellis |
| 7,402,145 | B1 | 7/2008 | Woggon |
| 7,404,232 | B2 | 7/2008 | Chase |
| 7,410,449 | B2 | 8/2008 | Yeh |
| 7,413,056 | B2 | 8/2008 | Gonzi et al. |
| 7,413,065 | B2 | 8/2008 | Gauthier |
| 7,413,530 | B2 | 8/2008 | Warner et al. |
| 7,413,532 | B1 | 8/2008 | Monsrud et al. |
| 7,413,533 | B2 | 8/2008 | Lin |
| 7,425,189 | B1 | 9/2008 | Eschenbach |
| 7,428,760 | B2 | 9/2008 | McCrimmon |
| 7,429,235 | B2 | 9/2008 | Lin |
| 7,429,236 | B2 | 9/2008 | Dalebout et al. |
| 7,432,677 | B2 | 10/2008 | Heydt et al. |
| 7,435,202 | B2 | 10/2008 | Daly et al. |
| 7,435,203 | B2 | 10/2008 | Anderson et al. |
| 7,435,205 | B2 | 10/2008 | Reyes et al. |
| 7,438,673 | B1 | 10/2008 | Jones |
| 7,448,823 | B2 | 11/2008 | Silva |
| 7,455,621 | B1 | 11/2008 | Anthony |
| 7,455,626 | B2 | 11/2008 | Trevino et al. |
| 7,455,628 | B1 | 11/2008 | Stearns |
| 7,455,633 | B2 | 11/2008 | Brown et al. |
| 7,461,825 | B2 | 12/2008 | Olivera |
| 7,462,135 | B2 | 12/2008 | Lo |
| 7,462,141 | B1 | 12/2008 | Raboin et al. |
| 7,468,025 | B2 | 12/2008 | Hauser et al. |
| 7,470,234 | B1 | 12/2008 | Elhag et al. |
| 7,473,211 | B2 | 1/2009 | Lee |
| 7,475,613 | B2 | 1/2009 | Bailey |
| 7,475,641 | B2 | 1/2009 | Jin |
| 7,475,900 | B2 | 1/2009 | Cheng |
| 7,476,182 | B2 | 1/2009 | Denisco |
| 7,476,186 | B1 | 1/2009 | Steffee |
| 7,478,794 | B1 | 1/2009 | Gohlke et al. |
| 7,482,050 | B2 | 1/2009 | Olson |
| 7,485,076 | B2 | 2/2009 | Lee |
| 7,485,077 | B2 | 2/2009 | Chen |
| 7,485,079 | B2 | 2/2009 | Brown et al. |
| 7,488,277 | B1 | 2/2009 | Knapp |
| 7,491,154 | B2 | 2/2009 | Yonehana et al. |
| 7,491,155 | B2 | 2/2009 | Fenelon et al. |
| 7,491,157 | B1 | 2/2009 | Lin |
| 7,491,159 | B2 | 2/2009 | Patterson |
| 7,494,450 | B2 | 2/2009 | Solomon |
| 7,494,454 | B2 | 2/2009 | Sheets |
| 7,497,784 | B2 | 3/2009 | Henry |
| 7,497,806 | B2 | 3/2009 | Duncan et al. |
| 7,497,814 | B1 | 3/2009 | Krull |
| 7,503,883 | B2 | 3/2009 | Madden |
| 7,507,183 | B2 | 3/2009 | Anderson |
| 7,507,186 | B2 | 3/2009 | Stearns |
| 7,507,187 | B2 | 3/2009 | Dyer et al. |
| 7,507,189 | B2 | 3/2009 | Krull |
| 7,510,508 | B2 | 3/2009 | Santomassimo et al. |
| 7,510,511 | B2 | 3/2009 | Von Detten |
| 7,511,710 | B2 | 3/2009 | Barrett |
| 7,517,303 | B2 | 4/2009 | Crawford et al. |
| 7,517,304 | B1 | 4/2009 | Swanson et al. |
| 7,520,840 | B2 | 4/2009 | Shifferaw |
| 7,520,845 | B2 | 4/2009 | Towley, III et al. |
| 7,524,272 | B2 | 4/2009 | Bruck et al. |
| 7,525,293 | B1 | 4/2009 | Notohamiprodjo et al. |
| 7,534,200 | B1 | 5/2009 | Martinez |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,551 | B2 | 5/2009 | Steffee |

(56) References Cited

U.S. PATENT DOCUMENTS 7,537,552 B2 5/2009 Dalebout et al.
7,540,828 B2 6/2009 Watterson et al.
7,540,829 B1 6/2009 Lin
7,540,832 B2 6/2009 Krull
7,542,040 B2 6/2009 Templeman
7,544,153 B2 6/2009 Trevino et al.
7,547,255 B2 6/2009 Lochtefeld et al.
7,549,938 B2 6/2009 Leighton et al.
7,549,947 B2 6/2009 Hickman et al.
7,549,949 B2 6/2009 Webber et al.
7,553,260 B2 6/2009 Piaget et al.
7,553,262 B2 6/2009 Piane, Jr.
7,553,264 B2 6/2009 Carter
7,553,267 B1 6/2009 Hauser
7,556,590 B2 7/2009 Watterson et al.
7,556,591 B2 7/2009 Chuang
7,559,879 B2 7/2009 Anderson et al.
7,563,203 B2 7/2009 Dalebout et al.
7,563,205 B2 7/2009 Alling
7,563,208 B1 7/2009 Chen
7,563,209 B2 7/2009 Webber et al.
7,563,213 B2 7/2009 Grant
7,563,214 B2 7/2009 Webber et al.
7,563,235 B2 7/2009 Der Meer
7,569,000 B2 8/2009 Wang
7,569,004 B2 8/2009 Kolomeir
7,569,005 B2 8/2009 Geeting
7,571,517 B2 8/2009 Smith et al.
7,572,206 B2 8/2009 Wilkins et al.
7,575,537 B2 8/2009 Ellis
7,575,538 B1 8/2009 Clark
7,578,771 B1 8/2009 Towley, III et al.
7,578,772 B2 8/2009 Lippitt
7,584,673 B2 9/2009 Shimizu
7,585,251 B2 9/2009 Doody, Jr. et al.
7,585,254 B1 9/2009 Vittone
7,585,258 B2 9/2009 Watson et al.
7,585,262 B1 9/2009 Vayntraub
7,585,263 B2 9/2009 Brown et al.
7,588,520 B2 9/2009 Nalley
7,591,763 B1 9/2009 Fucci
7,591,770 B2 9/2009 Stewart et al.
7,591,773 B2 9/2009 Weir
7,591,795 B2 9/2009 Whalen et al.
7,594,873 B2 9/2009 Terao et al.
7,594,877 B2 9/2009 Anderson et al.
7,594,878 B1 9/2009 Joannou
7,594,880 B2 9/2009 Webber
7,594,881 B2 9/2009 Shifferaw
7,597,656 B2 10/2009 Trees
7,601,101 B2 10/2009 Jackson et al.
7,601,105 B1 10/2009 Gipson, III et al.
7,601,187 B2 10/2009 Webber
7,602,301 B1 10/2009 Stirling et al.
7,604,571 B2 10/2009 Wilkins et al.
7,604,572 B2 10/2009 Stanford
7,604,573 B2 10/2009 Dalebout et al.
7,604,576 B2 10/2009 Drechsler
7,604,577 B2 10/2009 Lin
7,604,578 B2 10/2009 Liu
7,608,015 B2 10/2009 Radow
7,608,020 B2 10/2009 Mason
7,608,021 B1 10/2009 Nalley
7,608,023 B2 10/2009 Casagrande
7,608,024 B2 10/2009 Sechrest et al.
7,608,028 B2 10/2009 Pertegaz-Esteban
7,611,445 B2 11/2009 Brown et al.
7,611,448 B2 11/2009 Schiff
7,611,450 B2 11/2009 Mancini
7,614,639 B2 11/2009 Tholkes et al.
7,614,981 B2 11/2009 Cao
7,614,984 B1 11/2009 Krull
7,614,991 B2 11/2009 Fox
7,618,345 B2 11/2009 Corbalis et al.
7,618,346 B2 11/2009 Crawford et al.
7,621,847 B2 11/2009 Lamle
7,621,850 B2 11/2009 Piaget et al.
7,621,855 B1 11/2009 Krull
7,621,856 B1 11/2009 Keith
7,621,858 B2 11/2009 Sheron
7,624,956 B2 12/2009 Steigert et al.
7,624,967 B1 12/2009 Doebler et al.
7,625,033 B2 12/2009 Michelau et al.
7,625,314 B2 12/2009 Ungari
7,625,315 B2 12/2009 Hickman
7,625,319 B2 12/2009 Kang et al.
7,625,321 B2 12/2009 Simonson et al.
7,625,322 B1 12/2009 Krull
7,625,323 B1 12/2009 Lin
7,628,730 B1 12/2009 Watterson et al.
7,628,732 B1 12/2009 Porszasz et al.
7,628,733 B2 12/2009 Donner
7,628,737 B2 12/2009 Kowallis et al.
7,628,743 B1 12/2009 Flentye et al.
7,630,201 B2 12/2009 Asahi
7,632,221 B1 12/2009 Kolander
7,637,847 B1 12/2009 Hickman
7,637,850 B2 12/2009 Lin
7,637,855 B2 12/2009 Bizzell
7,639,520 B1 12/2009 Zansky et al.
7,641,598 B2 1/2010 Rodgers, Jr.
7,645,212 B2 1/2010 Ashby et al.
7,645,214 B2 1/2010 Lull
7,645,215 B2 1/2010 Gordon
7,645,216 B2 1/2010 Edeker
7,645,218 B2 1/2010 Potok et al.
7,645,221 B1 1/2010 Curry
7,647,196 B2 1/2010 Kahn et al.
7,648,441 B2 1/2010 Silk
7,648,443 B2 1/2010 Schenk
7,648,446 B2 1/2010 Chiles et al.
7,650,987 B2 1/2010 Taniguchi et al.
7,651,442 B2 1/2010 Carlson
7,651,450 B2 1/2010 Wehrell
7,654,229 B2 2/2010 Smith
7,654,938 B2 2/2010 Webber et al.
7,654,940 B2 2/2010 Webber et al.
7,654,941 B2 2/2010 Lacher
7,658,694 B2 2/2010 Ungari
7,658,695 B1 2/2010 Amsbury et al.
7,658,698 B2 2/2010 Pacheco et al.
7,662,075 B2 2/2010 Isom
7,665,794 B2 2/2010 Kachouh
7,666,123 B2 2/2010 Giannelli
7,670,263 B2 3/2010 Ellis
7,670,269 B2 3/2010 Webber et al.
7,670,270 B2 3/2010 Alessandri et al.
7,674,185 B2 3/2010 Omidi
7,674,205 B2 3/2010 Dalebout et al.
7,674,206 B2 3/2010 Jones
7,674,216 B1 3/2010 Bolling
7,677,518 B2 3/2010 Chouinard et al.
7,678,033 B2 3/2010 Tyree
7,682,286 B2 3/2010 Badarneh et al.
7,682,287 B1 3/2010 Hsieh
7,682,290 B2 3/2010 Liao et al.
7,682,291 B2 3/2010 Gill et al.
7,686,742 B2 3/2010 Tischler
7,690,317 B2 4/2010 Beck et al.
7,690,556 B1 4/2010 Kahn et al.
7,691,031 B2 4/2010 Toyama et al.
7,691,033 B2 4/2010 Rolli
7,691,041 B2 4/2010 Abdo
7,691,042 B2 4/2010 Pandozy
7,691,069 B2 4/2010 Adams
7,695,406 B2 4/2010 Waters
7,695,409 B2 4/2010 Helie et al.
7,695,411 B2 * 4/2010 Pandozy ..... A63B 21/068 482/62
7,695,414 B2 4/2010 Tiahrt
7,704,191 B2 4/2010 Smith et al.
7,704,192 B2 4/2010 Dyer et al.
7,704,195 B2 4/2010 Alessandri et al.
7,704,197 B2 4/2010 Yu

(56) References Cited

U.S. PATENT DOCUMENTS

| | | | |
|---|---|---|---|
| 7,704,199 | B2 | 4/2010 | Koch |
| 7,706,547 | B2 | 4/2010 | Luo |
| 7,708,668 | B2 | 5/2010 | Rodgers, Jr. |
| 7,708,670 | B2 | 5/2010 | Bowser |
| 7,708,672 | B2 | 5/2010 | Gibson et al. |
| 7,713,172 | B2 | 5/2010 | Watterson et al. |
| 7,713,177 | B2 | 5/2010 | Lo |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,829 | B2 | 5/2010 | Wang |
| 7,717,830 | B1 | 5/2010 | Charniga et al. |
| 7,717,832 | B2 | 5/2010 | Webber et al. |
| 7,717,833 | B1 | 5/2010 | Nelson et al. |
| 7,722,503 | B1 | 5/2010 | Smith et al. |
| 7,722,507 | B2 | 5/2010 | Yoo |
| 7,722,509 | B2 | 5/2010 | Eder |
| 7,722,513 | B2 | 5/2010 | Habing |
| 7,730,588 | B1 | 6/2010 | Bernier |
| 7,731,634 | B2 | 6/2010 | Stewart et al. |
| 7,731,635 | B2 | 6/2010 | Dyer |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,736,283 | B2 | 6/2010 | Webb |
| 7,736,286 | B2 | 6/2010 | Panaiotov |
| 7,740,562 | B2 | 6/2010 | Jones |
| 7,740,563 | B2 | 6/2010 | Dalebout et al. |
| 7,740,568 | B2 | 6/2010 | Webb |
| 7,740,570 | B2 | 6/2010 | Winston |
| 7,741,975 | B2 | 6/2010 | Shum et al. |
| 7,745,716 | B1 | 6/2010 | Murphy |
| 7,749,137 | B2 | 7/2010 | Watt et al. |
| 7,749,138 | B2 | 7/2010 | Wang |
| 7,749,140 | B1 | 7/2010 | Lindemeier et al. |
| 7,753,824 | B2 | 7/2010 | Wang |
| 7,753,830 | B1 | 7/2010 | Marsh et al. |
| 7,753,861 | B1 | 7/2010 | Kahn et al. |
| 7,757,346 | B2 | 7/2010 | Chase |
| 7,758,469 | B2 | 7/2010 | Dyer et al. |
| 7,758,470 | B2 | 7/2010 | Hirata et al. |
| 7,758,477 | B2 | 7/2010 | Prenatt |
| 7,758,478 | B2 | 7/2010 | Golesh et al. |
| 7,761,212 | B2 | 7/2010 | Takebayashi |
| 7,762,932 | B2 | 7/2010 | Hetrick |
| 7,762,934 | B1 | 7/2010 | Munson, Jr. et al. |
| 7,762,935 | B2 | 7/2010 | Doble |
| 7,762,952 | B2 | 7/2010 | Lee et al. |
| 7,764,641 | B2 | 7/2010 | Pelton et al. |
| 7,764,990 | B2 | 7/2010 | Martikka et al. |
| 7,766,793 | B2 | 8/2010 | Hashimoto |
| 7,766,797 | B2 | 8/2010 | Dalebout |
| 7,766,802 | B2 | 8/2010 | Webber et al. |
| 7,771,319 | B1 | 8/2010 | Lannon |
| 7,771,320 | B2 | 8/2010 | Riley et al. |
| 7,771,325 | B2 | 8/2010 | Baker |
| 7,771,329 | B2 | 8/2010 | Dalebout et al. |
| 7,771,330 | B2 | 8/2010 | Towley |
| 7,771,371 | B2 | 8/2010 | Avni |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,775,945 | B2 | 8/2010 | Smith |
| 7,775,949 | B2 | 8/2010 | Bowser |
| 7,775,952 | B1 | 8/2010 | Curran et al. |
| 7,775,953 | B2 | 8/2010 | Wang |
| 7,780,577 | B2 | 8/2010 | Arnold |
| 7,780,578 | B2 | 8/2010 | Packham |
| 7,780,583 | B2 | 8/2010 | Brown |
| 7,780,585 | B1 | 8/2010 | Rivas |
| 7,785,232 | B2 | 8/2010 | Cole et al. |
| 7,789,800 | B1 | 9/2010 | Watterson et al. |
| 7,789,806 | B2 | 9/2010 | Yang |
| 7,789,816 | B2 | 9/2010 | Krietzman |
| 7,794,363 | B2 | 9/2010 | Wang |
| 7,794,371 | B2 | 9/2010 | Webber et al. |
| 7,795,824 | B2 | 9/2010 | Shen et al. |
| 7,798,946 | B2 | 9/2010 | Dalebout et al. |
| 7,803,096 | B2 | 9/2010 | Mehta |
| 7,805,186 | B2 | 9/2010 | Pulkkinen et al. |
| 7,806,006 | B2 | 10/2010 | Phillips et al. |
| 7,806,780 | B1 | 10/2010 | Plunkett |
| 7,806,805 | B2 | 10/2010 | Barufka et al. |
| 7,806,815 | B2 | 10/2010 | Fernandez |
| 7,811,202 | B2 | 10/2010 | Planke |
| 7,811,209 | B2 | 10/2010 | Crawford et al. |
| 7,811,213 | B2 | 10/2010 | Chen |
| 7,815,548 | B2 | 10/2010 | Barre et al. |
| 7,815,549 | B2 | 10/2010 | Crawford et al. |
| 7,815,550 | B2 | 10/2010 | Watterson et al. |
| 7,815,552 | B2 | 10/2010 | Dibble et al. |
| 7,815,554 | B2 | 10/2010 | Gibson et al. |
| 7,819,779 | B2 | 10/2010 | Chang |
| 7,819,784 | B1 | 10/2010 | Caswell et al. |
| 7,819,785 | B2 | 10/2010 | Maiaro et al. |
| 7,825,319 | B2 | 11/2010 | Turner |
| 7,828,699 | B2 | 11/2010 | P Erez De Lazarraga |
| 7,828,703 | B1 | 11/2010 | Boesch |
| 7,833,135 | B2 | 11/2010 | Radow |
| 7,833,138 | B1 | 11/2010 | Fulks |
| 7,833,141 | B2 | 11/2010 | Kulka |
| 7,837,161 | B2 | 11/2010 | Chase |
| 7,837,595 | B2 | 11/2010 | Rice |
| 7,837,598 | B1 | 11/2010 | Boozel, Jr. |
| 7,837,602 | B1 | 11/2010 | Drybread |
| 7,837,603 | B1 | 11/2010 | Carnell, Sr. |
| 7,839,058 | B1 | 11/2010 | Churchill et al. |
| 7,841,971 | B2 | 11/2010 | Smith |
| 7,841,973 | B2 | 11/2010 | Trancart |
| 7,842,038 | B2 | 11/2010 | Haddock et al. |
| 7,846,070 | B2 | 12/2010 | Oglesby et al. |
| 7,850,514 | B2 | 12/2010 | Weber |
| 7,850,537 | B2 | 12/2010 | Stern |
| 7,850,584 | B2 | 12/2010 | Uygan |
| 7,854,669 | B2 | 12/2010 | Marty et al. |
| 7,854,690 | B2 | 12/2010 | Trevino et al. |
| 7,857,736 | B2 | 12/2010 | Merrithew et al. |
| 7,862,475 | B2 | 1/2011 | Watterson |
| 7,862,483 | B2 | 1/2011 | Hendrickson et al. |
| 7,862,486 | B1 | 1/2011 | Watson |
| 7,862,487 | B2 | 1/2011 | Olson |
| 7,862,489 | B2 | 1/2011 | Savšek et al. |
| 7,867,153 | B2 | 1/2011 | Roman |
| 7,871,355 | B2 | 1/2011 | Yeh |
| 7,871,357 | B2 | 1/2011 | Gibson et al. |
| 7,873,849 | B2 | 1/2011 | Mucignat et al. |
| 7,874,957 | B2 | 1/2011 | Hurwitz et al. |
| 7,874,961 | B2 | 1/2011 | McKee et al. |
| 7,874,963 | B2 | 1/2011 | Grind |
| 7,874,971 | B2 | 1/2011 | Reyes |
| 7,878,950 | B1 | 2/2011 | Bastian |
| 7,878,953 | B2 | 2/2011 | Webber et al. |
| 7,878,956 | B2 | 2/2011 | Kadar |
| 7,883,445 | B2 | 2/2011 | Olrik et al. |
| 7,883,448 | B2 | 2/2011 | Wang |
| 7,887,465 | B2 | 2/2011 | Uffelman |
| 7,887,468 | B2 | 2/2011 | Ross et al. |
| 7,887,469 | B1 | 2/2011 | Chen |
| 7,887,470 | B2 | 2/2011 | Chen |
| 7,887,471 | B2 | 2/2011 | Mcsorley |
| 7,892,148 | B1 | 2/2011 | Stauffer et al. |
| 7,892,149 | B2 | 2/2011 | Wu |
| 7,892,150 | B1 | 2/2011 | Colley |
| 7,892,155 | B2 | 2/2011 | Pearson et al. |
| 7,892,159 | B2 | 2/2011 | McVay et al. |
| 7,896,782 | B2 | 3/2011 | Tamari |
| 7,900,324 | B2 | 3/2011 | Ginocchio |
| 7,901,324 | B2 | 3/2011 | Kodama |
| 7,901,325 | B2 | 3/2011 | Henderson |
| 7,901,335 | B2 | 3/2011 | Webber et al. |
| 7,901,753 | B2 | 3/2011 | Carr |
| 7,905,817 | B2 | 3/2011 | Giannascoli et al. |

(56) References Cited

U.S. PATENT DOCUMENTS

| | | | |
|---|---|---|---|
| 7,905,819 | B2 | 3/2011 | Alessandri et al. |
| 7,908,981 | B2 | 3/2011 | Agee |
| 7,909,740 | B2 | 3/2011 | Dalebout et al. |
| 7,909,741 | B2 | 3/2011 | Kim et al. |
| 7,909,742 | B2 | 3/2011 | Ish, III et al. |
| 7,909,743 | B1 | 3/2011 | Webber |
| 7,909,745 | B2 | 3/2011 | Mills et al. |
| 7,914,420 | B2 | 3/2011 | Daly et al. |
| 7,914,421 | B2 | 3/2011 | Weier et al. |
| 7,918,768 | B2 | 4/2011 | Rogozinski |
| 7,918,769 | B2 | 4/2011 | Lamarque |
| 7,919,950 | B2 | 4/2011 | Uno et al. |
| 7,922,621 | B1 | 4/2011 | Hamada et al. |
| 7,922,631 | B2 | 4/2011 | Ish, III |
| 7,922,632 | B2 | 4/2011 | Chou |
| 7,922,633 | B2 | 4/2011 | Januszek |
| 7,922,635 | B2 | 4/2011 | Lull et al. |
| 7,927,253 | B2 | 4/2011 | Vincent |
| 7,927,257 | B2 | 4/2011 | Patel |
| 7,927,267 | B2 | 4/2011 | Splane |
| 7,931,563 | B2 | 4/2011 | Shaw et al. |
| 7,931,570 | B2 | 4/2011 | Hoffman |
| 7,935,026 | B2 | 5/2011 | Mcsorley |
| 7,935,032 | B1 | 5/2011 | Jackson |
| 7,935,038 | B2 | 5/2011 | Tyree |
| 7,938,751 | B2 | 5/2011 | Nicolas et al. |
| 7,938,755 | B1 | 5/2011 | Dyer et al. |
| 7,938,760 | B1 | 5/2011 | Webber et al. |
| 7,938,761 | B2 | 5/2011 | Simonson |
| 7,941,945 | B2 | 5/2011 | Gerber |
| 7,942,783 | B2 | 5/2011 | Ochi |
| 7,942,788 | B2 | 5/2011 | Wu |
| 7,942,793 | B2 | 5/2011 | Mills et al. |
| 7,946,967 | B2 | 5/2011 | Berhanu |
| 7,946,968 | B2 | 5/2011 | Kjellberg |
| 7,949,295 | B2 | 5/2011 | Kumar et al. |
| 7,951,046 | B1 | 5/2011 | Barber, Jr. |
| 7,955,235 | B2 | 6/2011 | Keiser |
| 7,959,124 | B2 | 6/2011 | Phifer |
| 7,963,890 | B2 | 6/2011 | Webber et al. |
| 7,963,892 | B2 | 6/2011 | Poblete Castro et al. |
| 7,967,728 | B2 | 6/2011 | Zavadsky |
| 7,967,730 | B2 | 6/2011 | Crawford et al. |
| 7,967,734 | B1 | 6/2011 | Damian |
| 7,972,245 | B2 | 7/2011 | Temple et al. |
| 7,972,249 | B1 | 7/2011 | Napalan |
| 7,976,437 | B1 | 7/2011 | Von Detten |
| 7,976,440 | B2 | 7/2011 | Webber et al. |
| 7,976,443 | B2 | 7/2011 | Krull |
| 7,976,445 | B2 | 7/2011 | Lalaoua |
| 7,978,081 | B2 | 7/2011 | Shears et al. |
| 7,980,996 | B2 | 7/2011 | Hickman |
| 7,981,010 | B1 | 7/2011 | Webber et al. |
| 7,981,011 | B1 | 7/2011 | Batca |
| 7,981,012 | B1 | 7/2011 | Krull |
| 7,981,013 | B2 | 7/2011 | Krull |
| 7,985,164 | B2 | 7/2011 | Ashby |
| 7,985,166 | B2 | 7/2011 | Farnsworth et al. |
| 7,985,167 | B2 | 7/2011 | Nizam |
| 7,988,598 | B2 | 8/2011 | Trzecieski |
| 7,988,600 | B2 | 8/2011 | Rodgers, Jr. |
| 7,988,604 | B2 | 8/2011 | Barnett |
| 7,988,605 | B1 | 8/2011 | Wyeroski |
| 7,992,879 | B2 | 8/2011 | Eisenberg et al. |
| 7,993,251 | B1 | 8/2011 | Webber et al. |
| 7,998,036 | B2 | 8/2011 | Ish, III |
| 7,998,038 | B2 | 8/2011 | Keiser |
| 7,998,042 | B2 | 8/2011 | Bowser et al. |
| 8,001,472 | B2 | 8/2011 | Gilley et al. |
| 8,002,674 | B2 | 8/2011 | Piaget et al. |
| 8,002,678 | B1 | 8/2011 | Krull |
| 8,002,684 | B2 | 8/2011 | Laurent |
| 8,006,574 | B2 | 8/2011 | Meyer |
| 8,006,711 | B2 | 8/2011 | Pietrzak et al. |
| 8,007,407 | B2 | 8/2011 | Richter |
| 8,007,409 | B2 | 8/2011 | Elllis |
| 8,007,413 | B1 | 8/2011 | Wu |
| 8,007,415 | B1 | 8/2011 | Lundquist |
| 8,007,416 | B2 | 8/2011 | Arlie |
| 8,007,422 | B2 | 8/2011 | Zaccherini |
| 8,009,045 | B2 | 8/2011 | Cehelnik |
| 8,011,242 | B2 | 9/2011 | O'neill |
| 8,012,003 | B2 | 9/2011 | Sterchi et al. |
| 8,012,067 | B2 | 9/2011 | Joannou |
| 8,012,068 | B1 | 9/2011 | Malcolm |
| 8,012,071 | B2 | 9/2011 | Grisdale |
| 8,012,073 | B2 | 9/2011 | Barnett |
| 8,021,277 | B2 | 9/2011 | Baudhuin |
| 8,021,285 | B2 | 9/2011 | Kushnir |
| 8,025,608 | B2 | 9/2011 | Popescu |
| 8,025,609 | B2 | 9/2011 | Giannelli et al. |
| 8,025,613 | B1 | 9/2011 | Wang |
| 8,029,415 | B2 | 10/2011 | Ashby et al. |
| 8,029,418 | B2 | 10/2011 | Nishimura |
| 8,029,425 | B2 | 10/2011 | Bronston et al. |
| 8,033,959 | B2 | 10/2011 | Oleson et al. |
| 8,033,960 | B1 | 10/2011 | Dalebout et al. |
| 8,033,965 | B1 | 10/2011 | Krull |
| 8,033,967 | B2 | 10/2011 | Canali |
| 8,037,574 | B2 | 10/2011 | Chase |
| 8,038,117 | B2 | 10/2011 | Chen et al. |
| 8,038,577 | B2 | 10/2011 | Mcintosh |
| 8,040,117 | B2 | 10/2011 | Telefus |
| 8,043,173 | B2 | 10/2011 | Menalagha et al. |
| 8,043,198 | B2 | 10/2011 | Zhou |
| 8,047,965 | B2 | 11/2011 | Shea |
| 8,047,966 | B2 | 11/2011 | Dorogusker et al. |
| 8,047,970 | B2 | 11/2011 | Nalley |
| 8,052,584 | B2 | 11/2011 | Keiser |
| 8,055,469 | B2 | 11/2011 | Kulach et al. |
| 8,056,687 | B2 | 11/2011 | Golden et al. |
| 8,057,361 | B2 | 11/2011 | McBride et al. |
| 8,057,366 | B2 | 11/2011 | Schippers |
| 8,057,367 | B2 | 11/2011 | Giannelli et al. |
| 8,057,368 | B1 | 11/2011 | Lyszczarz |
| 8,062,196 | B1 | 11/2011 | Khubani |
| 8,063,776 | B2 | 11/2011 | Ruha |
| 8,065,926 | B2 | 11/2011 | Meyer |
| 8,066,514 | B2 | 11/2011 | Clarke |
| 8,070,657 | B2 | 12/2011 | Loach |
| 8,070,658 | B2 | 12/2011 | Giannelli et al. |
| 8,072,902 | B2 | 12/2011 | Moon |
| 8,075,453 | B1 | 12/2011 | Wilkinson |
| 8,079,273 | B2 | 12/2011 | Svenberg |
| 8,079,937 | B2 | 12/2011 | Bedell |
| 8,079,939 | B1 | 12/2011 | Wang |
| 8,079,941 | B2 | 12/2011 | Nortje |
| 8,082,029 | B2 | 12/2011 | Honda |
| 8,083,645 | B2 | 12/2011 | Asukai et al. |
| 8,083,693 | B1 | 12/2011 | McKeon et al. |
| 8,088,044 | B2 | 1/2012 | Tchao et al. |
| 8,092,351 | B1 | 1/2012 | Rodgers, Jr. |
| 8,092,352 | B2 | 1/2012 | Irving et al. |
| 8,096,925 | B2 | 1/2012 | Radding et al. |
| 8,096,926 | B1 | 1/2012 | Batca |
| 8,103,379 | B2 | 1/2012 | Biba et al. |
| 8,103,517 | B2 | 1/2012 | Hinnebusch |
| 8,104,411 | B2 | 1/2012 | Fenton |
| 8,104,987 | B2 | 1/2012 | Johnson |
| 8,105,213 | B2 | 1/2012 | Stewart et al. |
| 8,106,563 | B2 | 1/2012 | Ritchey |
| 8,109,858 | B2 | 2/2012 | Redmann |
| 8,109,864 | B2 | 2/2012 | Tseng |
| 8,111,166 | B2 | 2/2012 | Flexer et al. |
| 8,113,990 | B2 | 2/2012 | Kolman et al. |
| 8,113,994 | B2 | 2/2012 | Piaget et al. |
| 8,118,709 | B2 | 2/2012 | Mckirdy |
| 8,118,888 | B2 | 2/2012 | Molter |
| 8,123,527 | B2 | 2/2012 | Holljes |
| 8,128,537 | B2 | 3/2012 | Signorile et al. |
| 8,141,276 | B2 | 3/2012 | Ellis |
| 8,142,370 | B2 | 3/2012 | Weinberg et al. |
| 8,147,385 | B2 | 4/2012 | Crawford et al. |
| 8,147,386 | B2 | 4/2012 | Farnsworth et al. |

(56) References Cited

U.S. PATENT DOCUMENTS

| | | | |
|---|---|---|---|
| 8,152,702 | B2 | 4/2012 | Pacheco |
| 8,162,769 | B2 | 4/2012 | Henry |
| 8,162,804 | B2 | 4/2012 | Tagliabue |
| 8,167,899 | B2 | 5/2012 | Justis et al. |
| 8,172,729 | B2 | 5/2012 | Ellis |
| 8,173,087 | B2 | 5/2012 | Wei et al. |
| 8,177,688 | B2 | 5/2012 | Burnfield et al. |
| 8,177,693 | B2 | 5/2012 | Webber et al. |
| 8,182,399 | B2 | 5/2012 | Davis et al. |
| 8,188,700 | B2 | 5/2012 | Tseng et al. |
| 8,192,332 | B2 | 6/2012 | Baker et al. |
| 8,192,337 | B2 | 6/2012 | Birch |
| 8,192,338 | B2 | 6/2012 | Solow |
| 8,197,392 | B2 | 6/2012 | Silverman et al. |
| 8,200,323 | B2 | 6/2012 | Dibenedetto et al. |
| 8,206,266 | B2 | 6/2012 | Hall |
| 8,206,274 | B2 | 6/2012 | Svenberg et al. |
| 8,210,995 | B2 | 7/2012 | Reyes |
| 8,212,445 | B2 | 7/2012 | Ritchey |
| 8,215,886 | B2 | 7/2012 | Campbell |
| 8,221,290 | B2 | 7/2012 | Vincent et al. |
| 8,221,295 | B2 | 7/2012 | Wilkins |
| 8,235,724 | B2 | 8/2012 | Gilley et al. |
| 8,235,876 | B2 | 8/2012 | Reyes |
| 8,240,430 | B2 | 8/2012 | Downey |
| 8,241,182 | B2 | 8/2012 | Julskjaer et al. |
| 8,241,186 | B2 | 8/2012 | Brodess et al. |
| 8,241,187 | B2 | 8/2012 | Moon et al. |
| 8,249,714 | B1 | 8/2012 | Hartman et al. |
| 8,251,874 | B2 | 8/2012 | Ashby et al. |
| 8,251,877 | B2 | 8/2012 | Rasmussen et al. |
| 8,260,858 | B2 | 9/2012 | Belz et al. |
| 8,262,546 | B1 | 9/2012 | Lashinske |
| 8,272,996 | B2 | 9/2012 | Weier |
| 8,275,265 | B2 | 9/2012 | Kobyakov et al. |
| 8,280,259 | B2 | 10/2012 | George et al. |
| 8,286,954 | B2 | 10/2012 | Zheng |
| 8,287,434 | B2 | 10/2012 | Zavadsky et al. |
| 8,298,125 | B2 | 10/2012 | Colledge et al. |
| 8,302,213 | B2 | 11/2012 | Kriesel |
| 8,303,472 | B2 | 11/2012 | Bowser |
| 8,306,635 | B2 | 11/2012 | Pryor |
| 8,308,620 | B2 | 11/2012 | Lyszczarz |
| 8,309,870 | B2 | 11/2012 | Peterson et al. |
| 8,310,468 | B2 | 11/2012 | Martin |
| 8,315,636 | B2 | 11/2012 | Moon et al. |
| 8,315,823 | B2 | 11/2012 | Berme et al. |
| 8,317,659 | B2 | 11/2012 | Woodson |
| 8,317,663 | B2 | 11/2012 | Stewart et al. |
| 8,320,578 | B2 | 11/2012 | Kahn et al. |
| 8,323,156 | B2 | 12/2012 | Ozawa et al. |
| 8,323,157 | B2 | 12/2012 | Campanaro et al. |
| 8,323,159 | B2 | 12/2012 | Perry |
| 8,329,265 | B2 | 12/2012 | Cook |
| 8,333,681 | B2 | 12/2012 | Schmidt |
| 8,343,016 | B1 | 1/2013 | Astilean |
| 8,348,811 | B2 | 1/2013 | Kamins |
| 8,359,954 | B2 | 1/2013 | Johnson et al. |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,368,329 | B1 | 2/2013 | Depew et al. |
| 8,376,911 | B2 | 2/2013 | Ogg et al. |
| 8,378,647 | B2 | 2/2013 | Yonezawa et al. |
| 8,394,004 | B2 | 3/2013 | Towley, III |
| 8,394,005 | B2 | 3/2013 | Solow et al. |
| 8,395,366 | B2 | 3/2013 | Uno |
| 8,398,529 | B2 | 3/2013 | Ellis |
| 8,403,816 | B2 | 3/2013 | Park |
| 8,429,223 | B2 | 4/2013 | Gilley et al. |
| 8,435,160 | B1 | 5/2013 | Clum |
| 8,444,537 | B1 | 5/2013 | Santoro |
| 8,446,275 | B2 | 5/2013 | Utter, II |
| 8,449,620 | B2 | 5/2013 | Hakansson et al. |
| 8,454,437 | B2 | 6/2013 | Dugan |
| 8,454,483 | B1 | 6/2013 | Bradley et al. |
| 8,459,479 | B2 | 6/2013 | Yourist |
| 8,467,979 | B2 | 6/2013 | Sobolewski |
| 8,470,190 | B2 | 6/2013 | Jeanne et al. |
| 8,475,338 | B2 | 7/2013 | Greenhill et al. |
| 8,475,346 | B2 | 7/2013 | Gerschefske et al. |
| 8,475,367 | B1 | 7/2013 | Yuen et al. |
| 8,480,541 | B1 | 7/2013 | Brunts |
| 8,485,576 | B2 | 7/2013 | Melville et al. |
| 8,485,944 | B2 | 7/2013 | Drazan |
| 8,485,945 | B2 | 7/2013 | Leonhard |
| 8,485,946 | B2 | 7/2013 | Ross et al. |
| 8,485,947 | B2 | 7/2013 | Nizam |
| 8,485,950 | B2 | 7/2013 | Adams |
| 8,485,953 | B2 | 7/2013 | Chou |
| 8,485,996 | B2 | 7/2013 | Bluman |
| 8,487,759 | B2 | 7/2013 | Hill |
| 8,493,757 | B2 | 7/2013 | Carletti et al. |
| 8,500,607 | B2 | 8/2013 | Vittone |
| 8,500,608 | B1 | 8/2013 | Bonomi |
| 8,505,597 | B2 | 8/2013 | Sharperson |
| 8,506,370 | B2 | 8/2013 | Homsi |
| 8,506,459 | B2 | 8/2013 | Cassidy et al. |
| 8,512,209 | B2 | 8/2013 | Guidi et al. |
| 8,512,210 | B2 | 8/2013 | Shauli |
| 8,512,212 | B2 | 8/2013 | Ish, III |
| 8,516,723 | B2 | 8/2013 | Ferrigan et al. |
| 8,517,895 | B2 | 8/2013 | Shalev |
| 8,517,899 | B2 | 8/2013 | Zhou |
| 8,523,743 | B1 | 9/2013 | Miles et al. |
| 8,523,789 | B2 | 9/2013 | Keiser |
| 8,527,101 | B2 | 9/2013 | Burris et al. |
| 8,529,414 | B2 | 9/2013 | Hobson |
| 8,529,415 | B2 | 9/2013 | Svenberg |
| 8,533,620 | B2 | 9/2013 | Hoffman et al. |
| 8,535,204 | B2 | 9/2013 | Stacey |
| 8,535,247 | B2 | 9/2013 | Williams |
| 8,537,017 | B2 | 9/2013 | Mack et al. |
| 8,540,560 | B2 | 9/2013 | Crowley et al. |
| 8,540,607 | B2 | 9/2013 | Kissel et al. |
| 8,550,962 | B2 | 10/2013 | Piaget et al. |
| 8,550,964 | B2 | 10/2013 | Ish, III et al. |
| 8,552,859 | B2 | 10/2013 | Pakula et al. |
| 8,556,090 | B2 | 10/2013 | Chen |
| 8,556,216 | B2 | 10/2013 | Bandera |
| 8,556,780 | B2 | 10/2013 | Chen |
| 8,562,489 | B2 | 10/2013 | Burton et al. |
| 8,562,496 | B2 | 10/2013 | Webber et al. |
| 8,564,235 | B2 | 10/2013 | Burris et al. |
| 8,568,279 | B2 | 10/2013 | Golesh |
| 8,568,280 | B2 | 10/2013 | Mendoza |
| 8,568,281 | B2 | 10/2013 | Beaulieu et al. |
| 8,569,963 | B2 | 10/2013 | Walters |
| 8,571,250 | B2 | 10/2013 | Royer |
| 8,572,764 | B2 | 11/2013 | Thellmann |
| 8,572,820 | B2 | 11/2013 | Richards |
| 8,573,572 | B2 | 11/2013 | Bowen et al. |
| 8,573,982 | B1 | 11/2013 | Chuang |
| 8,574,131 | B2 | 11/2013 | Daly |
| 8,585,561 | B2 | 11/2013 | Watt et al. |
| 8,588,476 | B1 | 11/2013 | Spicola, Jr. |
| 8,590,120 | B2 | 11/2013 | Sakai |
| 8,591,386 | B2 | 11/2013 | Meyer |
| 8,591,387 | B2 | 11/2013 | Fife |
| 8,602,951 | B2 | 12/2013 | Morris |
| 8,607,562 | B2 | 12/2013 | Browne |
| 8,608,624 | B2 | 12/2013 | Shabodyash et al. |
| 8,613,689 | B2 | 12/2013 | Dyer et al. |
| 8,614,595 | B2 | 12/2013 | Acatrinei |
| 8,614,902 | B2 | 12/2013 | Pansier et al. |
| 8,615,377 | B1 | 12/2013 | Yuen et al. |
| 8,617,008 | B2 | 12/2013 | Marty et al. |
| 8,622,747 | B2 | 1/2014 | Chu et al. |
| 8,631,544 | B1 | 1/2014 | Shotey et al. |
| 8,647,239 | B1 | 2/2014 | Sokolovas |
| 8,647,240 | B2 | 2/2014 | Heidecke |
| 8,651,030 | B2 | 2/2014 | Coffman |
| 8,655,004 | B2 | 2/2014 | Prest et al. |
| 8,657,724 | B2 | 2/2014 | Yang |

(56) References Cited

U.S. PATENT DOCUMENTS

| | | | |
|---|---|---|---|
| 8,668,630 | B2 | 3/2014 | Towley, III |
| 8,671,853 | B2 | 3/2014 | Flaherty |
| 8,678,897 | B2 | 3/2014 | Englert et al. |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,690,740 | B2 | 4/2014 | Yu |
| 8,696,527 | B2 | 4/2014 | Wu |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,702,574 | B2 | 4/2014 | Abranchess |
| 8,706,530 | B2 | 4/2014 | Ohnemus et al. |
| 8,708,870 | B2 | 4/2014 | Nalley |
| 8,708,872 | B2 | 4/2014 | Giannelli et al. |
| 8,714,346 | B2 | 5/2014 | Freitag |
| 8,715,140 | B1 | 5/2014 | Gertz |
| 8,715,143 | B2 | 5/2014 | Svenberg |
| 8,721,507 | B2 | 5/2014 | Blancher |
| 8,727,946 | B2 | 5/2014 | Greenhill et al. |
| 8,727,947 | B2 | 5/2014 | Tagliabue |
| 8,734,157 | B1 | 5/2014 | Hummel, III |
| 8,734,301 | B2 | 5/2014 | Remelius |
| 8,734,302 | B2 | 5/2014 | Hsieh |
| 8,734,304 | B2 | 5/2014 | Webber et al. |
| 8,734,308 | B1 | 5/2014 | Joslin |
| 8,738,321 | B2 | 5/2014 | Yuen et al. |
| 8,739,974 | B2 | 6/2014 | TeVault et al. |
| 8,740,753 | B2 | 6/2014 | Olson et al. |
| 8,740,756 | B2 | 6/2014 | Shabodyash et al. |
| 8,749,380 | B2 | 6/2014 | Vock et al. |
| 8,758,201 | B2 | 6/2014 | Ashby et al. |
| 8,762,077 | B2 | 6/2014 | Redmond |
| 8,762,101 | B2 | 6/2014 | Yuen et al. |
| 8,764,609 | B1 | 7/2014 | Elahmadie |
| 8,771,153 | B2 | 7/2014 | Dalebout et al. |
| 8,771,154 | B2 | 7/2014 | Fedriga |
| 8,777,820 | B2 | 7/2014 | Lo |
| 8,777,822 | B2 | 7/2014 | Agostini |
| 8,783,326 | B1 | 7/2014 | Vaninger et al. |
| 8,784,274 | B1 | 7/2014 | Chuang |
| 8,784,275 | B2 | 7/2014 | Mikan et al. |
| 8,784,286 | B2 | 7/2014 | Reyes |
| 8,786,575 | B2 | 7/2014 | Miller |
| 8,790,222 | B2 | 7/2014 | Burger |
| 8,801,578 | B2 | 8/2014 | Corbalis et al. |
| 8,801,581 | B2 | 8/2014 | Lai et al. |
| 8,801,582 | B2 | 8/2014 | Huang et al. |
| 8,814,754 | B2 | 8/2014 | Weast et al. |
| 8,815,189 | B2 | 8/2014 | Arnold et al. |
| 8,821,350 | B2 | 9/2014 | Maertz |
| 8,821,354 | B1 | 9/2014 | Tabahi |
| 8,821,359 | B1 | 9/2014 | Kassel |
| 8,821,870 | B2 | 9/2014 | Robinson et al. |
| 8,823,314 | B2 | 9/2014 | Lumsden et al. |
| 8,824,166 | B2 | 9/2014 | Rohrbach |
| 8,824,697 | B2 | 9/2014 | Christoph |
| 8,825,445 | B2 | 9/2014 | Hoffman et al. |
| 8,827,874 | B2 | 9/2014 | Nishimura |
| 8,827,879 | B2 | 9/2014 | Nicholas |
| 8,837,174 | B2 | 9/2014 | Hosotani |
| 8,839,725 | B2 | 9/2014 | Kooistra |
| 8,840,075 | B2 | 9/2014 | Michael Olson |
| 8,840,569 | B2 | 9/2014 | Flaction et al. |
| 8,845,497 | B2 | 9/2014 | Turner |
| 8,845,498 | B2 | 9/2014 | Webb |
| 8,845,499 | B1 | 9/2014 | Boatwright |
| 8,847,988 | B2 | 9/2014 | Geisner et al. |
| 8,851,565 | B2 | 10/2014 | Hontz et al. |
| 8,858,397 | B2 | 10/2014 | Ishii |
| 8,858,409 | B2 | 10/2014 | Trees |
| 8,864,627 | B2 | 10/2014 | Bayerlein et al. |
| 8,870,720 | B1 | 10/2014 | Webber et al. |
| 8,870,726 | B2 | 10/2014 | Watterson et al. |
| 8,876,131 | B1 | 11/2014 | Gomes |
| 8,876,661 | B2 | 11/2014 | Lu |
| 8,876,668 | B2 | 11/2014 | Hendrickson et al. |
| 8,876,674 | B2 | 11/2014 | Webb et al. |
| 8,888,660 | B1 | 11/2014 | Oteman |
| 8,892,999 | B2 | 11/2014 | Nims et al. |
| 8,894,549 | B2 | 11/2014 | Colledge |
| 8,894,551 | B2 | 11/2014 | Kerdjoudj |
| 8,913,409 | B2 | 12/2014 | Hui et al. |
| 8,917,273 | B2 | 12/2014 | Hoebel |
| 8,920,291 | B2 | 12/2014 | Chen et al. |
| 8,922,498 | B2 | 12/2014 | Vesely |
| 8,926,475 | B2 | 1/2015 | Lin et al. |
| 8,926,479 | B2 | 1/2015 | Chen et al. |
| 8,932,188 | B2 | 1/2015 | Svenberg |
| 8,939,831 | B2 | 1/2015 | Dugan |
| 8,956,290 | B2 | 2/2015 | Gilley et al. |
| 8,956,715 | B2 | 2/2015 | Kim |
| 8,961,439 | B2 | 2/2015 | Yang et al. |
| 8,968,155 | B2 | 3/2015 | Bird |
| 8,968,162 | B2 | 3/2015 | Jaguan |
| 8,968,163 | B1 | 3/2015 | Vidmar |
| 8,968,164 | B2 | 3/2015 | Chen |
| 8,979,709 | B2 | 3/2015 | Toback et al. |
| 8,986,165 | B2 | 3/2015 | Ashby |
| 8,986,807 | B2 | 3/2015 | Rodgers |
| 8,986,808 | B2 | 3/2015 | George |
| 8,990,045 | B2 | 3/2015 | Zhu et al. |
| 8,990,732 | B2 | 3/2015 | Farrenkopf et al. |
| 8,992,392 | B2 | 3/2015 | Giannelli et al. |
| 8,992,393 | B2 | 3/2015 | Reyes |
| 8,996,978 | B2 | 3/2015 | Richstein et al. |
| 9,005,085 | B2 | 4/2015 | Astilean |
| 9,008,973 | B2 | 4/2015 | French |
| 9,010,222 | B2 | 4/2015 | Peirce |
| 9,011,156 | B2 | 4/2015 | Hallmark |
| 9,011,291 | B2 | 4/2015 | Birrell |
| 9,011,299 | B2 | 4/2015 | Lien |
| 9,011,301 | B2 | 4/2015 | Balandis et al. |
| 9,015,952 | B2 | 4/2015 | Magosaki |
| 9,017,230 | B1 | 4/2015 | Pitts |
| 9,022,906 | B1 | 5/2015 | Nelson |
| 9,022,907 | B2 | 5/2015 | Wang |
| 9,028,368 | B2 | 5/2015 | Ashby et al. |
| 9,028,381 | B2 | 5/2015 | Mestemaker |
| 9,033,137 | B2 | 5/2015 | Koppes et al. |
| 9,033,712 | B2 | 5/2015 | Vasin |
| 9,038,218 | B1 | 5/2015 | Heil et al. |
| 9,038,549 | B1 | 5/2015 | Zebarjad |
| 9,039,578 | B2 | 5/2015 | Dalebout |
| 9,044,635 | B2 | 6/2015 | Lull |
| 9,044,637 | B2 | 6/2015 | Karl |
| 9,050,486 | B2 | 6/2015 | Reed |
| 9,050,491 | B2 | 6/2015 | Gordon et al. |
| 9,050,497 | B2 | 6/2015 | Reyes |
| 9,050,498 | B2 | 6/2015 | Lu et al. |
| 9,063,026 | B2 | 6/2015 | Nassef |
| 9,072,930 | B2 | 7/2015 | Ashby et al. |
| 9,072,932 | B2 | 7/2015 | Piaget et al. |
| 9,072,941 | B2 | 7/2015 | Duda et al. |
| 9,078,708 | B2 | 7/2015 | Haas |
| 9,079,068 | B2 | 7/2015 | Muehl |
| 9,081,534 | B2 | 7/2015 | Yuen et al. |
| 9,081,889 | B2 | 7/2015 | Ingrassia et al. |
| 9,083,245 | B2 | 7/2015 | Zhao et al. |
| 9,084,565 | B2 | 7/2015 | Mason et al. |
| 9,084,712 | B2 | 7/2015 | Roerdink et al. |
| 9,089,732 | B2 | 7/2015 | Andon et al. |
| 9,091,008 | B2 | 7/2015 | Mathieu |
| 9,095,740 | B2 | 8/2015 | Wu |
| 9,108,079 | B2 | 8/2015 | Solow et al. |
| 9,108,081 | B2 | 8/2015 | Giannelli et al. |
| 9,114,273 | B2 | 8/2015 | Kehoe |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,125,620 | B2 | 9/2015 | Walke |
| 9,126,072 | B2 | 9/2015 | Watterson |
| 9,126,076 | B2 | 9/2015 | Liang |
| 9,132,051 | B2 | 9/2015 | Heil |

(56) References Cited

U.S. PATENT DOCUMENTS

| | | | |
|---|---|---|---|
| 9,132,330 | B2 | 9/2015 | Brendle |
| 9,135,347 | B2 | 9/2015 | Damman et al. |
| 9,138,607 | B2 | 9/2015 | Miranda |
| 9,138,612 | B2 | 9/2015 | Breaux |
| 9,138,614 | B2 | 9/2015 | Lu et al. |
| 9,138,615 | B2 | 9/2015 | Olson et al. |
| 9,144,703 | B2 | 9/2015 | Dalebout et al. |
| 9,144,709 | B2 | 9/2015 | Reich |
| 9,148,077 | B2 | 9/2015 | Henderson |
| 9,162,102 | B1 | 10/2015 | Eder et al. |
| 9,162,104 | B1 | 10/2015 | Lee |
| 9,162,106 | B1 | 10/2015 | Scheiman |
| 9,168,414 | B2 | 10/2015 | Liu et al. |
| 9,174,085 | B2 | 11/2015 | Foley |
| 9,186,537 | B2 | 11/2015 | Arnold et al. |
| 9,186,549 | B2 | 11/2015 | Watterson et al. |
| 9,186,552 | B1 | 11/2015 | Deal |
| 9,192,800 | B1 | 11/2015 | Meyer et al. |
| 9,198,622 | B2 | 12/2015 | Kaleal et al. |
| 9,199,115 | B2 | 12/2015 | Yim et al. |
| 9,199,123 | B2 | 12/2015 | Solow |
| 9,201,458 | B2 | 12/2015 | Hunt et al. |
| 9,211,431 | B2 | 12/2015 | Hornback et al. |
| 9,220,940 | B2 | 12/2015 | Kuwari |
| 9,221,545 | B2 | 12/2015 | Popescu et al. |
| 9,223,936 | B2 | 12/2015 | Aragones et al. |
| 9,224,291 | B2 | 12/2015 | Moll-Carrillo et al. |
| 9,226,692 | B2 | 1/2016 | Haas |
| 9,227,101 | B2 | 1/2016 | Maguire |
| 9,242,139 | B2 | 1/2016 | Holley |
| 9,242,142 | B2 | 1/2016 | Vincent et al. |
| 9,248,329 | B2 | 2/2016 | Heideman |
| 9,254,409 | B2 | 2/2016 | Dalebout et al. |
| 9,256,711 | B2 | 2/2016 | Horseman |
| 9,257,054 | B2 | 2/2016 | Coza et al. |
| 9,259,633 | B2 | 2/2016 | Meyers |
| 9,263,967 | B2 | 2/2016 | McCune |
| 9,265,984 | B2 | 2/2016 | Huber |
| 9,272,186 | B2 | 3/2016 | Reich |
| 9,283,429 | B2 | 3/2016 | Aragones et al. |
| 9,283,431 | B2 | 3/2016 | Marty |
| 9,289,063 | B2 | 3/2016 | Baugh et al. |
| 9,289,644 | B2 | 3/2016 | Carson |
| 9,289,674 | B2 | 3/2016 | Winsper et al. |
| 9,292,935 | B2 | 3/2016 | Koduri et al. |
| 9,295,302 | B1 | 3/2016 | Reed et al. |
| 9,298,886 | B2 | 3/2016 | Homsi |
| 9,302,139 | B2 | 4/2016 | Habing et al. |
| 9,308,409 | B2 | 4/2016 | Beaver et al. |
| 9,308,410 | B2 | 4/2016 | Beaver et al. |
| 9,308,415 | B2 | 4/2016 | Crawford et al. |
| 9,308,417 | B2 | 4/2016 | Grundy |
| 9,311,802 | B1 | 4/2016 | Chin et al. |
| 9,314,658 | B2 | 4/2016 | Kaye |
| 9,314,659 | B2 | 4/2016 | Gvoich |
| 9,314,666 | B2 | 4/2016 | Canavan et al. |
| 9,317,660 | B2 | 4/2016 | Burich et al. |
| 9,320,457 | B2 | 4/2016 | Flaction et al. |
| 9,320,935 | B1 | 4/2016 | Paris |
| 9,320,938 | B1 | 4/2016 | Belmore |
| 9,320,940 | B2 | 4/2016 | Rainey |
| 9,327,159 | B1 | 5/2016 | Medina |
| 9,330,239 | B2 | 5/2016 | Koduri et al. |
| 9,330,544 | B2 | 5/2016 | Levesque et al. |
| 9,333,388 | B2 | 5/2016 | Lee et al. |
| 9,339,681 | B1 | 5/2016 | Nalley |
| 9,339,682 | B2 | 5/2016 | Braier et al. |
| 9,339,683 | B2 | 5/2016 | Dilli et al. |
| 9,339,692 | B2 | 5/2016 | Hashish |
| 9,352,181 | B2 | 5/2016 | O'Neil |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,358,414 | B2 | 6/2016 | Dephouse |
| 9,358,422 | B2 | 6/2016 | Brontman |
| 9,358,426 | B2 | 6/2016 | Aragones et al. |
| 9,364,703 | B1 | 6/2016 | Kuka |
| 9,364,706 | B2 | 6/2016 | Lo |
| 9,364,708 | B2 | 6/2016 | Luger et al. |
| 9,364,712 | B2 | 6/2016 | Wu |
| 9,364,714 | B2 | 6/2016 | Koduri et al. |
| 9,367,668 | B2 | 6/2016 | Flynt et al. |
| 9,369,178 | B2 | 6/2016 | Matsutani |
| 9,370,687 | B2 | 6/2016 | Hao |
| 9,370,691 | B2 | 6/2016 | Nissila et al. |
| 9,375,602 | B2 | 6/2016 | Krull |
| 9,378,336 | B2 | 6/2016 | Ohnemus et al. |
| 9,387,355 | B1 | 7/2016 | Joya |
| 9,387,357 | B2 | 7/2016 | Mueller |
| 9,387,387 | B2 | 7/2016 | Dalebout |
| 9,389,718 | B1 | 7/2016 | Letourneur |
| 9,392,941 | B2 | 7/2016 | Powch et al. |
| 9,393,453 | B2 | 7/2016 | Watterson |
| 9,403,047 | B2 | 8/2016 | Olson |
| 9,403,048 | B2 | 8/2016 | Balandis et al. |
| 9,409,047 | B2 | 8/2016 | Kamenskikh |
| 9,409,050 | B2 | 8/2016 | Mintz |
| 9,411,940 | B2 | 8/2016 | Burroughs et al. |
| 9,415,257 | B2 | 8/2016 | Habing |
| 9,427,611 | B1 | 8/2016 | Balentine |
| 9,427,615 | B2 | 8/2016 | Pretz et al. |
| 9,452,315 | B1 | 9/2016 | Murray et al. |
| 9,452,320 | B2 | 9/2016 | Yang |
| 9,455,623 | B2 | 9/2016 | Fan et al. |
| 9,455,784 | B2 | 9/2016 | O'Keeffe |
| 9,457,219 | B2 | 10/2016 | Smith |
| 9,457,220 | B2 | 10/2016 | Olson |
| 9,457,224 | B2 | 10/2016 | Giannelli et al. |
| 9,457,256 | B2 | 10/2016 | Aragones et al. |
| 9,463,345 | B2 | 10/2016 | Simonetti |
| 9,463,349 | B1 | 10/2016 | Chang |
| 9,468,792 | B2 | 10/2016 | Simonetti |
| 9,468,793 | B2 | 10/2016 | Salmon |
| 9,474,666 | B1 | 10/2016 | Smith |
| 9,480,874 | B2 | 11/2016 | Cutler |
| 9,486,658 | B2 | 11/2016 | Alexander |
| 9,498,128 | B2 | 11/2016 | Jayalth et al. |
| 9,498,666 | B1 | 11/2016 | Boatwright |
| 9,498,668 | B2 | 11/2016 | Smith |
| 9,498,671 | B1 | 11/2016 | Softky |
| 9,505,241 | B2 | 11/2016 | Lyon |
| 9,506,528 | B2 | 11/2016 | Tucker et al. |
| 9,506,529 | B2 | 11/2016 | Tucker et al. |
| 9,511,254 | B2 | 12/2016 | Netter |
| 9,511,259 | B2 | 12/2016 | Mountain |
| 9,511,864 | B2 | 12/2016 | Simpson |
| 9,521,901 | B2 | 12/2016 | Dalebout |
| 9,526,937 | B2 | 12/2016 | Uygan |
| 9,539,458 | B1 | 1/2017 | Ross |
| 9,539,461 | B2 | 1/2017 | Ercanbrack |
| 9,540,071 | B2 | 1/2017 | Jordan et al. |
| 9,540,174 | B2 | 1/2017 | Josserond et al. |
| 9,545,540 | B1 | 1/2017 | Moschel |
| 9,545,541 | B2 | 1/2017 | Aragones et al. |
| 9,550,091 | B2 | 1/2017 | Emerson |
| 9,555,278 | B2 | 1/2017 | Kaye et al. |
| 9,555,280 | B2 | 1/2017 | Kaye et al. |
| 9,560,917 | B2 | 2/2017 | Roslund, Jr. |
| 9,569,986 | B2 | 2/2017 | Levine et al. |
| 9,573,017 | B2 | 2/2017 | Chang |
| 9,579,534 | B2 | 2/2017 | Sutkowski et al. |
| 9,579,544 | B2 | 2/2017 | Watterson |
| 9,582,976 | B2 | 2/2017 | Chin et al. |
| 9,586,085 | B2 | 3/2017 | Arnold et al. |
| 9,586,090 | B2 | 3/2017 | Watterson et al. |
| 9,593,992 | B2 | 3/2017 | Wu |
| 9,604,089 | B2 | 3/2017 | Cervone et al. |
| 9,604,092 | B2 | 3/2017 | Krull |
| 9,604,099 | B2 | 3/2017 | Taylor |
| 9,604,757 | B2 | 3/2017 | Spivack et al. |
| 9,610,475 | B1 | 4/2017 | DeKnock et al. |
| 9,610,506 | B2 | 4/2017 | Dugan |
| 9,616,274 | B2 | 4/2017 | Wehrell |

(56) References Cited

U.S. PATENT DOCUMENTS

| | | | |
|---|---|---|---|
| 9,616,284 | B1 | 4/2017 | Aganyan et al. |
| 9,616,292 | B2 | 4/2017 | Orfield |
| 9,623,285 | B1 | 4/2017 | Ruiz |
| 9,623,286 | B1 | 4/2017 | Chen |
| 9,630,048 | B2 | 4/2017 | Kaye et al. |
| 9,636,539 | B1 | 5/2017 | Brumit |
| 9,636,540 | B2 | 5/2017 | Mueller et al. |
| 9,642,415 | B2 | 5/2017 | Pease et al. |
| 9,643,042 | B2 | 5/2017 | Madden |
| 9,649,524 | B2 | 5/2017 | Giunchi |
| 9,656,115 | B2 | 5/2017 | Young |
| 9,656,144 | B2 | 5/2017 | Jafarifesharaki |
| 9,656,591 | B1 | 5/2017 | Dumenigo |
| 9,665,046 | B2 | 5/2017 | Aoto et al. |
| 9,665,873 | B2 | 5/2017 | Ackland |
| 9,669,261 | B2 | 6/2017 | Eder |
| 9,673,904 | B2 | 6/2017 | Palanisamy et al. |
| 9,675,836 | B2 | 6/2017 | Babon |
| 9,681,313 | B2 | 6/2017 | Malach |
| 9,682,267 | B2 | 6/2017 | Kaye et al. |
| 9,682,306 | B2 | 6/2017 | Lin et al. |
| 9,682,307 | B2 | 6/2017 | Dalebout |
| 9,687,689 | B2 | 6/2017 | Lin |
| 9,692,276 | B2 | 6/2017 | Oteman et al. |
| 9,694,234 | B2 | 7/2017 | Dalebout et al. |
| 9,700,752 | B1 | 7/2017 | Powers |
| 9,700,753 | B1 | 7/2017 | Boatwright |
| 9,700,780 | B2 | 7/2017 | Riley et al. |
| 9,707,435 | B1 | 7/2017 | Ferlito et al. |
| 9,707,441 | B2 | 7/2017 | Yang |
| 9,707,447 | B1 | 7/2017 | Lopez Babodilla |
| 9,720,912 | B2 | 8/2017 | Morimoto et al. |
| 9,723,381 | B2 | 8/2017 | Swanson |
| 9,724,553 | B2 | 8/2017 | Kaye et al. |
| 9,724,563 | B2 | 8/2017 | Schmidt |
| 9,731,157 | B2 | 8/2017 | Loach |
| 9,731,158 | B1 | 8/2017 | Lo |
| 9,734,477 | B2 | 8/2017 | Weast et al. |
| 9,737,747 | B1 | 8/2017 | Walsh et al. |
| 9,737,755 | B2 | 8/2017 | Dalebout |
| 9,750,454 | B2 | 9/2017 | Walke et al. |
| 9,757,605 | B2 | 9/2017 | Olson et al. |
| 9,757,611 | B1 | 9/2017 | Colburn |
| 9,764,184 | B2 | 9/2017 | Kueker et al. |
| 9,764,188 | B1 | 9/2017 | Aganyan et al. |
| 9,776,032 | B2 | 10/2017 | Moran et al. |
| 9,776,039 | B1 | 10/2017 | Xu |
| 9,782,625 | B1 | 10/2017 | Blum et al. |
| 9,795,818 | B2 | 10/2017 | Powell |
| 9,795,819 | B2 | 10/2017 | Wehrell |
| 9,795,822 | B2 | 10/2017 | Smith et al. |
| 9,795,827 | B2 | 10/2017 | Wiener et al. |
| 9,795,855 | B2 | 10/2017 | Jafarifesharaki |
| 9,802,072 | B2 | 10/2017 | Wehrell |
| 9,802,075 | B2 | 10/2017 | Gvoich |
| 9,808,673 | B2 | 11/2017 | Robinson |
| 9,814,920 | B1 | 11/2017 | Monterrey |
| 9,814,922 | B2 | 11/2017 | Moran et al. |
| 9,814,927 | B2 | 11/2017 | Forystek |
| 9,814,929 | B2 | 11/2017 | Moser |
| 9,814,930 | B2 | 11/2017 | Manzke et al. |
| 9,827,458 | B2 | 11/2017 | Dalton |
| 9,829,068 | B2 | 11/2017 | Marchetti |
| 9,833,654 | B1 | 12/2017 | Gant |
| 9,833,658 | B2 | 12/2017 | Wiener et al. |
| 9,839,804 | B2 | 12/2017 | Werner |
| 9,841,077 | B2 | 12/2017 | Modrezejewski et al. |
| 9,846,438 | B2 | 12/2017 | Rihn et al. |
| 9,849,330 | B2 | 12/2017 | Lagree |
| 9,868,006 | B1 | 1/2018 | Epler |
| 9,873,012 | B2 | 1/2018 | Huppee et al. |
| 9,878,201 | B1 | 1/2018 | Moschel |
| 9,884,222 | B2 | 2/2018 | Chen |
| 9,884,224 | B2 | 2/2018 | Spoeth et al. |
| 9,885,575 | B2 | 2/2018 | Collin |
| 9,889,334 | B2 | 2/2018 | Ashby et al. |
| 9,895,567 | B2 | 2/2018 | Lee |
| 9,895,570 | B2 | 2/2018 | Shah |
| 9,895,571 | B2 | 2/2018 | Wang |
| 9,901,766 | B2 | 2/2018 | Ross |
| 9,901,767 | B2 | 2/2018 | Kuo |
| 9,901,772 | B2 | 2/2018 | Crowley et al. |
| 9,901,780 | B2 | 2/2018 | DeLuca et al. |
| 9,901,805 | B2 | 2/2018 | Hughes, Jr. |
| 9,907,396 | B1 | 3/2018 | Labrosse et al. |
| 9,914,011 | B2 | 3/2018 | Downey et al. |
| 9,914,014 | B2 | 3/2018 | Lagree et al. |
| 9,919,183 | B1 | 3/2018 | Moschel |
| 9,921,726 | B1 | 3/2018 | Sculley et al. |
| 9,937,375 | B2 | 4/2018 | Zhu |
| 9,943,719 | B2 | 4/2018 | Smith et al. |
| 9,948,349 | B2 | 4/2018 | Malach |
| 9,950,205 | B2 | 4/2018 | Simonetti |
| 9,950,209 | B2 | 4/2018 | Yim et al. |
| 9,951,904 | B2 | 4/2018 | Perez et al. |
| 9,956,450 | B2 | 5/2018 | Bayerlein et al. |
| 9,968,816 | B2 | 5/2018 | Olson et al. |
| 9,968,821 | B2 | 5/2018 | Finlayson et al. |
| 9,968,823 | B2 | 5/2018 | Cutler |
| 9,975,003 | B2 | 5/2018 | Molins et al. |
| 9,979,182 | B2 | 5/2018 | Lin et al. |
| 9,987,513 | B2 | 6/2018 | Yim et al. |
| 9,987,517 | B1 | 6/2018 | Kuo |
| 9,990,126 | B2 | 6/2018 | Chanyontpatanakul |
| 9,993,680 | B2 | 6/2018 | Gordon |
| 9,993,683 | B2 | 6/2018 | Moschel |
| 9,993,711 | B2 | 6/2018 | Moya Saez |
| 10,004,934 | B2 | 6/2018 | Pennington |
| 10,004,940 | B2 | 6/2018 | Badarneh |
| 10,004,945 | B2 | 6/2018 | Sauter |
| 10,010,169 | B2 | 7/2018 | Grotenhuis |
| 10,010,745 | B1 | 7/2018 | Brumit |
| 10,016,646 | B2 | 7/2018 | Butler |
| 10,022,583 | B2 | 7/2018 | Wang |
| 10,022,590 | B2 | 7/2018 | Foley et al. |
| 10,036,443 | B2 | 7/2018 | Galasso et al. |
| 10,038,952 | B2 | 7/2018 | Labrosse et al. |
| 10,039,952 | B2 | 8/2018 | Chang |
| 10,039,970 | B2 | 8/2018 | Lee et al. |
| 10,046,222 | B2 | 8/2018 | Hawkins, III et al. |
| 10,065,064 | B2 | 9/2018 | Smith et al. |
| 10,065,070 | B2 | 9/2018 | Huang |
| 10,070,816 | B2 | 9/2018 | Cowley et al. |
| 10,071,285 | B2 | 9/2018 | Smith et al. |
| 10,076,437 | B2 | 9/2018 | Plath |
| 10,086,254 | B2 | 10/2018 | Watterson |
| 2001/0001303 | A1 | 5/2001 | Ohsuga et al. |
| 2001/0008053 | A1 | 7/2001 | Belli |
| 2002/0016235 | A1 | 2/2002 | Ashby et al. |
| 2002/0025888 | A1 | 2/2002 | Germanton |
| 2002/0043909 | A1 | 4/2002 | Nielsen |
| 2002/0052268 | A1 | 5/2002 | Morcillo-Quintero |
| 2002/0055418 | A1 | 5/2002 | Pyles et al. |
| 2002/0055422 | A1 | 5/2002 | Airmet |
| 2002/0066735 | A1 | 6/2002 | Hewlitt et al. |
| 2002/0072436 | A1 | 6/2002 | Liu |
| 2002/0077221 | A1 | 6/2002 | Dalebout et al. |
| 2002/0086779 | A1 | 7/2002 | Wilkinson |
| 2002/0091043 | A1 | 7/2002 | Rexach |
| 2002/0101880 | A1 | 8/2002 | Kim |
| 2002/0128127 | A1 | 9/2002 | Chen |
| 2002/0160883 | A1 | 10/2002 | Dugan |
| 2002/0160891 | A1 | 10/2002 | Gallagher |
| 2002/0193213 | A1 | 12/2002 | Batca |
| 2003/0008731 | A1 | 1/2003 | Anderson et al. |
| 2003/0017918 | A1 | 1/2003 | Webb et al. |
| 2003/0022765 | A1 | 1/2003 | Wu |
| 2003/0022770 | A1 | 1/2003 | Lee |
| 2003/0045406 | A1 | 3/2003 | Stone |
| 2003/0060344 | A1 | 3/2003 | David |
| 2003/0060345 | A1 | 3/2003 | Piane |
| 2003/0069108 | A1 | 4/2003 | Rubinstein |
| 2003/0073545 | A1 | 4/2003 | Liu |
| 2003/0092532 | A1 | 5/2003 | Giannelli et al. |

(56) References Cited

U.S. PATENT DOCUMENTS

| | | | |
|---|---|---|---|
| 2003/0092540 | A1 | 5/2003 | Gillen |
| 2003/0096675 | A1 | 5/2003 | Wang |
| 2003/0100413 | A1 | 5/2003 | Huang |
| 2003/0100415 | A1 | 5/2003 | Augustine et al. |
| 2003/0104908 | A1 | 6/2003 | Tung |
| 2003/0114276 | A1 | 6/2003 | Schiff |
| 2003/0122384 | A1 | 7/2003 | Swanson et al. |
| 2003/0128186 | A1 | 7/2003 | Laker |
| 2003/0134718 | A1 | 7/2003 | Kim |
| 2003/0148853 | A1 | 8/2003 | Alessandri |
| 2003/0148862 | A1 | 8/2003 | Chen |
| 2003/0166434 | A1 | 9/2003 | Lopez-Santillana et al. |
| 2003/0171189 | A1 | 9/2003 | Kaufman |
| 2003/0171190 | A1 | 9/2003 | Rice |
| 2003/0176815 | A1 | 9/2003 | Baba et al. |
| 2003/0186792 | A1 | 10/2003 | Keeler |
| 2003/0211916 | A1 | 11/2003 | Capuano |
| 2003/0216230 | A1 | 11/2003 | Wang |
| 2004/0005961 | A1 | 1/2004 | Iund |
| 2004/0005965 | A1 | 1/2004 | Panatta |
| 2004/0009856 | A1 | 1/2004 | Hammer |
| 2004/0014571 | A1 | 1/2004 | Haynes |
| 2004/0021046 | A1 | 2/2004 | Hutchison |
| 2004/0023761 | A1 | 2/2004 | Emery |
| 2004/0023766 | A1 | 2/2004 | Slone |
| 2004/0025754 | A1 | 2/2004 | Dye |
| 2004/0025993 | A1 | 2/2004 | Russell |
| 2004/0029645 | A1 | 2/2004 | Chen |
| 2004/0033866 | A1 | 2/2004 | Shapiro |
| 2004/0033868 | A1 | 2/2004 | Van Straaten |
| 2004/0043871 | A1 | 3/2004 | Chang |
| 2004/0043873 | A1 | 3/2004 | Wilkinson et al. |
| 2004/0051392 | A1 | 3/2004 | Badarneh |
| 2004/0053748 | A1 | 3/2004 | Lo et al. |
| 2004/0053752 | A1 | 3/2004 | Yang |
| 2004/0072662 | A1 | 4/2004 | Landfair |
| 2004/0077468 | A1 | 4/2004 | Myles |
| 2004/0087420 | A1 | 5/2004 | Montesquieux |
| 2004/0097353 | A1 | 5/2004 | Mencis |
| 2004/0100484 | A1 | 5/2004 | Barrett |
| 2004/0132586 | A1 | 7/2004 | Leighton et al. |
| 2004/0138030 | A1 | 7/2004 | Wang |
| 2004/0138032 | A1 | 7/2004 | Van Straaten |
| 2004/0142799 | A1 | 7/2004 | Yeo |
| 2004/0142801 | A1 | 7/2004 | Lin |
| 2004/0152566 | A1 | 8/2004 | Yeh |
| 2004/0160336 | A1 | 8/2004 | Hoch |
| 2004/0162194 | A1 | 8/2004 | Habing |
| 2004/0162196 | A1 | 8/2004 | Degroot |
| 2004/0163574 | A1 | 8/2004 | Schoenbach |
| 2004/0171464 | A1 | 9/2004 | Ashby et al. |
| 2004/0171465 | A1 | 9/2004 | Hald |
| 2004/0176215 | A1 | 9/2004 | Gramaccioni |
| 2004/0180719 | A1 | 9/2004 | Feldman |
| 2004/0181972 | A1 | 9/2004 | Csorba |
| 2004/0185988 | A1 | 9/2004 | Hsiung |
| 2004/0198569 | A1 | 10/2004 | Sanford-Schwentke |
| 2004/0204294 | A2 | 10/2004 | Wilkinson |
| 2004/0208943 | A1 | 10/2004 | Miketin |
| 2004/0224740 | A1 | 11/2004 | Ball et al. |
| 2004/0242378 | A1 | 12/2004 | Pan |
| 2004/0242380 | A1 | 12/2004 | Kuivala |
| 2004/0242388 | A1 | 12/2004 | Kusminsky |
| 2004/0266587 | A1 | 12/2004 | Miller |
| 2004/0266591 | A1 | 12/2004 | Alessandri et al. |
| 2005/0003931 | A1 | 1/2005 | Mills et al. |
| 2005/0008992 | A1 | 1/2005 | Westergaard et al. |
| 2005/0009668 | A1 | 1/2005 | Savettiere |
| 2005/0023292 | A1 | 2/2005 | Market et al. |
| 2005/0037904 | A1 | 2/2005 | Chang |
| 2005/0043155 | A1 | 2/2005 | Yannitte |
| 2005/0044984 | A1 | 3/2005 | Jones |
| 2005/0049117 | A1 | 3/2005 | Rodgers |
| 2005/0049123 | A1 | 3/2005 | Dalebout et al. |
| 2005/0054492 | A1 | 3/2005 | Neff |
| 2005/0061587 | A1 | 3/2005 | Tsai |
| 2005/0065003 | A1 | 3/2005 | Klotzki |
| 2005/0075213 | A1 | 4/2005 | Arick |
| 2005/0085348 | A1 | 4/2005 | Kiefer |
| 2005/0096189 | A1 | 5/2005 | Chen |
| 2005/0101463 | A1 | 5/2005 | Chen |
| 2005/0107220 | A1 | 5/2005 | Wang |
| 2005/0107226 | A1 | 5/2005 | Monda |
| 2005/0113223 | A1 | 5/2005 | Dovner et al. |
| 2005/0130814 | A1 | 6/2005 | Nitta et al. |
| 2005/0143226 | A1 | 6/2005 | Heidecke |
| 2005/0148440 | A1 | 7/2005 | Denton |
| 2005/0148442 | A1 | 7/2005 | Watterson |
| 2005/0159273 | A1 | 7/2005 | Chen |
| 2005/0159278 | A1 | 7/2005 | Mcvay |
| 2005/0164839 | A1 | 7/2005 | Watterson |
| 2005/0170935 | A1 | 8/2005 | Manser |
| 2005/0170936 | A1 | 8/2005 | Quinn |
| 2005/0170937 | A1 | 8/2005 | van Straaten |
| 2005/0172311 | A1 | 8/2005 | Hjelt et al. |
| 2005/0181347 | A1 | 8/2005 | Barnes et al. |
| 2005/0181916 | A1 | 8/2005 | Frost et al. |
| 2005/0187075 | A1 | 8/2005 | Bellamy |
| 2005/0196737 | A1 | 9/2005 | Mann |
| 2005/0209050 | A1 | 9/2005 | Bartels |
| 2005/0233873 | A1 | 10/2005 | Chen |
| 2005/0239600 | A1 | 10/2005 | Liang |
| 2005/0239607 | A1 | 10/2005 | Chang |
| 2005/0245370 | A1 | 11/2005 | Boland |
| 2005/0248713 | A1 | 11/2005 | Hirosue et al. |
| 2005/0250619 | A1 | 11/2005 | Daikeler et al. |
| 2005/0272562 | A1 | 12/2005 | Alessandri et al. |
| 2005/0272564 | A1 | 12/2005 | Pyles et al. |
| 2005/0272575 | A1 | 12/2005 | Melegati |
| 2005/0272577 | A1 | 12/2005 | Olson |
| 2005/0277520 | A1 | 12/2005 | Van Waes |
| 2005/0283051 | A1 | 12/2005 | Chen |
| 2005/0288155 | A1 | 12/2005 | Yang |
| 2006/0003869 | A1 | 1/2006 | Huang et al. |
| 2006/0003877 | A1 | 1/2006 | Harmon |
| 2006/0019804 | A1 | 1/2006 | Young |
| 2006/0019806 | A1 | 1/2006 | Mikulski |
| 2006/0021155 | A1 | 2/2006 | Lang et al. |
| 2006/0030465 | A1 | 2/2006 | Johnson |
| 2006/0033392 | A1 | 2/2006 | Ritchey |
| 2006/0035757 | A1 | 2/2006 | Flick et al. |
| 2006/0035772 | A1 | 2/2006 | Golesh et al. |
| 2006/0040797 | A1 | 2/2006 | Chang |
| 2006/0040810 | A1 | 2/2006 | Chu |
| 2006/0047447 | A1 | 3/2006 | Brady et al. |
| 2006/0058162 | A1 | 3/2006 | Vieno et al. |
| 2006/0063644 | A1 | 3/2006 | Yang |
| 2006/0084422 | A1 | 4/2006 | Huang et al. |
| 2006/0084556 | A1 | 4/2006 | Payne |
| 2006/0116253 | A1 | 6/2006 | Nizam |
| 2006/0122035 | A1 | 6/2006 | Felix |
| 2006/0122038 | A1 | 6/2006 | Chou Lin |
| 2006/0122044 | A1 | 6/2006 | Ho |
| 2006/0128540 | A1 | 6/2006 | Engle |
| 2006/0135322 | A1 | 6/2006 | Rocker |
| 2006/0148622 | A1 | 7/2006 | Chen |
| 2006/0160665 | A1 | 7/2006 | Tai |
| 2006/0160666 | A1 | 7/2006 | Wang |
| 2006/0160677 | A1 | 7/2006 | Piane, Jr. |
| 2006/0166791 | A1 | 7/2006 | Liao |
| 2006/0166799 | A1 | 7/2006 | Boland et al. |
| 2006/0172862 | A1 | 8/2006 | Badarneh et al. |
| 2006/0189440 | A1 | 8/2006 | Gravagne |
| 2006/0189452 | A1 | 8/2006 | Chou |
| 2006/0194679 | A1 | 8/2006 | Hatcher |
| 2006/0205568 | A1 | 9/2006 | Huang |
| 2006/0217240 | A1 | 9/2006 | White |
| 2006/0217242 | A1 | 9/2006 | Karpachev |
| 2006/0240947 | A1 | 10/2006 | Qu |
| 2006/0240951 | A1 | 10/2006 | Wang |
| 2006/0240959 | A1 | 10/2006 | Huang |
| 2006/0244187 | A1 | 11/2006 | Downey |
| 2006/0247107 | A1 | 11/2006 | Carter |
| 2006/0247109 | A1 | 11/2006 | Powell |

(56) References Cited

U.S. PATENT DOCUMENTS

2006/0248965 A1 11/2006 Wyatt
2006/0251638 A1 11/2006 Guenzler-Pukall
2006/0252602 A1 11/2006 Brown
2006/0252612 A1 11/2006 Melcer
2006/0258513 A1 11/2006 Routley
2006/0258519 A1 11/2006 Ardito, III et al.
2006/0276306 A1 12/2006 Pan et al.
2006/0281608 A1 12/2006 Tumminello
2006/0287089 A1 12/2006 Addington et al.
2006/0287147 A1 12/2006 Kriesel
2006/0287163 A1 12/2006 Wang
2006/0288846 A1 12/2006 Logan
2007/0004562 A1 1/2007 Pan et al.
2007/0004569 A1 1/2007 Cao
2007/0006489 A1 1/2007 Case, Jr. et al.
2007/0013655 A1 1/2007 Rosenberg et al.
2007/0017025 A1 1/2007 Myer
2007/0018465 A1 1/2007 Vassilakos
2007/0021280 A1 1/2007 Tyree
2007/0027002 A1 2/2007 Clark et al.
2007/0038137 A1 2/2007 Arand et al.
2007/0042868 A1 2/2007 Fisher
2007/0042878 A1 2/2007 Lundquist
2007/0049464 A1 3/2007 Chou
2007/0049465 A1 3/2007 Wu
2007/0049466 A1 3/2007 Hubbard
2007/0049470 A1 3/2007 Pyles et al.
2007/0057001 A1 3/2007 Wang
2007/0060449 A1 3/2007 Lo
2007/0060451 A1 3/2007 Lucas
2007/0066448 A1 3/2007 Pan et al.
2007/0087908 A1 4/2007 Pan et al.
2007/0087920 A1 4/2007 Dachraoui et al.
2007/0093369 A1 4/2007 Bocchicchio
2007/0111858 A1 5/2007 Dugan
2007/0117683 A1 5/2007 Ercanbrack et al.
2007/0123389 A1 5/2007 Martin
2007/0123396 A1 5/2007 Ellis
2007/0135264 A1 6/2007 Rosenberg
2007/0135272 A1 6/2007 Stuckey
2007/0135279 A1 6/2007 Purdy et al.
2007/0141871 A1 6/2007 Scherer et al.
2007/0142177 A1 6/2007 Simms et al.
2007/0142183 A1 6/2007 Chang
2007/0151489 A1 7/2007 Byrne
2007/0155277 A1 7/2007 Amitai et al.
2007/0155495 A1 7/2007 Goo
2007/0155600 A1 7/2007 Cunningham et al.
2007/0161468 A1 7/2007 Yanagisawa et al.
2007/0161470 A1 7/2007 Berryman
2007/0161472 A1 7/2007 Drechsler
2007/0167292 A1 7/2007 Kuo
2007/0176035 A1 8/2007 Campbell
2007/0179030 A1 8/2007 Slawinski
2007/0184944 A1 8/2007 Huang
2007/0184953 A1 8/2007 Luberski et al.
2007/0190508 A1 8/2007 Dalton
2007/0191190 A1 8/2007 Kuo
2007/0197345 A1 8/2007 Wallace et al.
2007/0197353 A1 8/2007 Hundley
2007/0201727 A1 8/2007 Birrell et al.
2007/0202992 A1 8/2007 Grasshoff
2007/0204430 A1 9/2007 Chase
2007/0214630 A1 9/2007 Kim
2007/0219066 A1 9/2007 Wang
2007/0225119 A1 9/2007 Schenk
2007/0225126 A1 9/2007 Yoo
2007/0225127 A1 9/2007 Pan et al.
2007/0232455 A1 10/2007 Hanoun
2007/0232461 A1 10/2007 Jenkins et al.
2007/0232463 A1 10/2007 Wu
2007/0243975 A1 10/2007 Gearon
2007/0245612 A1 10/2007 Tresenfeld
2007/0247320 A1 10/2007 Morahan
2007/0249467 A1 10/2007 Hong et al.
2007/0259759 A1 11/2007 Sumners et al.
2007/0259763 A1 11/2007 McKeown et al.
2007/0270284 A1 11/2007 Lin
2007/0270667 A1 11/2007 Coppi et al.
2007/0270726 A1 11/2007 Chou
2007/0281828 A1 12/2007 Rice
2007/0281831 A1 12/2007 Wang
2007/0281836 A1 12/2007 Gearon
2007/0284495 A1 12/2007 Charles
2007/0287606 A1 12/2007 Mac Millan
2007/0296313 A1 12/2007 Wang
2007/0298935 A1 12/2007 Badarneh
2007/0298937 A1 12/2007 Shah
2007/0298941 A1 12/2007 Egger
2007/0298945 A1 12/2007 Mehta
2007/0298947 A1 12/2007 Eksteen
2008/0001772 A1 1/2008 Saito
2008/0004162 A1 1/2008 Chen
2008/0018211 A1 1/2008 Dye
2008/0020898 A1 1/2008 Pyles et al.
2008/0020907 A1 1/2008 Lin
2008/0020911 A1 1/2008 Castello Neto
2008/0026658 A1 1/2008 Kriesel
2008/0026838 A1 1/2008 Dunstan et al.
2008/0032864 A1 2/2008 Hakki
2008/0032870 A1 2/2008 Wu
2008/0039301 A1 2/2008 Halbridge
2008/0046246 A1 2/2008 Hakki
2008/0051256 A1 2/2008 Ashby et al.
2008/0057889 A1 3/2008 Jan
2008/0070755 A1 3/2008 Mckee
2008/0070756 A1 3/2008 Chu
2008/0076972 A1 3/2008 Dorogusker et al.
2008/0085819 A1 4/2008 Yang et al.
2008/0085820 A1 4/2008 Majkrzak
2008/0090703 A1 4/2008 Rosenberg
2008/0096735 A1 4/2008 Grider
2008/0096745 A1 4/2008 Perry
2008/0103024 A1 5/2008 Habing
2008/0103034 A1 5/2008 Mihara et al.
2008/0108917 A1 5/2008 Joutras et al.
2008/0139370 A1 6/2008 Charnitski
2008/0146418 A1 6/2008 Summers
2008/0153676 A1 6/2008 Krietzman
2008/0153682 A1 6/2008 Chen et al.
2008/0155077 A1 6/2008 James
2008/0161168 A1 7/2008 Hsiao
2008/0161170 A1 7/2008 Lumpee
2008/0161653 A1 7/2008 Lin et al.
2008/0171640 A1 7/2008 Chang
2008/0171922 A1 7/2008 Teller
2008/0176717 A1 7/2008 Wang
2008/0176718 A1 7/2008 Wang
2008/0182724 A1 7/2008 Guthrie
2008/0182731 A1 7/2008 Vittone
2008/0187689 A1 8/2008 Dierkens et al.
2008/0188362 A1 8/2008 Chen
2008/0191864 A1 8/2008 Wolfson
2008/0200287 A1 8/2008 Marty et al.
2008/0200853 A1 8/2008 Tielve
2008/0204225 A1 8/2008 Kitchen
2008/0207407 A1 8/2008 Yeh
2008/0207415 A1 8/2008 Tsai
2008/0214971 A1 9/2008 Talish
2008/0216717 A1 9/2008 Jones
2008/0228110 A1 9/2008 Berme
2008/0229875 A1 9/2008 Ray
2008/0234111 A1 9/2008 Packham
2008/0242511 A1 10/2008 Munoz et al.
2008/0242520 A1 10/2008 Hubbard
2008/0250729 A1 10/2008 Kriesel
2008/0255794 A1 10/2008 Levine
2008/0261785 A1 10/2008 Albanese
2008/0279896 A1 11/2008 Heinen et al.
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0300110 A1 12/2008 Smith et al.

(56) References Cited

U.S. PATENT DOCUMENTS

2008/0300115 A1 12/2008 Erlandson
2008/0300118 A1 12/2008 Wehrell
2008/0300914 A1 12/2008 Karkanias et al.
2008/0312047 A1 12/2008 Feng
2008/0318737 A1 12/2008 Chu
2008/0318738 A1 12/2008 Chen
2008/0318744 A1 12/2008 Barra
2009/0001831 A1 1/2009 Cho et al.
2009/0023553 A1 1/2009 Shim
2009/0027925 A1 1/2009 Kanouda et al.
2009/0029831 A1 1/2009 Weier
2009/0042698 A1 2/2009 Wang
2009/0048073 A1 2/2009 Roimicher
2009/0048493 A1 2/2009 James et al.
2009/0054751 A1 2/2009 Babashan et al.
2009/0069159 A1 3/2009 Wang
2009/0075781 A1 3/2009 Schwarzberg et al.
2009/0075784 A1 3/2009 Hoggan
2009/0075793 A1 3/2009 Trainor
2009/0080808 A1 3/2009 Hagen
2009/0093347 A1 4/2009 Wang
2009/0105052 A1 4/2009 Dalebout et al.
2009/0105548 A1 4/2009 Bart
2009/0111658 A1 4/2009 Juan
2009/0111664 A1 4/2009 Kau
2009/0111666 A1 4/2009 Wang
2009/0111670 A1 4/2009 Williams
2009/0118098 A1 5/2009 Yeh
2009/0124463 A1 5/2009 Lin
2009/0124464 A1 5/2009 Kastelic
2009/0124465 A1 5/2009 Wang
2009/0124466 A1 5/2009 Zhang
2009/0128516 A1 5/2009 Rimon et al.
2009/0131225 A1 5/2009 Burdea
2009/0131230 A1 5/2009 Cole
2009/0149302 A1 6/2009 Thuma
2009/0156363 A1 6/2009 Guidi et al.
2009/0156364 A1 6/2009 Simeoni
2009/0158871 A1 6/2009 Chuo
2009/0163327 A1 6/2009 Huang et al.
2009/0170672 A1 7/2009 Mcmullen
2009/0180646 A1 7/2009 Vulfson et al.
2009/0181829 A1 7/2009 Wu
2009/0181830 A1 7/2009 Wu
2009/0181831 A1 7/2009 Kuo
2009/0186748 A1 7/2009 Golesh et al.
2009/0196417 A1 8/2009 Beaver et al.
2009/0209393 A1 8/2009 Crater et al.
2009/0221405 A1 9/2009 Wang
2009/0221407 A1 9/2009 Hauk
2009/0258710 A1 10/2009 Quatrochi et al.
2009/0269728 A1 10/2009 Verstegen et al.
2009/0286653 A1 11/2009 Wiber
2009/0305852 A1 12/2009 Svenberg
2010/0004104 A1 1/2010 Gustafson
2010/0005624 A1 1/2010 Swearingen
2010/0015585 A1 1/2010 Baker
2010/0022354 A1 1/2010 Fisher
2010/0031803 A1 2/2010 Lozada et al.
2010/0034665 A1 2/2010 Zhong et al.
2010/0035726 A1 2/2010 Fisher et al.
2010/0048368 A1 2/2010 Donofrio
2010/0056345 A1 3/2010 Liu
2010/0063426 A1 3/2010 Planke
2010/0064255 A1 3/2010 Rottler et al.
2010/0079291 A1 4/2010 Kroll et al.
2010/0081548 A1 4/2010 Labedz
2010/0093493 A1 4/2010 Eldridge
2010/0105527 A1 4/2010 Johnson
2010/0105530 A1 4/2010 Inaizumi
2010/0113223 A1 5/2010 Chiles et al.
2010/0130337 A1 5/2010 Stewart
2010/0137105 A1 6/2010 McLaughlin
2010/0156760 A1 6/2010 Cheswick
2010/0175634 A1 7/2010 Chang et al.
2010/0178981 A1 7/2010 Holcomb
2010/0179035 A1 7/2010 Carnahan
2010/0184570 A1 7/2010 Cheng
2010/0192715 A1 8/2010 Vauchel et al.
2010/0197462 A1 8/2010 Piane, Jr.
2010/0197465 A1 8/2010 Stevenson
2010/0210418 A1 8/2010 Park
2010/0216600 A1 8/2010 Noffsinger
2010/0216607 A1 8/2010 Mueller
2010/0216610 A1 8/2010 Gedeon-Janvier
2010/0227740 A1 9/2010 Liu
2010/0233664 A1 9/2010 Wroclawsky
2010/0234184 A1 9/2010 Le Page
2010/0234193 A1 9/2010 Friedman
2010/0240458 A1 9/2010 Gaiba et al.
2010/0240493 A1 9/2010 Wang
2010/0279822 A1 11/2010 Ford
2010/0285933 A1 11/2010 Nalley
2010/0304931 A1 12/2010 Stumpf
2010/0304938 A1 12/2010 Olson
2010/0304940 A1 12/2010 Svenberg
2010/0311552 A1 12/2010 Sumners
2010/0317488 A1 12/2010 Cartaya
2010/0323852 A1 12/2010 Locsin
2010/0327603 A1 12/2010 Suaan
2011/0028282 A1 2/2011 Sbragia
2011/0054359 A1 3/2011 Sazonov et al.
2011/0056328 A1 3/2011 Ko
2011/0061840 A1 3/2011 Goldmann
2011/0065371 A1 3/2011 Leff
2011/0065373 A1 3/2011 Goldmann
2011/0067361 A1 3/2011 Sloan
2011/0073743 A1 3/2011 Shamie
2011/0082013 A1 4/2011 Bastian
2011/0082015 A1 4/2011 Dreissigacker et al.
2011/0086707 A1 4/2011 Loveland
2011/0087137 A1 4/2011 Hanoun
2011/0093100 A1 4/2011 Ramsay
2011/0098157 A1 4/2011 Whalen et al.
2011/0098615 A1 4/2011 Whalen et al.
2011/0109283 A1 5/2011 Kapels et al.
2011/0131005 A1 6/2011 Ueshima et al.
2011/0136627 A1 6/2011 Williams
2011/0143769 A1 6/2011 Jones et al.
2011/0152037 A1 6/2011 Tsou
2011/0152635 A1 6/2011 Morris et al.
2011/0165995 A1 7/2011 Paulus
2011/0165996 A1 7/2011 Paulus
2011/0165997 A1 7/2011 Reich
2011/0172058 A1 7/2011 Deaconu
2011/0172060 A1 7/2011 Morales et al.
2011/0172068 A1 7/2011 Tyson, III
2011/0175744 A1 7/2011 Englert et al.
2011/0185309 A1 7/2011 Challinor et al.
2011/0188980 A1 8/2011 Pumroy
2011/0190096 A1 8/2011 Clarke
2011/0195819 A1 8/2011 Shaw
2011/0195825 A1 8/2011 Liester
2011/0201481 A1 8/2011 Lo
2011/0205164 A1 8/2011 Hansen et al.
2011/0221672 A1 9/2011 Osterhout et al.
2011/0237407 A1 9/2011 Kaleal
2011/0240403 A1 10/2011 Meillet
2011/0275489 A1 11/2011 Apau
2011/0275499 A1 11/2011 Eschenbach
2011/0281249 A1 11/2011 Gammell et al.
2011/0281691 A1 11/2011 Ellis
2011/0287905 A1 11/2011 Reyes
2011/0308919 A1 12/2011 Hahn
2012/0004074 A1 1/2012 Schelzig
2012/0010053 A1 1/2012 Bayerlein et al.
2012/0015787 A2 1/2012 Crawley
2012/0021873 A1 1/2012 Brunner
2012/0021876 A1 1/2012 Hsiung
2012/0021877 A1 1/2012 Lundquist et al.
2012/0035024 A1 2/2012 Price
2012/0071301 A1 3/2012 Kaylor et al.
2012/0083396 A1 4/2012 Aquino
2012/0088633 A1 4/2012 Crafton

(56) References Cited

U.S. PATENT DOCUMENTS

| | | | |
|---|---|---|---|
| 2012/0088640 | A1 | 4/2012 | Wissink |
| 2012/0115691 | A1 | 5/2012 | Munroe |
| 2012/0132877 | A1 | 5/2012 | Wang |
| 2012/0142503 | A1 | 6/2012 | Sevadjian |
| 2012/0158238 | A1 | 6/2012 | Daley |
| 2012/0165162 | A1 | 6/2012 | Lu |
| 2012/0174833 | A1 | 7/2012 | Early |
| 2012/0178590 | A1 | 7/2012 | Lu |
| 2012/0190502 | A1 | 7/2012 | Paulus et al. |
| 2012/0218184 | A1 | 8/2012 | Wissmar |
| 2012/0225758 | A1 | 9/2012 | Shaw |
| 2012/0230504 | A1 | 9/2012 | Kuroda |
| 2012/0238411 | A1 | 9/2012 | McBride et al. |
| 2012/0242774 | A1 | 9/2012 | Numano et al. |
| 2012/0253489 | A1 | 10/2012 | Dugan |
| 2012/0258433 | A1 | 10/2012 | Hope et al. |
| 2012/0270705 | A1 | 10/2012 | Lo |
| 2012/0277070 | A1 | 11/2012 | Sienna |
| 2012/0283074 | A1 | 11/2012 | Hutchins |
| 2012/0293141 | A1 | 11/2012 | Zhang et al. |
| 2012/0295774 | A1 | 11/2012 | Dalebout et al. |
| 2012/0298017 | A1 | 11/2012 | Chen |
| 2012/0322625 | A1 | 12/2012 | Park |
| 2012/0322629 | A1 | 12/2012 | Webb |
| 2012/0326873 | A1 | 12/2012 | Utter, II |
| 2012/0329615 | A1 | 12/2012 | Jeong |
| 2013/0002533 | A1 | 1/2013 | Burroughs et al. |
| 2013/0018494 | A1 | 1/2013 | Amini |
| 2013/0035219 | A1 | 2/2013 | Williams |
| 2013/0053220 | A1 | 2/2013 | Monaco |
| 2013/0053222 | A1 | 2/2013 | Lo |
| 2013/0090212 | A1 | 4/2013 | Wang |
| 2013/0090216 | A1 | 4/2013 | Jackson |
| 2013/0102443 | A1 | 4/2013 | Lundquist et al. |
| 2013/0123083 | A1 | 5/2013 | Sip |
| 2013/0130868 | A1 | 5/2013 | Hou |
| 2013/0130869 | A1 | 5/2013 | Hou |
| 2013/0141235 | A1 | 6/2013 | Utter, II |
| 2013/0147411 | A1 | 6/2013 | Pang et al. |
| 2013/0150214 | A1 | 6/2013 | Wu |
| 2013/0154441 | A1 | 6/2013 | Redmond |
| 2013/0172152 | A1 | 7/2013 | Watterson |
| 2013/0178338 | A1 | 7/2013 | Ross |
| 2013/0178346 | A1 | 7/2013 | Lin |
| 2013/0185003 | A1 | 7/2013 | Carbeck et al. |
| 2013/0190136 | A1 | 7/2013 | Watterson |
| 2013/0193655 | A1 | 8/2013 | Kaye et al. |
| 2013/0196821 | A1 | 8/2013 | Watterson et al. |
| 2013/0196827 | A1 | 8/2013 | Chang |
| 2013/0225373 | A1 | 8/2013 | Poat |
| 2013/0225377 | A1 | 8/2013 | Lee et al. |
| 2013/0228063 | A1 | 9/2013 | Turner |
| 2013/0231226 | A1 | 9/2013 | Bonutti |
| 2013/0237383 | A1 | 9/2013 | Chen |
| 2013/0245966 | A1 | 9/2013 | Burroughs et al. |
| 2013/0263418 | A1 | 10/2013 | Johnson, Jr. |
| 2013/0267386 | A1 | 10/2013 | Her |
| 2013/0274067 | A1 | 10/2013 | Watterson et al. |
| 2013/0274071 | A1 | 10/2013 | Wang |
| 2013/0274074 | A1 | 10/2013 | Ghandour |
| 2013/0303334 | A1 | 11/2013 | Adhami |
| 2013/0310230 | A1 | 11/2013 | Norris |
| 2013/0337974 | A1 | 12/2013 | Yanev et al. |
| 2013/0337980 | A1 | 12/2013 | Himmelrick et al. |
| 2013/0346043 | A1 | 12/2013 | Mewes et al. |
| 2014/0011645 | A1 | 1/2014 | Johnson et al. |
| 2014/0026788 | A1 | 1/2014 | Kallio, III et al. |
| 2014/0031703 | A1 | 1/2014 | Rayner et al. |
| 2014/0056461 | A1 | 2/2014 | Afshar |
| 2014/0073488 | A1 | 3/2014 | Wu |
| 2014/0080678 | A1 | 3/2014 | Wu |
| 2014/0085077 | A1 | 3/2014 | Luna et al. |
| 2014/0106943 | A1 | 4/2014 | Simonetti |
| 2014/0106948 | A1 | 4/2014 | Agostini |
| 2014/0121066 | A1 | 5/2014 | Huang et al. |
| 2014/0121071 | A1 | 5/2014 | Strom et al. |
| 2014/0156228 | A1 | 6/2014 | Molettiere et al. |
| 2014/0162856 | A1 | 6/2014 | Kramer |
| 2014/0187383 | A1 | 7/2014 | Martin |
| 2014/0221160 | A1 | 8/2014 | Hardy et al. |
| 2014/0221175 | A1 | 8/2014 | Liu |
| 2014/0221881 | A1 | 8/2014 | Schlauder et al. |
| 2014/0222173 | A1 | 8/2014 | Giedwoyn et al. |
| 2014/0228175 | A1 | 8/2014 | Lemos et al. |
| 2014/0274564 | A1 | 9/2014 | Greenbaum |
| 2014/0274579 | A1 | 9/2014 | Olson |
| 2014/0287886 | A1 | 9/2014 | Patti |
| 2014/0309092 | A1 | 10/2014 | De Michele |
| 2014/0357457 | A1 | 12/2014 | Boekema |
| 2014/0358473 | A1 | 12/2014 | Goel et al. |
| 2014/0360413 | A1 | 12/2014 | Schenk |
| 2015/0003621 | A1 | 1/2015 | Trammell |
| 2015/0004579 | A1 | 1/2015 | Shelton |
| 2015/0016623 | A1 | 1/2015 | Trammell |
| 2015/0038300 | A1 | 2/2015 | Forhan et al. |
| 2015/0044648 | A1 | 2/2015 | White et al. |
| 2015/0065273 | A1 | 3/2015 | Lake |
| 2015/0065301 | A1 | 3/2015 | Oteman |
| 2015/0069738 | A1 | 3/2015 | Knight |
| 2015/0072842 | A1 | 3/2015 | Segal |
| 2015/0105220 | A1 | 4/2015 | Hong |
| 2015/0126348 | A1 | 5/2015 | Kaye et al. |
| 2015/0148204 | A1 | 5/2015 | Sleppy |
| 2015/0165270 | A1 | 6/2015 | Allos |
| 2015/0201722 | A1 | 7/2015 | Brouard |
| 2015/0202487 | A1 | 7/2015 | Wu |
| 2015/0209610 | A1 | 7/2015 | Dalebout et al. |
| 2015/0209617 | A1 | 7/2015 | Hsiao |
| 2015/0238801 | A1 | 8/2015 | Meredith |
| 2015/0251047 | A1 | 9/2015 | Maanitty |
| 2015/0251055 | A1 | 9/2015 | Ashby |
| 2015/0253210 | A1 | 9/2015 | Ashby et al. |
| 2015/0265903 | A1 | 9/2015 | Kolen et al. |
| 2015/0273267 | A1 | 10/2015 | Manzke |
| 2015/0283420 | A1 | 10/2015 | Chang |
| 2015/0283421 | A1 | 10/2015 | Gaylord |
| 2015/0352396 | A1 | 12/2015 | Dalebout |
| 2015/0352401 | A1 | 12/2015 | Johnson |
| 2015/0360073 | A1 | 12/2015 | Moran et al. |
| 2015/0367176 | A1 | 12/2015 | Bejestan et al. |
| 2016/0001123 | A1 | 1/2016 | Parrish, Jr. |
| 2016/0008650 | A1 | 1/2016 | Jue et al. |
| 2016/0016035 | A1 | 1/2016 | Hao |
| 2016/0027325 | A1 | 1/2016 | Malhotra |
| 2016/0047446 | A1 | 2/2016 | Hung |
| 2016/0051857 | A1 | 2/2016 | Rasner |
| 2016/0074691 | A1 | 3/2016 | Pearce et al. |
| 2016/0096064 | A1 | 4/2016 | Gatti |
| 2016/0101311 | A1 | 4/2016 | Workman |
| 2016/0121156 | A1 | 5/2016 | Bach |
| 2016/0193518 | A1 | 7/2016 | Baxter |
| 2016/0199683 | A1 | 7/2016 | Shamlin |
| 2016/0206248 | A1 | 7/2016 | Sartor et al. |
| 2016/0211841 | A1 | 7/2016 | Harrison |
| 2016/0219968 | A1 | 8/2016 | Martin |
| 2016/0256728 | A1 | 9/2016 | Tang |
| 2016/0263426 | A1 | 9/2016 | Mueller et al. |
| 2016/0278487 | A1 | 9/2016 | Postolek |
| 2016/0303421 | A1 | 10/2016 | Tyger et al. |
| 2016/0319850 | A1 | 11/2016 | Kamen et al. |
| 2016/0321075 | A1 | 11/2016 | Catherwood et al. |
| 2016/0346586 | A1 | 12/2016 | Pullins et al. |
| 2016/0346617 | A1 | 12/2016 | Sprugo |
| 2016/0367851 | A1 | 12/2016 | Astilean et al. |
| 2017/0021218 | A1 | 1/2017 | Peritz |
| 2017/0050069 | A1 | 2/2017 | Ky |
| 2017/0050074 | A1 | 2/2017 | Olson |
| 2017/0056711 | A1 | 3/2017 | Dalebout et al. |
| 2017/0056712 | A1 | 3/2017 | Johnson |
| 2017/0056715 | A1 | 3/2017 | Dalebout et al. |
| 2017/0056726 | A1 | 3/2017 | Dalebout et al. |
| 2017/0065852 | A1 | 3/2017 | Cygan et al. |
| 2017/0068782 | A1 | 3/2017 | Pillai et al. |
| 2017/0106227 | A1 | 4/2017 | Lalaoua |

(56) References Cited

U.S. PATENT DOCUMENTS

2017/0106240 A1 4/2017 Chuang
2017/0113093 A1 4/2017 Bellavista et al.
2017/0136289 A1 5/2017 Frank
2017/0136291 A1 5/2017 Huang
2017/0136339 A1 5/2017 Habiche
2017/0165523 A1 6/2017 Chou
2017/0165552 A1 6/2017 Martin
2017/0173394 A1 6/2017 Rider
2017/0189745 A1 7/2017 Hamilton et al.
2017/0197103 A1 7/2017 Rau et al.
2017/0197106 A1 7/2017 Dalebout et al.
2017/0216660 A1 8/2017 Lernihan
2017/0239509 A1 8/2017 Wang
2017/0266481 A1 9/2017 Dalebout
2017/0266483 A1 9/2017 Dalebout et al.
2017/0266503 A1 9/2017 Watterson et al.
2017/0266532 A1 9/2017 Watterson
2017/0266533 A1 9/2017 Dalebout
2017/0266534 A1 9/2017 Watterson
2017/0274237 A1 9/2017 Chang
2017/0274242 A1 9/2017 Corbalis
2017/0312580 A1 11/2017 Chang
2017/0319906 A1 11/2017 Chang et al.
2017/0326411 A1 11/2017 Watterson
2017/0367480 A1 12/2017 Dickerson et al.
2017/0368442 A1 12/2017 Baudhuin
2018/0001135 A1 1/2018 Powell
2018/0036572 A1 2/2018 Hsu
2018/0036585 A1 2/2018 Powell
2018/0056111 A1 3/2018 Chiang et al.
2018/0085622 A1 3/2018 Ivan
2018/0092603 A1 4/2018 Duan et al.
2018/0099179 A1 4/2018 Chatterton et al.
2018/0099180 A1 4/2018 Wilkinson
2018/0099181 A1 4/2018 Powell et al.
2018/0104533 A1 4/2018 Powell et al.
2018/0111018 A1 4/2018 Lee
2018/0117385 A1 5/2018 Watterson et al.
2018/0117388 A1 5/2018 Porter
2018/0117419 A1 5/2018 Jackson
2018/0140886 A1 5/2018 Hetrick et al.
2018/0147440 A1 5/2018 Lin
2018/0154205 A1 6/2018 Watterson
2018/0154208 A1 6/2018 Powell et al.
2018/0256933 A1 9/2018 Olson

* cited by examiner

BODY WEIGHT LIFT MECHANISM ON TREADMILL

RELATED APPLICATIONS

This application claims priority to U.S. Patent Application Ser. No. 62/415,933 titled "Body Weight Lift Mechanism on Treadmill" and filed on 1 Nov. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling, among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to perform an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and easily within reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes, to name a few.

One type of treadmill is disclosed in U.S. Pat. No. 7,575,537 issued to Joseph K. Ellis, et al. In this reference, an exercise treadmill is described as having an endless movable surface looped around rollers or pulleys to form an upper run and a lower run, the movable surface being rotated when one of the rollers or pulleys is rotated, and an exercise surface for walking or running while exercising, a weight resistance mechanism for providing a weight resistance for simulating the dragging or pulling of a load, wherein the weight resistance can be adjusted and set to a specific weight resistance setting; a movable hand controller operatively attached to the weight resistance mechanism for operating and controlling the exercise treadmill and the weight resistance mechanism. According to Ellis, the endless movable surface moves in a direction simulating walking or running backwards, and the weight resistance mechanism applies a constant and static force to the hand controller generally only in the same as the direction the endless movable surface moves and opposite a pulling direction. In this manner, according to Ellis, operation of the treadmill simulates the dragging or pulling of a load by a combination of the actuation of the weight resistance mechanism to simulate the load and the walking or running backwards to provide the dragging or pulling action. Other treadmills are described in U.S. Patent Publication Nos. 2007/0232463 issued to Yu Feng Wu and 2015/0352396 issued to William T. Dalebout.

SUMMARY

In one embodiment, an exercise machine includes a frame, a base portion of the frame, a deck pivotally connected at a rear end, an upright structure of the frame, a handle movably attached to the frame, and a linkage connecting the handle to the first end of the deck. An elevation of the first end of the deck changes when the handle is moved.

The exercise machine may also include a first post of the upright structure, a second post of the upright structure, an axle connecting the first post to the second post, and the handle rotates about the axle.

The first post may be connected to the base portion, the second post may be connected to the base portion, and the deck may move independent of the first and second post when the handle is moved.

The exercise machine may include a torque adjuster that changes the mechanical advantage between the handle and the linkage.

The exercise machine may include a connection plate, an opening defined in the connection plate, and the axle may be disposed within the opening.

The exercise machine may include linkage slots defined in the connection plate where the linkage slots selectively connect to an end of the linkage.

The linkage slots may be arranged in a generally linear arrangement.

The linkage may be pivotally connected to the first end of the deck.

The exercise machine may include handling slots defined in the connection plate where the handle slots selectively connect to at least one of the handles.

The handle slots may be arranged in a generally semicircular arrangement.

The exercise machine may include a sleeve disposed about the axle and at least one of the handles may be rigidly connected to the sleeve.

The exercise machine may include a locking assembly, a housing of the locking assembly rigidly connected to the sleeve, and a retractable pin of the locking assembly partially disposed within an aperture of the housing.

The retractable pin may be aligned with at least one of the handle slots by rotating the sleeve.

The exercise machine may be a treadmill.

In one embodiment, a treadmill includes a frame, a base portion of the frame, a deck pivotally connected to the frame at a rear end, a first pulley at a first end of the deck, a second pulley at a second end of the deck, a tread belt surrounding the first pulley and the second pulley, an upright structure of the frame, a handle movably attached to the frame, a linkage connecting the handle to the first end of the deck, wherein an elevation of the first end of the deck changes when the handle is moved, a first post of the upright structure, a second post of the upright structure, an axle connecting the first post to the second post where the handle rotates about the axle when the handle rotates, the first post is connected to the base portion, the second post is connected to the base portion, the deck moves independent of the first and second post when the handle is moved, and a torque adjuster that changes the mechanical advantage between the handle and the linkage.

The treadmill may also include a connection plate, an opening defined in the connection plate, and the axle may be disposed within the opening.

The treadmill may include linkage slots defined in the connection plate where the linkage slots may selectively connect to an end of the linkage.

The exercise machine may include handling slots defined in the connection plate where the handle slots selectively connect to at least one of the handles.

The exercise machine may include a sleeve disposed about the axle and at least one of the handles may be rigidly connected to the sleeve.

In one embodiment, a treadmill includes a frame, a base portion of the frame, a deck pivotally connected to the frame at a rear end, a first pulley at a first end of the deck, a second pulley at a second end of the deck, a tread belt surrounding the first pulley and the second pulley, an upright structure of the frame, a handle movably attached to the frame, a linkage connecting the handle to the first end of the deck, wherein an elevation of the first end of the deck changes when the handle is moved, a first post of the upright structure, a second post of the upright structure, an axle connecting the first post to the second post, the handle rotates about the axle when the handle rotates, the first post is connected to the base portion, the second post is connected to the base portion, the deck moves independent of the first and second post when the handle is moved, a torque adjuster that changes the mechanical advantage between the handle and the linkage, a connection plate of the torque adjuster, an opening defined in the connection plate, the axle being disposed within the opening, linkage slots defined in the plate, wherein the linkage slots selectively connect to an end of the linkage, handle slots defined in the plate, wherein the handle slots selectively connect to at least one of the handles, a sleeve disposed about the axle, at least one of the handles being rigidly connected to the sleeve, a locking assembly, a housing of the locking assembly rigidly connected to the sleeve, and a retractable pin of the locking assembly partially disposed within an aperture of the housing.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Additionally, for purposes of this disclosure, the term "width" means the dimension of an object from side to side. Often, the width of an object is transverse the object's length. Further, for purposes of this disclosure, the term "post" generally refers to an upright structural member.

Figure 1:
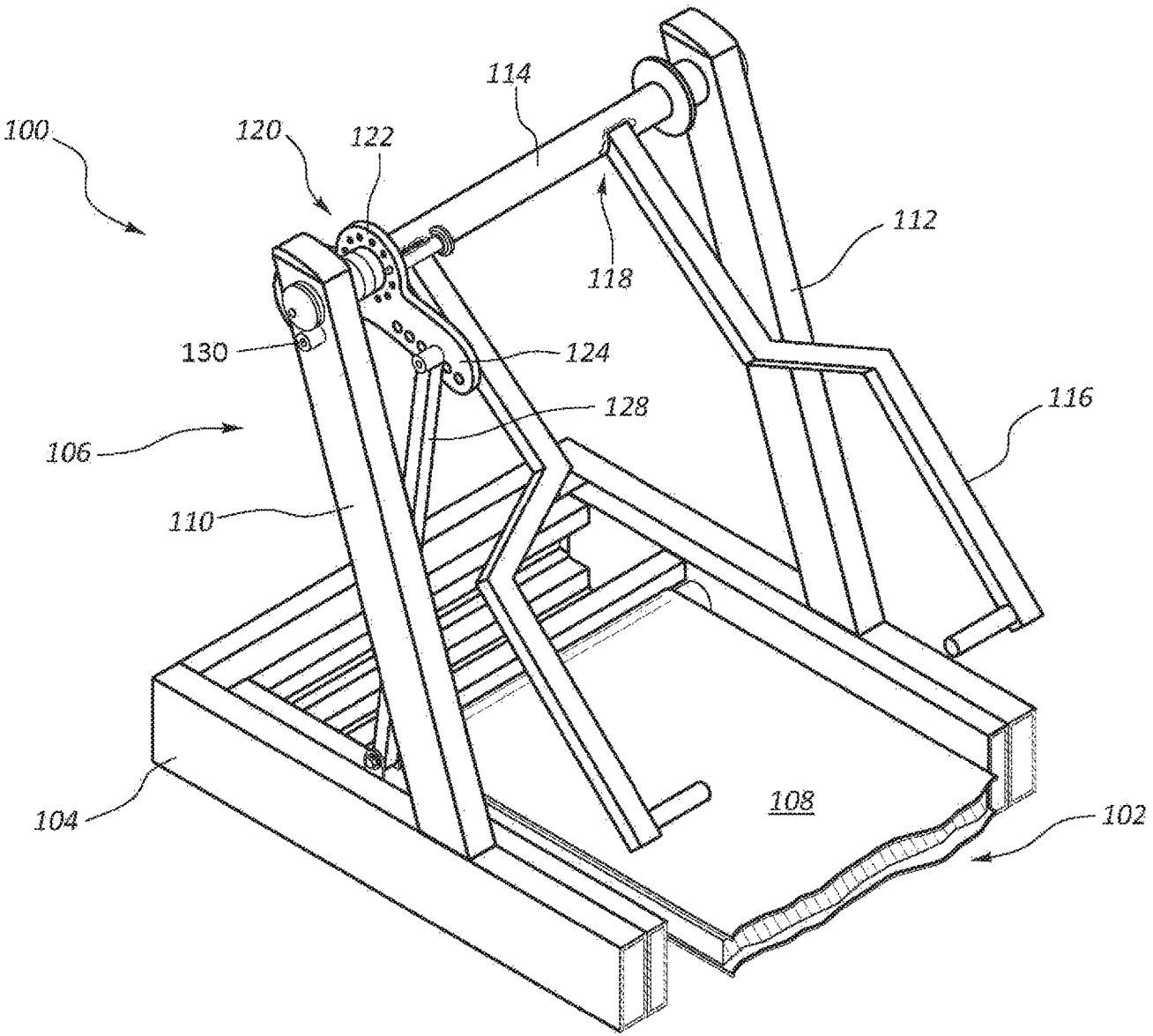
FIG. 1 depicts a cross-sectional perspective view of an example of an exercise machine in accordance with aspects of the present disclosure.

FIG. 1 depicts a cross-sectional view of an example of a treadmill 100 that includes a deck 102, a base 104, and an upright structure 106. The deck 102 includes a front pulley connected to a front portion, and a rear pulley connected to a rear portion. A tread belt 108 surrounds a portion of the deck, the front pulley, and the second pulley. A motor (not shown) can drive either the front pulley or the rear pulley and cause the tread belt 108 to move along a surface of the deck 102. The deck 102 may be movably connected to the base 104. For example, the deck may be pivotally connected at a rear portion of the base 104.

In this example, the upright structure 106 includes a first post 110 and a second post 112. The first post 110 and the second post 112 support an axle 114 that spans from the first post 110 to the second post 112. A pair of handles 116 is connected to the axle 114. In this example, the handles 116 protrude away from the axle 114 and are angled towards the deck 102. A user can move the handles 116 so that the connecting end 118 of the handles 116 rotates about the axle 114.

A torque adjuster 120 is rigidly connected to the handles 116 so that when a user moves the handles 116, the torque adjuster 120 rotates with the handles 116. In this example, the torque adjuster 120 includes multiple openings. A first subset of openings are the handle openings 122. These handle openings 122 are used to interlock the handles 116 to the torque adjuster 120. The angle at which the handles 116 protrude away from the axle 114 depends on which of the handle openings is interlocked with the handles 116.

A second subset of openings defined in the torque adjuster 120 are linkage slots 124. The linkage slots are spaced along the bottom side of the torque adjuster 120 and selectively interlock with a linkage 128. The linkage 128 may connect the torque adjuster 120 to the deck 102. As the user moves the handles 116, the torque adjuster 120 rotates with the handles 116. As the torque adjuster 120 rotates, the linkage moves with the torque adjuster 120 resulting in movement of the deck. For example, when a user lifts up on the handles 116, the front portion of the deck 102 moves up. Similarly, when the user moves the handles 116 downward, the deck 102 is also lowered.

A deck pin 130 is incorporated into at least one of the first post 110 and the second post 112. The deck pin 130 is movably retained in the post and can selectively interlock with the connection plate. The deck pin 130 may be insertable into any desired opening of the connection plate. With the deck pin 130 interlocked with the connection plate, the connection plate is selectively locked into place with respect to the post. As a result, the angle of the deck may be locked in place. In some cases, the handles may be disengageable from the connection plate. When the handles are interlocked with the connection plate and the deck pin is interlocked with the connection plate, then the handles may be locked in place. But, in those circumstances where the handles are disconnected from the connection plate, the handles may be moveable without affecting the orientation of the deck.

Figure 2:
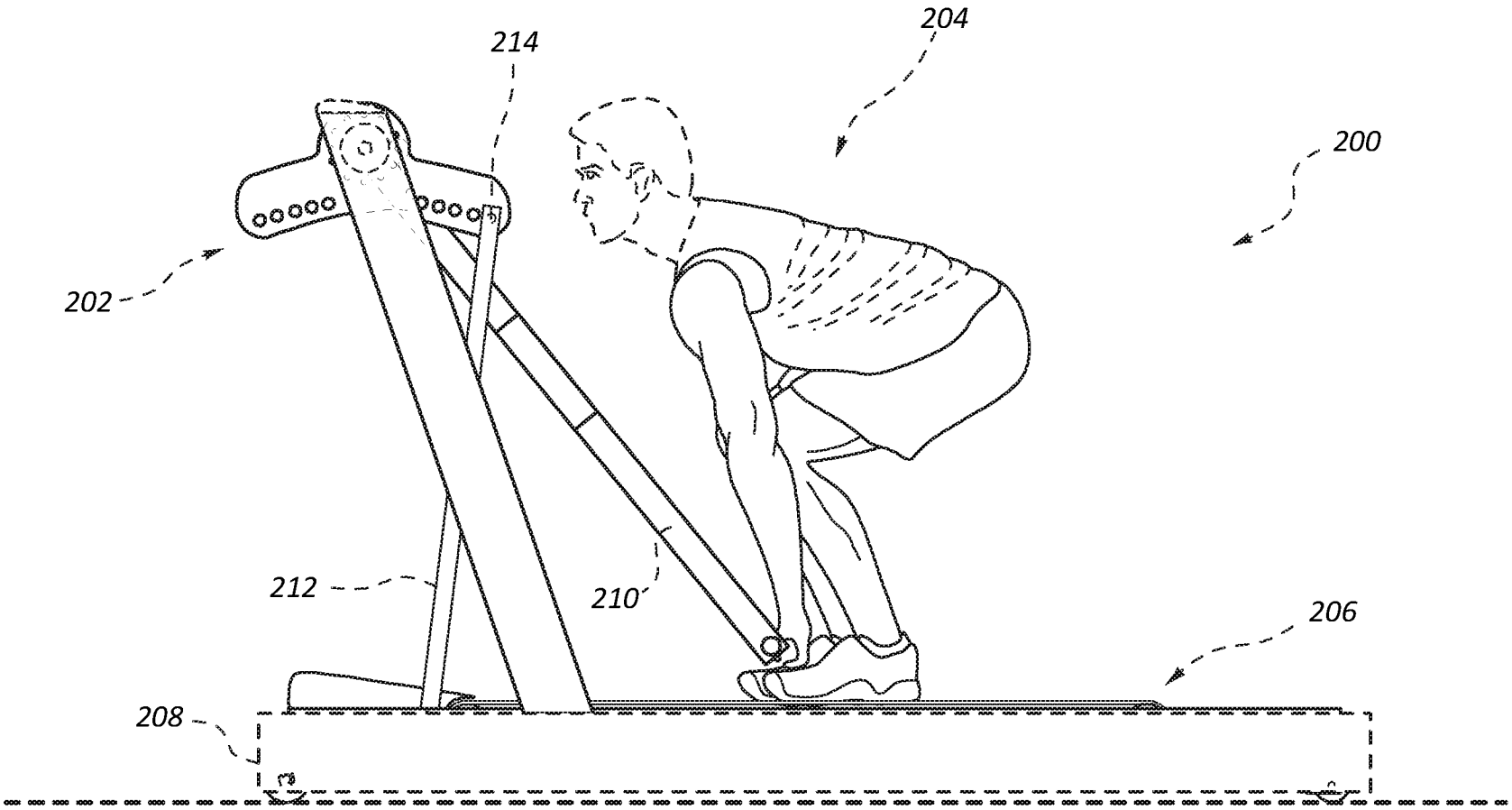
FIG. 2 depicts a side view of an example of an exercise machine in accordance with aspects of the present disclosure.

FIG. 2 illustrates an example of a treadmill 200 with a body weight lift mechanism 202. In this example, a user 204 stands on the deck 206 of a treadmill 200 in a hunched position. The deck 206 is aligned with the base 208 of the treadmill 200. The handles 210 are angled downwards towards the deck 206. The linkage 212 is connected to the linkage slot 214 nearest to the user 204.

Figure 3:
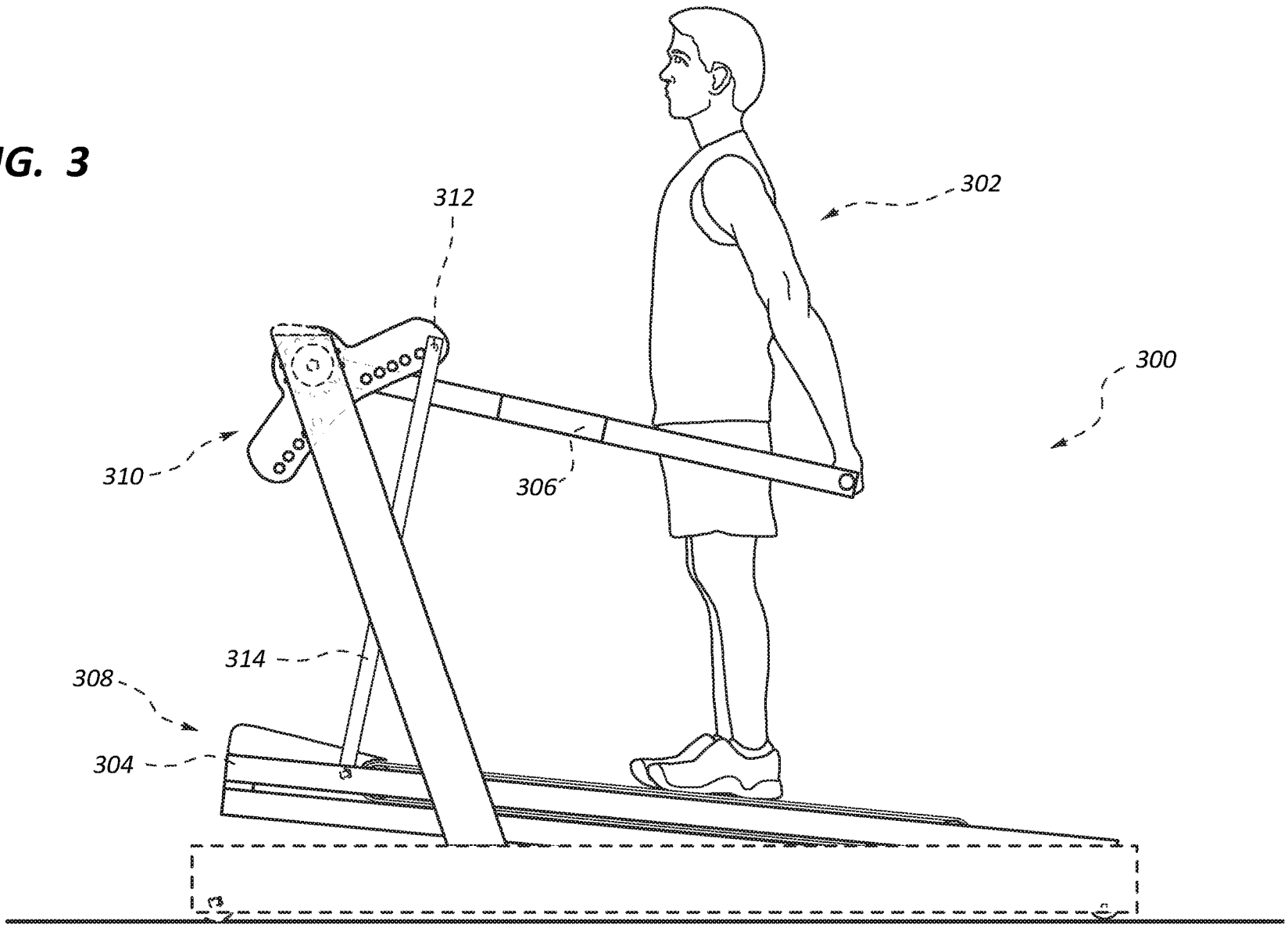
FIG. 3 depicts a side view of an example of an exercise machine in accordance with aspects of the present disclosure.

FIG. 3 illustrates an example of a treadmill 300 with the body lift mechanism. In this example, the user 302 is standing on the deck 304 in an upright position after having been in the hunched position. The user 302 continues to hold the handles 306 while transitioning from the hunched position to the upright position. As the user 302 stands, the handles 306 are lifted from a lower elevation to a higher elevation 308. As the handles 306 rotate, the torque adjuster 310 is also rotated upwards, which applies an upward force on the linkage slot 312 interlocked with the linkage 314. As a result, the linkage 314 and the front portion of the deck 304 are also lifted upwards. With the user 302 standing on the deck 304, the user's body weight provides resistance to lifting the deck 304.

Figure 4:
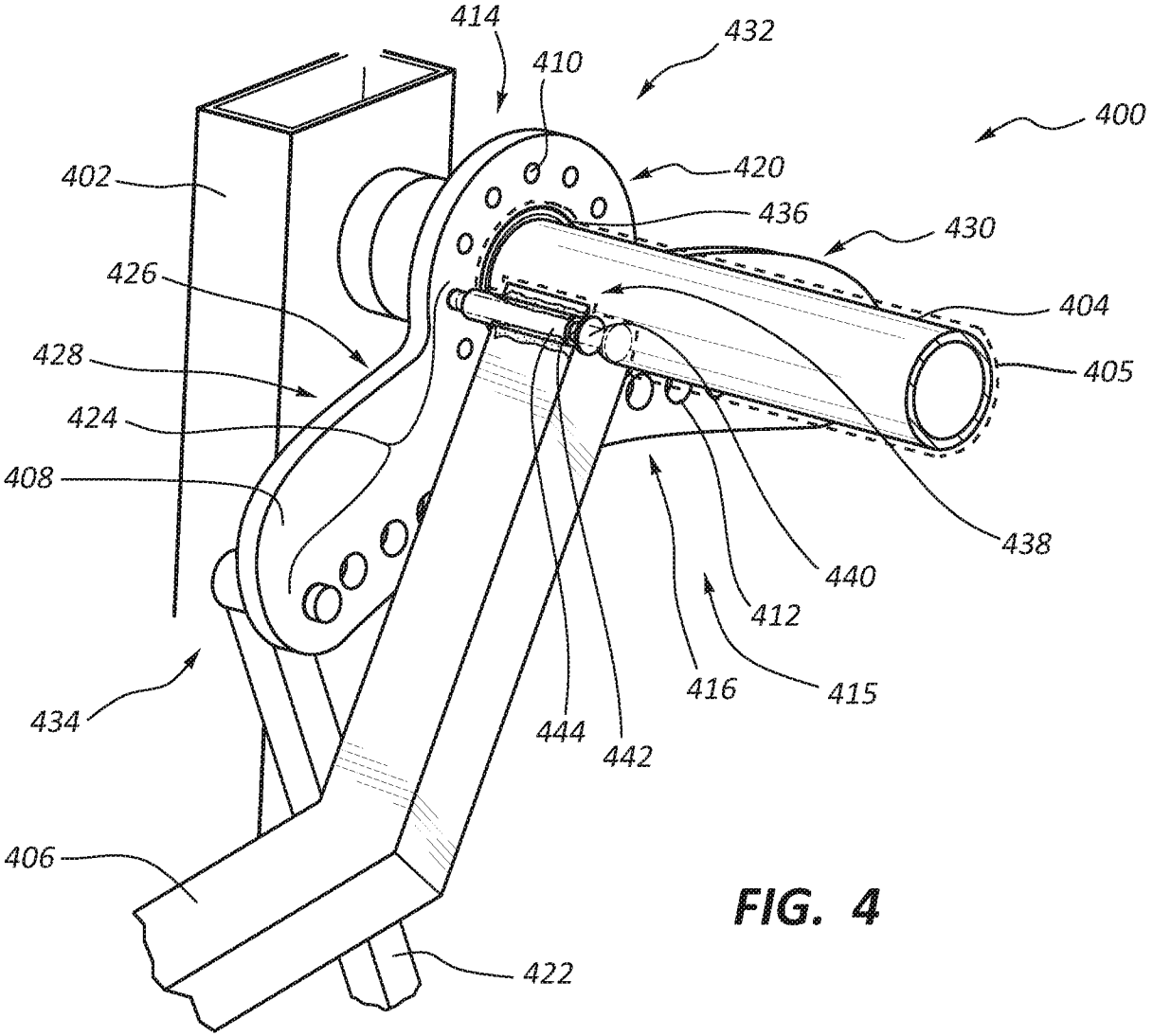
FIG. 4 depicts a perspective view of an example of a torque adjuster in accordance with aspects of the present disclosure.

FIG. 4 illustrates an example of a torque adjuster 400 of the body weight lift mechanism. In this example, the upright structure's post 402 is connected to the axle 404. The handles 406 may be rigidly connected to the axle 404. In this example, the torque adjuster 400 is rotationally independent of the axle so that the torque adjuster 400 can rotate about the axle 404. In another example, the handles 406 may be connected to a sleeve 405 disposed about the axle 404. In those examples with a sleeve, the torque adjuster 400 may be rigidly connected to the sleeve so that the torque adjuster 400 is rotationally independent of the axle 404.

The torque adjuster 400 includes a connection plate 408. In this example, the connection plate 408 includes handle openings 410 and linkage slots 412. The handle openings 410 are located in an upper portion 414 of the connection plate 408, and the linkage slots 412 are located in a lower portion 415 of the connection plate 408.

In the illustrated example, the handle openings 410 are connected to a first end 416 of the handle 406. The handle 406 extends away from the axle 404 towards the user standing on the deck. The user can grip the second end of the handles 406 while standing on the deck. As the user pulls up on the second end of the handle 406, the connection plate 408 is rotated around the axle 404.

The handle openings 410 are located within a medial region 420 of the connection plate 408. The lower portion 415 of the connection plate 408 has a length that is greater than a length of the plate's upper portion 414. Thus, the lower portion 415 extends beyond the upper portion 414 lengthwise. The linkage slots 412 are distributed from side to side on the lower portion 415 of the connection plate 408. As a result, the linkage slots 412 extend beyond the plate's medial region 420 and therefore extend beyond the handle openings. The distance between the handle opening 410 connected to the handle 406 and the linkage slot 412 connected to the linkage 422 defines a torque length 424 or moment arm. The greater the distance between these openings, the greater the torque length. In some examples, there is a negative relationship between the difficulty of lifting the handle 406 and the torque length 424 so that the shorter the torque length the greater load required to lift the deck.

The connection plate 408 has two groups of linkage slots 412. The first group 426 is on the user side 428 of the connection plate 408. The second group 430 of linkage slots 412 is on the far side 432 of the connection plate 408. The first group 426 and the second group 430 are separated by the axle 404. In some examples, when the user lifts up on the handle 406, the user side 428 of the connection plate 408 rotates in an upward direction and the far side 432 of the connection plate moves in a downward direction. Thus, in these types of examples, the user may connect the linkage 422 to the linkage slots 412 in the user side 428 when desiring to perform an exercise that exerts energy in the upward direction. In this example, the deck will be raised as the user lifts up on the handle 406. In other cases, when the user desires to perform an exercise that involves exerting a downward force, the user may connect the linkage 422 into the linkage slots 412 on the far side 432 of the connection plate 408.

The linkage 422 includes a first end 434 and a second end. The first end 434 may be connected to the connection plate 408, and the second end may be connected to the deck.

In this example, the connection plate 408 includes an axle opening 436, and the axle 404 is partially disposed within the axle opening 436. The handle openings 410 are disposed about the axle opening 436. The axle 404 is supported by the first post 402 and the second post (not shown in FIG. 4).

In the illustrated example, a locking assembly 438 is connected to the handle 406. The locking assembly 438 may include a retractable pin 440 that is located within a channel 442 of the handle 406. In the illustrated example, the channel 442 is defined within a column 444 (e.g., a housing) attached to the handle 406. In this example, the column 444 is welded to the outer surface of the handle 406. Alternatively, the channel 442 may be defined in a thickness of the handle 406. In some cases, the retractable pin 440 may be spring loaded or otherwise biased to keep the retractable pin 440 in an extended position when at rest. While this example depicts the channel being directly connected to the handle 406, in other examples, the channel is formed or otherwise attached to the axle 404.

FIG. 4 also depicts the first end 434 of the linkage 422 being connected within a linkage slot 412. The connection between the linkage 422 and the linkage slot 412 may also include a retractable pin, but any appropriate type of connection mechanism may be used in accordance with the principles of the present disclosure.

Figure 5:
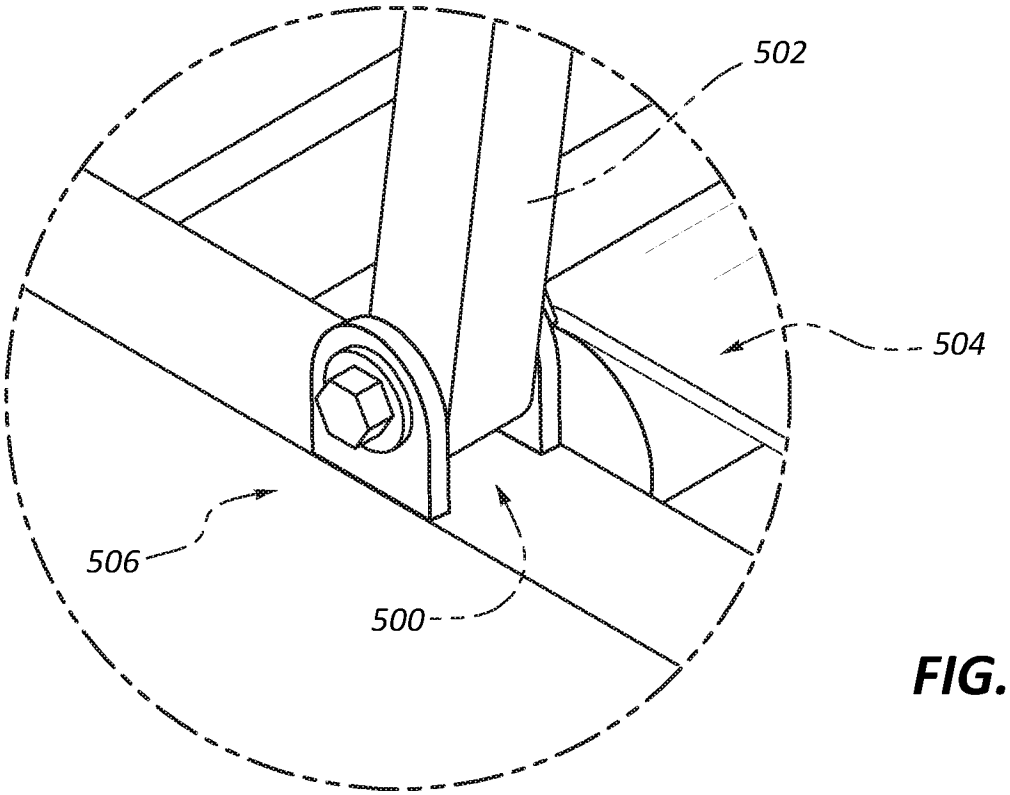
FIG. 5 depicts a perspective view of an example of a connection between a deck and linkage of an exercise machine in accordance with aspects of the present disclosure.

FIG. 5 depicts an example of the second end 500 of the linkage 502 being attached to the deck 504. This connection 506 is a rotatable connection to accommodate the angle changes between the linkage 502 and the deck 504 as the linkage 502 moves the deck 504.

Figure 6:
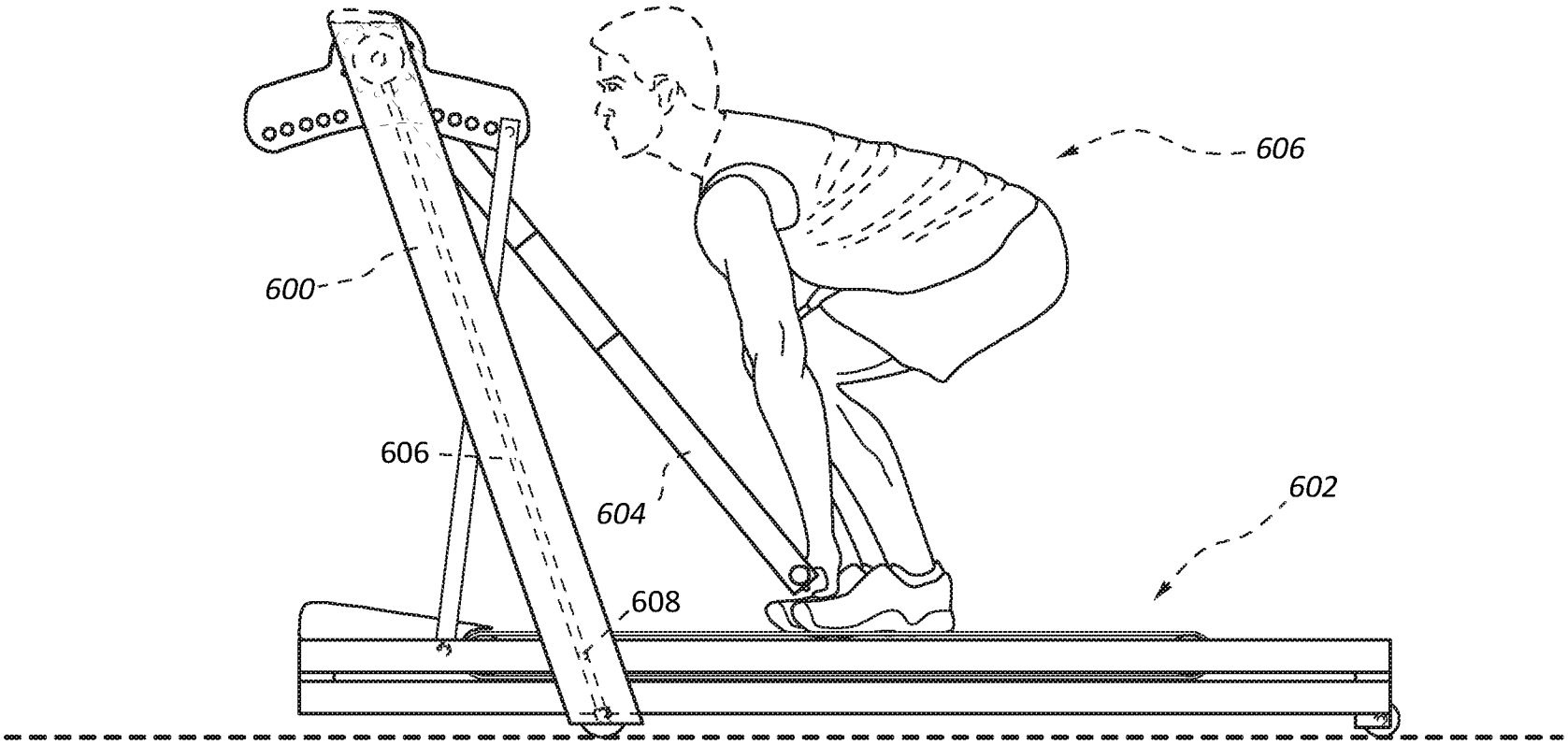
FIG. 6 depicts a side view of an example of an exercise machine in accordance with aspects of the present disclosure.

FIG. 6 depicts an alternative example where the first post 600 and the second post are not rigidly connected to a base frame. In this example, the deck 602 is raised and lowered by the movement of the handles 604, and the deck moves independently of the first and second posts. In the illustrated example, the user 606 is in a hunched position and gripping the handles 604. In this example, a track 606 is defined along the length of the posts 600. A guide 608 of the deck 602 is fitted within the track 606. As the user causes the deck 602 to move, the guide 608 stabilizes the movement of the deck 602 with respect to the posts 600.

Figure 7:
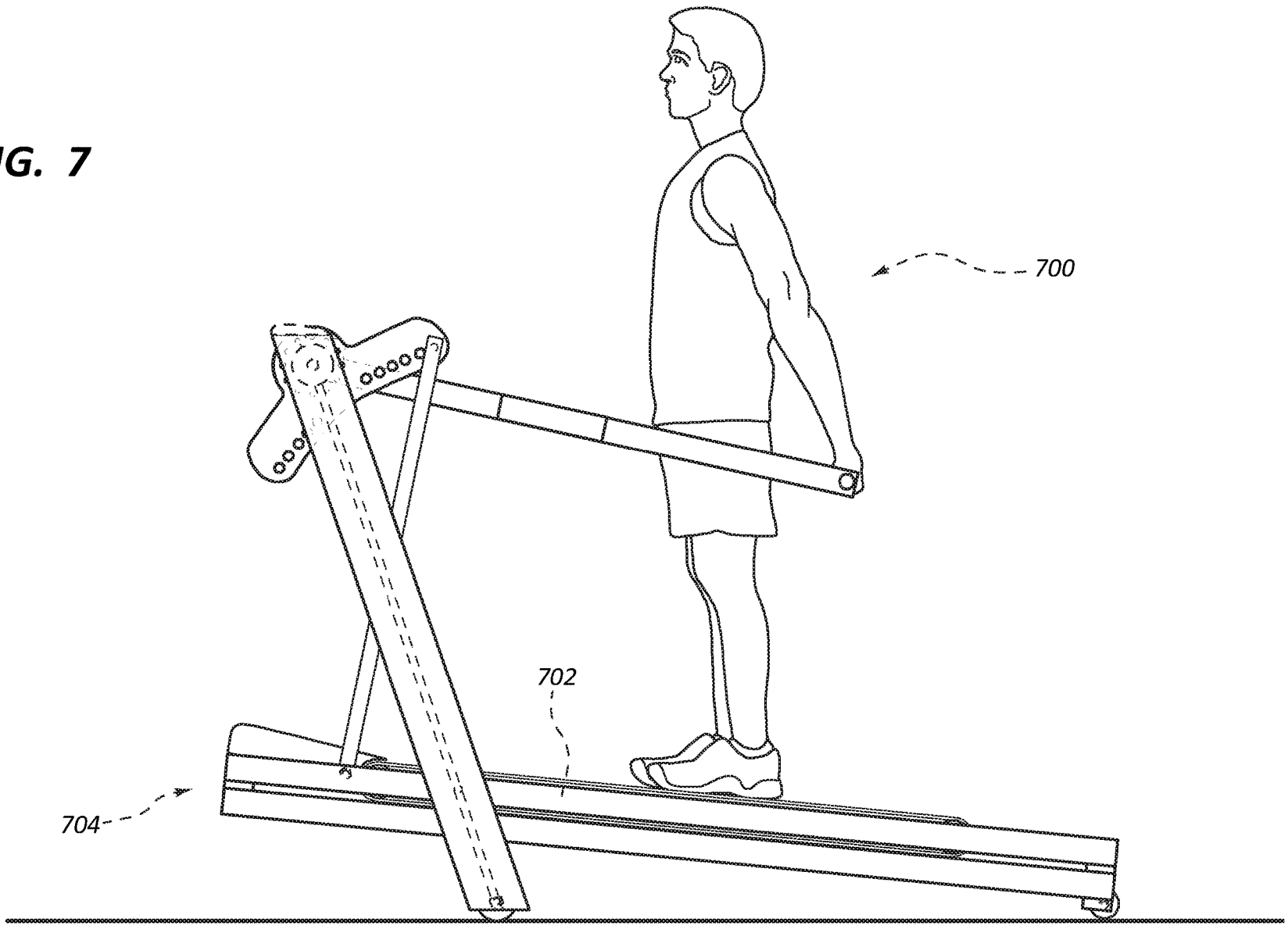
FIG. 7 depicts a side view of an example of an exercise machine in accordance with aspects of the present disclosure.

FIG. 7 depicts the alternative example with the user 700 standing upright on the deck 702 and with the deck 702 pulled up to an elevated position 704.

Figure 8:
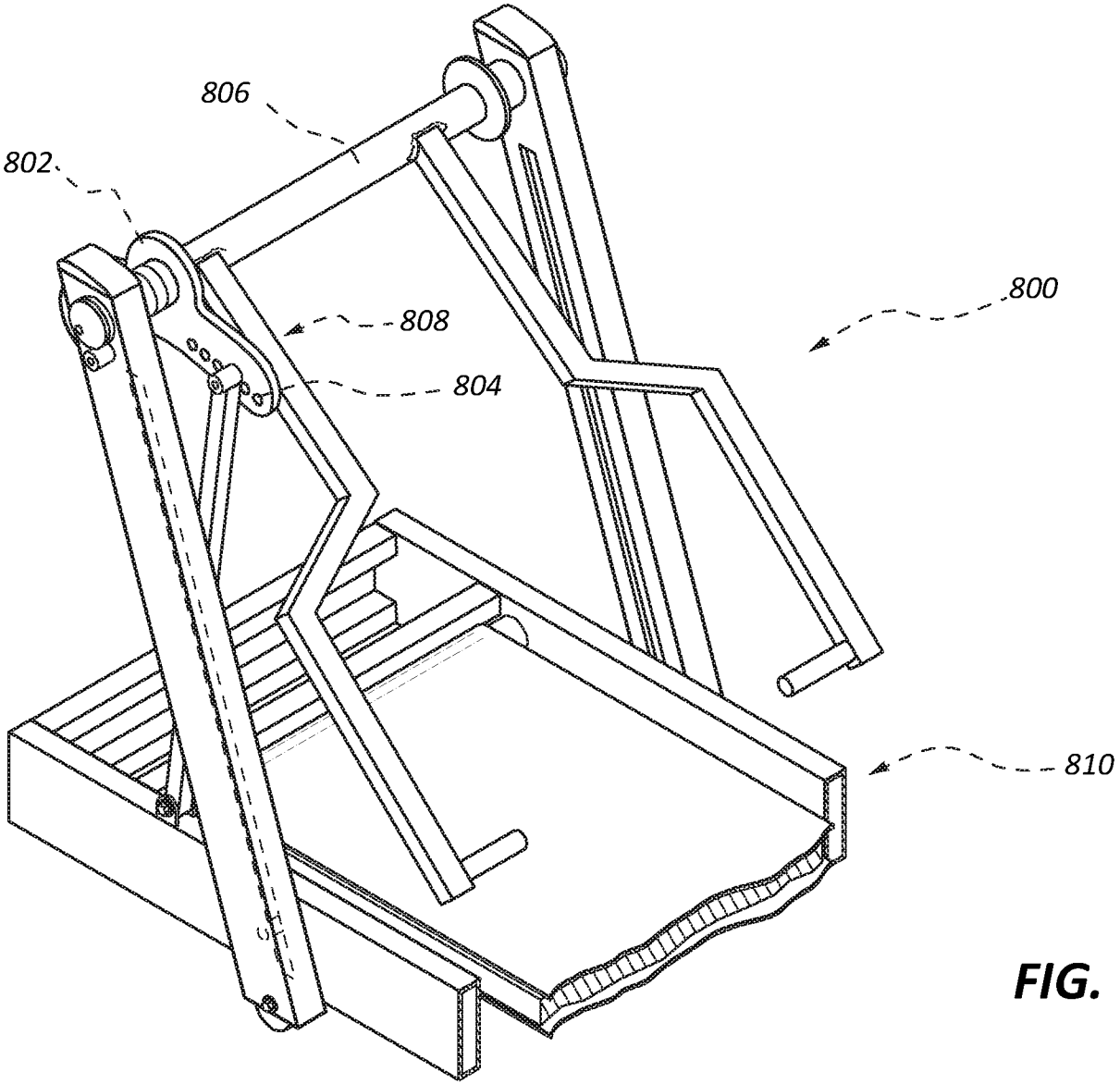
FIG. 8 depicts a perspective cross-sectional view of an example of an exercise machine in accordance with aspects of the present disclosure.

FIG. 8 depicts an example of the treadmill 800 with an alternative connection plate 802. In this example, the connection plate 802 includes just linkage slots 804 without the handle openings. In this example, the torque length is measured between the axle 806 and the connected linkage slot 804. Further, the connection plate 802 includes a fewer number of linkage slots 804 than depicted in the other examples. In this case, linkage slots 804 are only depicted on the user side 808 of the connection plate 802.

In the illustrated example, the treadmill 800 includes a single connection plate 802 on a single side of the treadmill 800. In alternative examples, the treadmill includes multiple connection plates 802. For example, a connection plate may be included on both side of the treadmill so that the loads generated from lifting the deck 810 are equalized on both sides of the deck 810.

Figure 9:
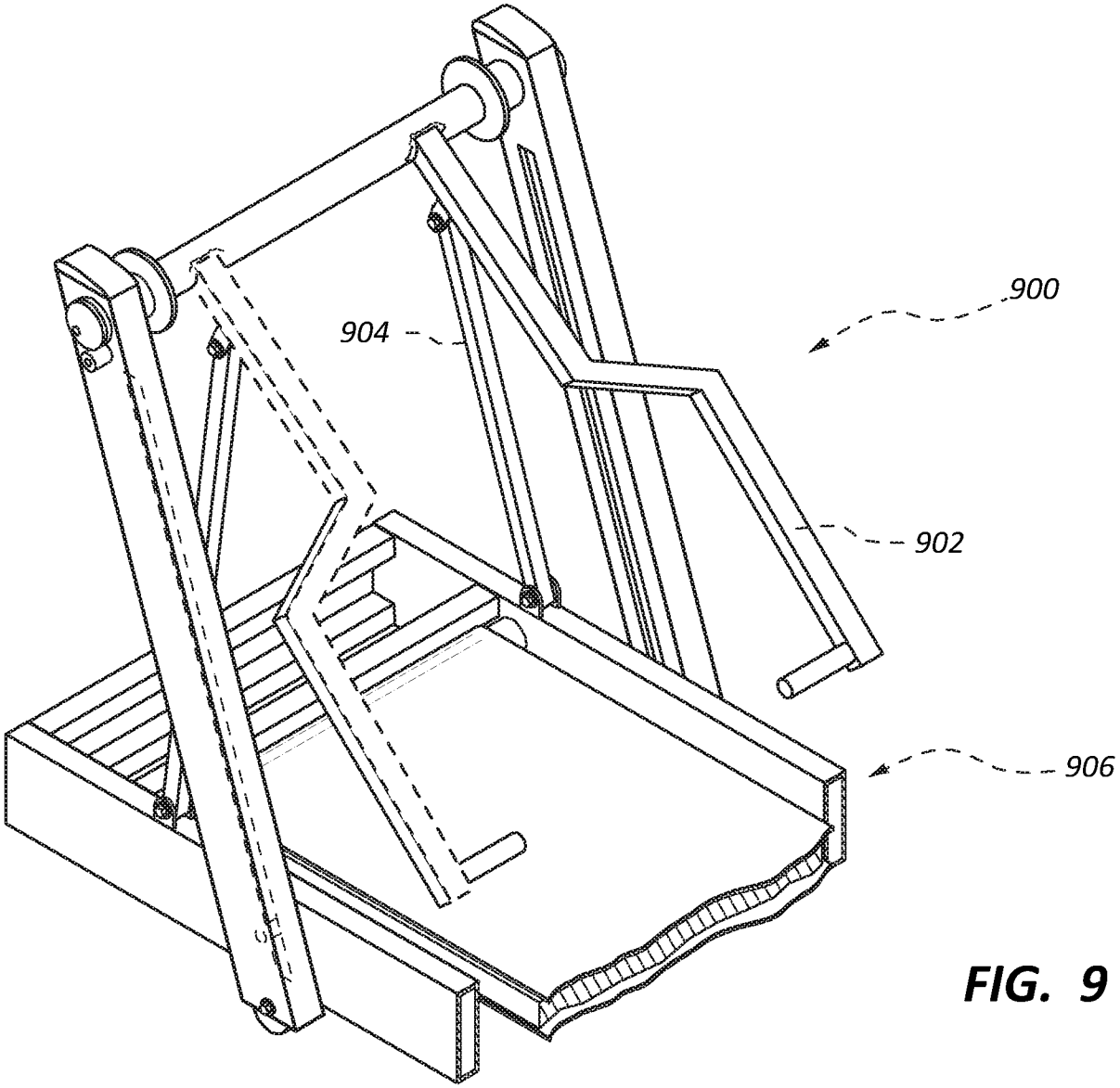
FIG. 9 depicts a perspective cross-sectional view of an example of an exercise machine in accordance with aspects of the present disclosure.

FIG. 9 depicts an example of the treadmill 900 where no torque adjuster is included between the handle 902 and the linkage 904. The treadmill 900 still includes the handle 902 which is indirectly connected to the deck 906 so that the deck position changes as the handle 902 is moved.

Figure 10:
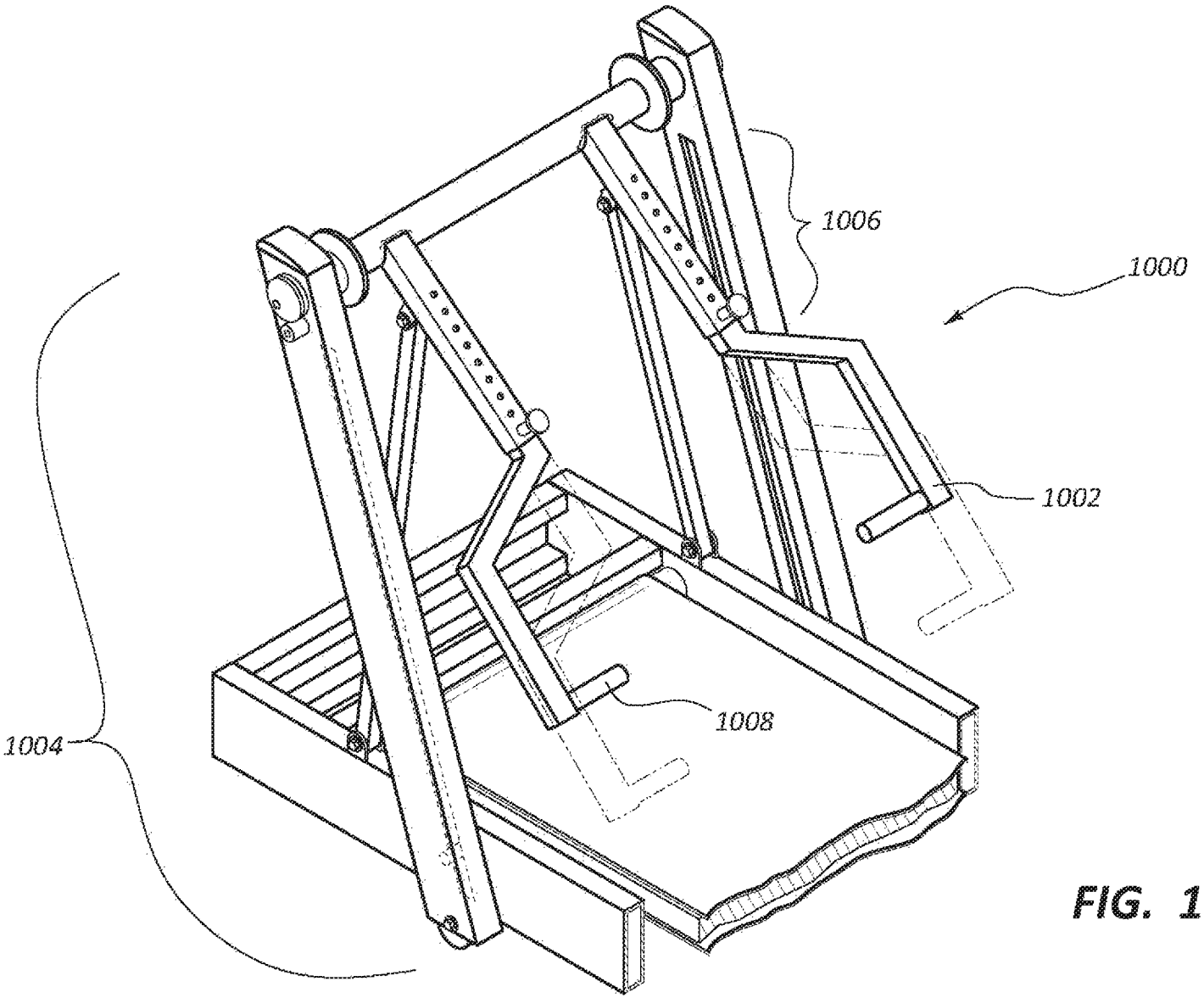
FIG. 10 depicts a perspective cross-sectional view of an example of an exercise machine in accordance with aspects of the present disclosure.

FIG. 10 depicts an example of a treadmill 1000 with handles 1002 that have an adjustable length 1004. In this example, the handles 1002 may include a telescoping portion 1006. The position of the handles' second end 1008 depends on the length of the telescoping portion. In some examples, the longer the telescoping portion, the farther away the handles' second ends are located from the axle. The farther away the handles' second ends are, the easier it may be to lift the deck.

Figure 11:
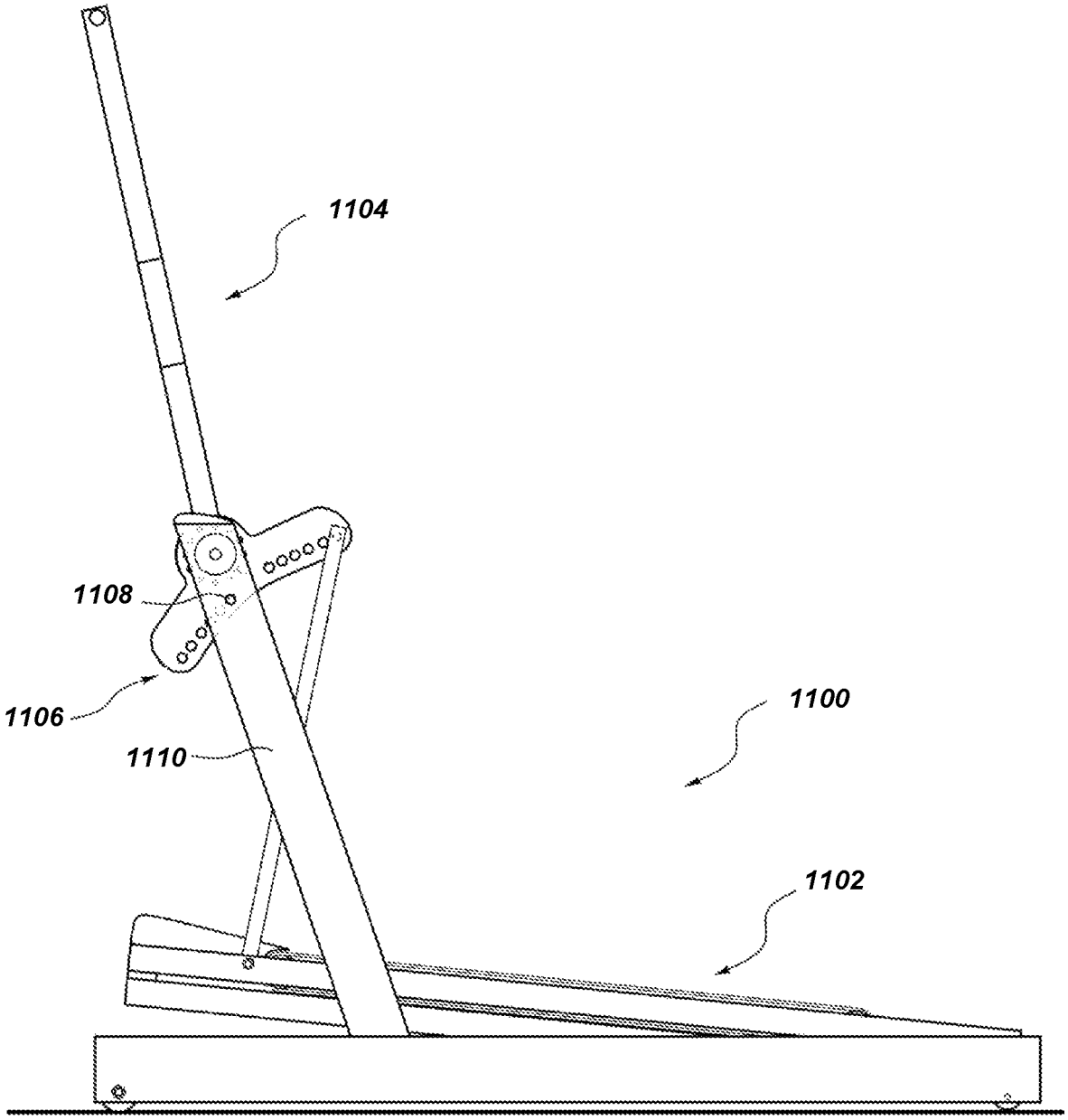
FIG. 11 depicts a side view of an example of an exercise machine in accordance with aspects of the present disclosure.

FIG. 11 illustrates an example of a treadmill 1100 with the body lift mechanism. In this example, the angle of the deck 1102 can be oriented into an upright position independent of the orientation of the handle 1104. The handles 1104 can be disconnected from the connection plate 1106 by moving the retracted pin (440, FIG. 4). With the handles disconnected, the handles can rotate about the axle to any appropriate location without affecting the deck's angle.

A deck pin 1108 incorporated into the posts 1110 may interlock with the connection plate 1106. The deck pin 1108 may be incorporated into any appropriate opening defined in the connection plate 1106. As described above, the deck's angle is affected by the angle of the connection plate 1106. Thus, as the connection plate 1106 is moved so that the deck pin 1108 is connected into the desired opening, the deck angle also changes. With the deck pin 1108 secured to the connection plate 1106, the deck angle is locked in place. In some examples, a user moves the connection plate 1106 so that the deck is oriented at the desired angle. While the deck is at the desired angle, the deck pin is inserted into the desired opening to lock the deck at the desired angle. With the deck at the desired angle, the retractable pin is retracted thereby unlocking the handles to rotate about the axle. With the handles freed, the handles can be rotated out of the way from the deck.

Figure 12:
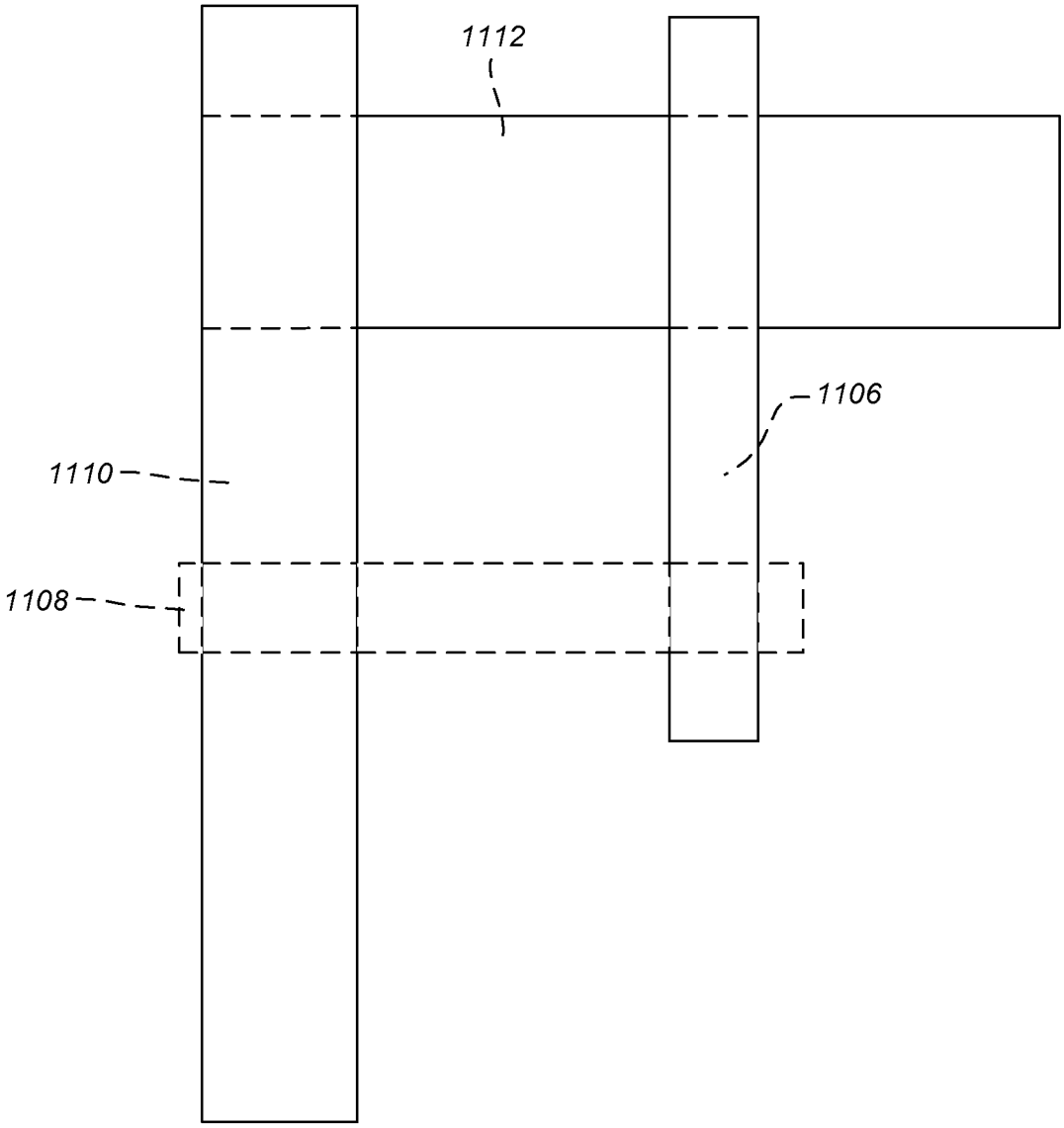
FIG. 12 depicts a cross-sectional view of an example of an exercise machine in accordance with aspects of the present disclosure.

FIG. 12 illustrates a cross section view of the treadmill 1100 depicted in FIG. 11. In this example, the deck pin 1108 is incorporated into the post 1110 and interlocks with the connection plate 1106. The deck pin 1108 may be incorporated into any appropriate opening defined in the connection plate 1106. With the deck pin 1108 secured to the connection plate 1106, the deck angle is locked in place. In some examples, the deck pin 1108 is aligned with the axle 1112 that rotationally connects the post 1110 to the connection plate 1106.

GENERAL DESCRIPTION

In general, the invention disclosed herein may provide users with a treadmill that allows the user to simultaneously or separately perform aerobic exercises as well as lifting exercises. The user's own body weight can provide the resistance to the lifting exercises. In some cases, the mechanical advantage of the lifting mechanisms can be adjusted allowing the user to have a different amount of resistance for different types of lifting exercises. In some cases, the user's own body weight may be too much for the user, so the user can adjust the mechanical advantage to lower the amount of resistance needed to perform the lifting exercise. In some cases, the exercise machine may be used for pushing exercises that involve pushing the handles towards to the deck.

At least one handle may be connected to an upright structure of the exercise machine. The handle may be indirectly connected to the deck so that when the handle is moved that the deck's elevation is changed. The handle may be located so that the user can conveniently grasp the handle when the user is standing on the deck.

The deck may include a first pulley located in a front portion of the deck and a second pulley located in a rear portion of the deck. A tread belt may surround the first and second pulleys and provide a surface on which the user may exercise. At least one of the first pulley and the second pulley may be connected to a motor so that when the motor is active, the pulley rotates. As the pulley rotates, the tread belt moves as well. The user may exercise by walking, running, or cycling on the tread belt's moving surface. In other examples, the tread belt is moved with the user's own power. In these situations, the tread belt may move as the user pushes off of the tread belt with his or her feet while walking or running. A flywheel may be connected to the tread belt and/or one of the pulleys to maintain the tread belt's momentum under the user's power.

The deck may be capable of having its front portion raised and lowered as well as its rear portion raised and lowered to control the lengthwise slope of the running deck when the tread belt is moving. The lengthwise slope of the deck may be controlled electronically through controls located in the treadmill or through instructions received from a wireless device. With these elevation controls, the orientation of the running deck can be adjusted as desired by the user or as instructed by a programmed workout. In those examples where the treadmill simulates a route that involves changes in elevation, the running deck can be oriented to mimic the elevation changes in the route while the user performs an exercise on the deck.

In one example, the lengthwise slope and/or lateral tilt angle of the deck can be controlled with one or more actuators, often linear actuators, positioned at the corners of the deck. In another example, a single linear actuator positioned underneath the deck is attached to the deck's underside and a base of the deck. In this example, when the single linear actuator extends, the single linear actuator increases the incline angle of the deck and when the single linear actuator retracts, the single linear actuator decreases the incline angle of the deck. In yet other examples, multiple actuators are used to adjust the incline angle simultaneously. Other types of actuators may be used, such as cam surfaces, magnets, hydraulic actuators, pneumatic actuators, other types of actuators, or combinations thereof. Thus, in response to determining that the running deck's orientation should change, a signal can be sent to the actuators to appropriately move the deck into the desired orientation. The signal may come from the user's input, a simulated environment, a programmed workout, a remote device, another type of device or program, or combinations thereof.

In some examples where actuators change the slope of the deck, the deck may be detachable from the actuators when the user is performing the lifting exercises. In other examples, the actuators may move with the deck as the user performs lifting exercises with the deck by moving the handles.

In some cases, the user may change the elevation of the front portion of the deck while the user is running by moving the handles. The user may desire to do repetitive lifts while running. In other examples, the user may desire to change the elevation of the deck while running. The user may accomplish this by moving the handles to a desired elevation and locking the handles in place. With the handles locked in place, the elevation of the deck will be fixed. Thus, the user may change the slope of the deck for aerobic exercises with the use of the handle.

In another example, the deck's angle of orientation can be changed independent of the orientation of the handle. The handles can be disconnected from the connection plate by moving the retracted pin away from the connection plate. With the handles disconnected, the handles can rotate about the axle to any appropriate location without affecting the deck's angle.

A deck pin incorporated into the posts may interlock with the connection plate. The deck pin may be incorporated into any appropriate opening formed in the connection plate. As described above, the deck's angle is affected by the angle of the connection plate. Thus, as the connection plate is moved so that the deck pin is aligned for insertion into the desired opening, the deck angle also changes. With the deck pin secured to the connection plate, the deck angle is locked in place. In some examples, a user moves the connection plate so that the deck is oriented at the desired angle. While the deck is at the desired angle, the deck pin is inserted into the desired opening thereby locking the deck at the desired angle. With the deck at the desired angle, the retractable pin may be retracted away from the connection plate thereby unlocking the handles from the connection plate, which frees the handles for rotation about the axle. With the handles freed, the handles can be moved out of the way from the deck. In this example, a user may exercise on the deck at an inclined angle without the handles in the user's immediate vicinity.

The treadmill may include a console attached to an upright structure of the treadmill. In some cases, the upright structure includes a first post adjacent to a first side of the deck and a second post adjacent to a second side of the deck. In this example, the console is supported by the first and second posts. The deck moves independently of the first and second posts and also moves independently of the console.

The console may locate a display screen and the treadmill's controls within a convenient reach of the user to control the operating parameters of the deck. For example, the console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the console, monitor the user's heart rate or other physiological parameters during the workout, perform other tasks, or combinations thereof. Buttons, levers, touch screens, voice commands, or other mechanisms may be incorporated into the console and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The treadmill may include preprogrammed workouts that simulate an outdoor route. In other examples, the treadmill has the capability of depicting a real world route. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulated route is on a downward slope, the rear portion of the running deck may be caused to elevate to simulate the decline in the route. Also, if the route has a lateral tilt angle, the running deck may be tilted laterally to the appropriate side of the running deck to mimic the lateral tilt angle.

While the programmed workout or the simulated environment may send control signals to orient the deck, the user may, in some instances, override these programmed control signals by manually inputting controls through the console. For example, if the programmed workout or the simulated environment cause the deck to be steeper than the user desires, the user can adjust the deck's orientation with the controls in the console.

In one example, the upright structure includes a first post and a second post. The first post and the second post support an axle that spans from the first post to the second post. A pair of handles is connected to the axle. In this example, the handles protrude away from the axle and are angled towards the deck. A user can move the handles so that the connecting end of the handles rotates about the axle. While this example has been described with reference to the upright structure including a first post and a second post, other examples of the upright structure may include any appropriate number of posts. In other examples, the upright structure includes just a single post, three posts, or another number of posts. For the purposes of this disclosure, the term post generally refers to a structural element that is oriented upright. In examples where the treadmill includes just a single post, the post may be centrally located with respect to the deck. In other examples with a single post, the post may be positioned off-center with respect to the deck.

A torque adjuster may be rigidly connected to the handles so that when a user moves the handles, the torque adjuster rotates with the handles. In this example, the torque adjuster includes multiple openings. A first subset of openings are the handle openings. These handle openings are used to interlock the handles to the torque adjuster. The angle at which the handles protrude away from the axle depends on which of the handle openings is interlocked with the handles.

A second subset of openings defined in the torque adjuster are linkage slots. The linkage slots are spaced along the bottom side of the torque adjuster and selectively interlock with a linkage. The linkage may connect the torque adjuster to the deck. As the user moves the handles, the torque adjuster rotates with the handles. As the torque adjuster rotates, the linkage moves with the torque adjuster resulting in movement of the deck. For example, when a user lifts up on the handles, the front portion of the deck moves up. Similarly, when the user moves the handles downward, the deck is also lowered.

To perform a lift, the user may be on the deck initially in a hunched position while holding the handles. At the end of the lift, the user may stand in an upright position. The user continues to hold the handles while transitioning from the hunched position to the upright position. As the user stands, the handles are lifted from a lower elevation to a higher elevation. As the handles rotate, the torque adjuster is also rotated upwards, which applies an upward force on the linkage slot interlocked with the linkage. As a result, the linkage and the front portion of the deck are also lifted upwards. With the user standing on the deck, the user's body weight provides resistance to lifting the deck.

The upright structure's post may be connected to the axle that spans from the first post to the second post. The handles may be rigidly connected to the axle so that the axle rotates with the movement of the handles. In other examples, a sleeve is positioned around the axle and the handles are connected to the sleeve. In these examples, when the handle is moved, the sleeve rotates with the handles. In either of these embodiments, when the axle and/or sleeve is rotated by the handle, the rotation of the axle/handle causes the connection plate to move, which in turn causes the linkage and the deck to move.

In some examples, the torque adjuster is rotationally independent of the axle so that the torque adjuster can rotate about the axle. In another example, the handles may be connected to a sleeve (not shown) disposed about the axle. In those examples with a sleeve, the torque adjuster may be rigidly connected to the sleeve so that the torque adjuster is rotationally independent of the axle. In other examples, the torque adjuster is rotationally fixed to the axle so that the axle and the torque adjuster move together.

The torque adjuster may include a connection plate. In this example, the connection plate includes handle openings and linkage slots. The handle openings are located in an upper portion of the connection plate, and the linkage slots are located in a lower portion of the connection plate.

In some cases, the handle openings are connected to a first end of the handle. The handle extends away from the axle towards the user standing on the deck. The user can grip the second end of the handles while standing on the deck. As the user pulls up on the second end of the handle, the connection plate is rotated around the axle.

The handle openings may be located within a central region of the connection plate. The lower portion of the connection plate has a length that is greater than a length of the plate's upper portion. Thus, the lower portion extends beyond the upper portion lengthwise. The linkage slots are distributed from side to side on the lower portion of the plate. As a result, the linkage slots extend beyond the plate's central region and therefore extend beyond the handle openings. The distance between the handle opening connected to the handle and the linkage slot connected to the linkage defines a torque length. The greater the distance between these openings, the greater the torque length. In some examples, there is a negative relationship between the difficulty of lifting the handle and the torque length, so that the shorter the torque length the greater the load required to lift the deck.

In some cases, the connection plate has two groups of linkage slots. The first group is on the user side of the connection plate. The second group of linkage slots is on the far side of the connection plate. The first group and the second group are separated by the axle. In some examples, when the user lifts up on the handle, the user side of the connection plate rotates in an upward direction and the far side of the connection plate moves in a downward direction. Thus, in these types of examples, the user may connect the linkage to the linkage slots in the user side when desiring to perform an exercise that exerts a force on the handles in the upward direction. In this example, the deck will be raised as the user lifts up on the handle. In other cases, when the user desires to perform an exercise that involves exerting a downward force on the handle, the user may connect the linkage into the linkage slots on the far side of the connection plate. The linkage may include a first end and a second end. The first end may be connected to the connection plate and the second end may be connected to the deck.

A locking assembly may be connected to the handle, the sleeve, the axle, another component, or combinations thereof. The locking assembly may include a retractable pin that is located within a channel of the handle. The channel may be defined within a column attached to the handle. In this example, the column is welded to the outer surface of the handle. Alternatively, the channel may be defined in a thickness of the handle. In some cases, the retractable pin may be spring loaded or otherwise biased to keep the retractable pin in an extended position when at rest. While the present retractable pin is described as a spring biased pin, any number of selectively actuated pins may be used including, but in no way limited to, a solenoid, a threaded bolt, a detent biased pin, and the like. Additionally, while a pin and correlating holes are described as connecting the handle to the connection plate, any number of engagement systems may be used, including, but in no way limited to, a compression fit, hydraulic engagement members, and cut outs, and the like. While this example has been described with the channel being directly connected to the handle, in other examples, the channel is formed or otherwise attached to the axle.

Any appropriate type of exercise may be performed with the handles to move the deck with the user's body weight as resistance. A non-exhaustive list of lifts that may be performed under these conditions include squatting exercises, dead lift exercises, curling exercises, military press exercises, bench press exercises, calf raise exercises, jumping exercises, other types of exercises, or combinations thereof. In some cases, a specialized handle attachment may be connectable to the handle's second end that is specialized for a particular type of lift.

While the examples above have been described with a torque adjuster that includes a retractable pin to connect the handles to the connection plate, any appropriate type of connection mechanism may be used in accordance with the principles described herein. For example, the connection mechanism may include a pneumatic mechanism, a magnetic mechanism, a hydraulic mechanism, an electric mechanism, a compression mechanism, an interlocking mechanism, another type of mechanism, or combinations thereof. In examples with an electronic mechanism, a solenoid may be used to move a pin in and out of the openings defined in the connection plate. In another example, a magnet may be used to attach the handles to the connection plate. In this type of example and in other types of examples, the connection plate may not include a handle opening. In some instances, the magnet may attach directly to the plate without an opening. In other examples, a protrusion, grip, or another type of interlocking feature of the locking plate may provide a location for a connection mechanism to attach to the plate so that the handle is connected to the connection plate.

In another example, the torque adjuster does not include a connection plate. In one particular type of example, the handles include a section that can expand so that the length of the handles is changeable. Since the torque applied to the axle is affected by the distance from which the load is applied, the distance of the second end of the handles from the axle affects the torque. The extendable portion of the handles may include a telescoping section, a rail, an expanding material, a screw mechanism, another type of extension mechanism, or combinations thereof.

In another example, the torque adjuster may receive instructions to adjust the torque. In these examples, programmed instructions on the treadmill may causes a processor to adjust the torque. The user may access the instructions to adjust the torque through an input mechanism that is incorporated into the console. In other examples, the user may send the instructions through a remote device, like a mobile device. In further examples, programmed workouts or other programmed instructions may cause the torque to be adjusted without commands being sent from the user.

The linkage may be connected to the deck at any appropriate location. For example, the linkage may be connected to a front portion of the deck, a mid-region of the deck, a rear portion of the deck, another portion of the deck, or combinations thereof.

In some cases, the treadmill may include a belt locking mechanism that locks the tread belt in place when the user lifts the deck by moving the handles. The belt locking mechanism may include a brake. In other examples, the belt locking mechanism may include a feature that interlocks with the belt, the motor, a flywheel, or another component of the deck, or combinations thereof. In some cases, the deck may be disengaged from the motors, flywheels, other belt drivers, or combinations thereof.

While the examples above have been described with reference to deck pins, retractable pins, and other manually operated pins to selectively change the orientation of the deck, handles, or other treadmill components, any appropriate type of locking mechanisms may be used in accordance with the principles described in the present disclosure. For example, at least one of the pins may be automatically operated. A console, remote device, or other type of user interface may receive input commands from the user to determine the appropriate angles/orientations of the handles, deck, or other treadmill components. In yet other examples, a preprogrammed exercise routine may initiate the angles/orientations of the treadmill components based on the parameters of the preprogrammed workout routine.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples described herein, but is to be accorded the broadest scope consistent with the principles and novel features disclosed herein.

What is claimed is:

1. An exercise machine, comprising:
a frame;
a base portion of the frame;
a deck pivotally connected to the base portion;
an upright structure of the frame;
a handle movably attached to the frame;
a linkage connecting the handle to the deck, wherein an elevation of the deck changes when the handle is moved; and
a torque adjuster configured to modify a mechanical advantage between the handle and the linkage, the torque adjuster including a connection plate, a lower portion of the connection plate including a lower portion length different from an upper portion length of an upper portion of the connection plate,
wherein the exercise machine comprises a treadmill.

2. The exercise machine of claim 1, further comprising:
a first post of the upright structure;
a second post of the upright structure; and
an axle connecting the first post to the second post;
wherein the handle is rotatably disposed about the axle.

3. The exercise machine of claim 2, wherein
the first post is connected to the base portion;
the second post is connected to the base portion; and
the deck moves independent of the first post and the second post when the handle is moved.

4. The exercise machine of claim 2, further comprising:
an opening defined in the connection plate;
wherein the axle is disposed within the opening.

5. The exercise machine of claim 4, further comprising:
a plurality of handle slots defined in the connection plate;
wherein the plurality of handle slots are configured to selectively connect to the handle.

6. The exercise machine of claim 5, wherein the plurality of handle slots are arranged in a semi-circular arrangement on the connection plate.

7. The exercise machine of claim 6, further comprising:
a sleeve disposed about the axle;
wherein the handle is rigidly connected to the sleeve.

8. The exercise machine of claim 7, further comprising:
a locking assembly;

a housing of the locking assembly rigidly connected to the sleeve; and a retractable pin of the locking assembly partially disposed within an aperture of the housing.

9. The exercise machine of claim 8, wherein the retractable pin is configured to be aligned with at least one of the plurality of handle slots by rotating the sleeve.

10. The device of claim 1, further comprising:

a plurality of linkage slots defined in the lower portion of the connection plate;

wherein the plurality of linkage slots are configured to selectively connect to an end of the linkage.

11. The exercise machine of claim 10, wherein the plurality of linkage slots are arranged in a linear arrangement on the lower portion of the connection plate.

12. The exercise machine of claim 10, wherein the linkage is pivotally connected to a front end of the deck.

13. The exercise machine of claim 1, wherein the lower portion length is greater than the upper portion length.

14. An exercise machine, comprising:

a frame including an upright structure having a first post and a second post;

a deck connected to the frame;

a first pulley disposed at a first end of the deck;

a second pulley disposed at a second end of the deck;

a tread belt surrounding the first pulley and the second pulley;

a handle movably attached to the frame;

a linkage connecting the handle to the first end of the deck; and a torque adjuster that changes a mechanical advantage between the handle and the linkage;

wherein an elevation of the first end of the deck changes when the handle is moved;

an axle connecting the first post to the second post;

wherein the handle is configured to rotate about the axle;

wherein the deck moves independent of the first post and the second post when the handle is moved.

15. The exercise machine of claim 14, further comprising:

a connection plate; and an opening defined in the connection plate;

wherein the axle is disposed within the opening.

16. The exercise machine of claim 15, further comprising:

a plurality of linkage slots defined in the connection plate;

wherein the plurality of linkage slots are configured to selectively connect to an end of the linkage.

17. The exercise machine of claim 15, further comprising:

a plurality of handle slots defined in the connection plate;

wherein the plurality of handle slots are configured to selectively connect to the handle.

18. The exercise machine of claim 17, further comprising:

a sleeve disposed about the axle;

wherein the handle is rigidly connected to the sleeve.

19. An exercise machine, comprising:

a frame including a base portion and an upright structure having a first post and a second post, wherein the first post and the second post are connected to the base portion of the frame;

a deck pivotally connected to the frame at a rear end;

a first pulley at a first end of the deck;

a second pulley at a second end of the deck;

a tread belt surrounding the first pulley and the second pulley;

a handle movably attached to the frame;

a linkage connecting the handle to the first end of the deck;

wherein an elevation of the first end of the deck changes when the handle is moved;

an axle connecting the first post to the second post;

wherein the handle rotates about the axle;

wherein the deck moves independent of the first post and the second post when the handle is moved;

a torque adjuster that changes a mechanical advantage between the handle and the linkage;

a connection plate of the torque adjuster;

an axle receiving opening defined in the connection plate, wherein the axle is disposed within the axle receiving opening;

a plurality of linkage slots defined in the connection plate, the plurality of linkage slots selectively connect to an end of the linkage;

a plurality of handle slots defined in the connection plate, the plurality of handle slots selectively connected to the handle;

a sleeve disposed about the axle, wherein the handle is rigidly connected to the sleeve; and a locking assembly including a housing and a retractable pin, wherein the housing of the locking assembly is rigidly connected to the sleeve, and wherein the retractable pin of the locking assembly is partially disposed within an aperture of the housing.

* * * * *